US008419213B1

(12) United States Patent
Rubtsov et al.

(10) Patent No.: US 8,419,213 B1
(45) Date of Patent: Apr. 16, 2013

(54) LED-BASED INCAPACITATING APPARATUS AND METHOD

(75) Inventors: Vladimir Rubtsov, Los Angeles, CA (US); Michael Levin, Los Angeles, CA (US); Gennady Sigal, Oakville (CA)

(73) Assignee: Vladimir Rubtsov, Los Angeles, CA (US)

( * ) Notice: Subject to any disclaimer, the term of this patent is extended or adjusted under 35 U.S.C. 154(b) by 360 days.

(21) Appl. No.: 12/910,796

(22) Filed: Oct. 23, 2010

Related U.S. Application Data

(63) Continuation-in-part of application No. 12/399,701, filed on Mar. 6, 2009, now Pat. No. 7,909,484, which is a continuation of application No. 11/269,074, filed on Nov. 8, 2005, now Pat. No. 7,500,763.

(51) Int. Cl.
*F21V 9/00* (2006.01)

(52) U.S. Cl.
USPC ..... 362/231; 362/184; 362/237; 362/244; 362/249.02; 362/294; 362/311.02; 362/276; 340/573.1; 340/815.4

(58) Field of Classification Search ..... 362/184, 362/231, 237, 244, 249.02, 259, 276, 294, 362/311.02, 800; 340/573.1, 815.4
See application file for complete search history.

(56) References Cited

U.S. PATENT DOCUMENTS

| | | | | |
|---|---|---|---|---|
| 6,190,022 | B1 * | 2/2001 | Tocci et al. | 362/259 |
| 7,500,763 | B2 * | 3/2009 | Rubtsov | 362/231 |
| 7,909,484 | B2 * | 3/2011 | Rubtsov | 362/311.02 |
| 2005/0185403 | A1 * | 8/2005 | Diehl | 362/259 |
| 2006/0119483 | A1 * | 6/2006 | Rubtsov | 340/574 |

* cited by examiner

*Primary Examiner* — Stephen F Husar
(74) *Attorney, Agent, or Firm* — Lawrence S. Cohen

(57) ABSTRACT

Apparatus and method for using a light source having spatially separated light emitting areas emitting light at different wavelengths to incapacitate a subject by a pattern of temporal flashing and/or color flashing of the light source. Also, power circuitry and optics particularly suited for flashing light incapacitation are included.

30 Claims, 38 Drawing Sheets

LED-BASED INCAPACITATING APPARATUS AND METHOD

CROSS-REFERENCE TO RELATED APPLICATIONS

The present application is continuation-in-part application of the following and commonly assigned U.S. Patent Application: U.S. patent application Ser. No. 12/399,701, titled "LED-Based Incapacitating Apparatus and Method," filed on Mar. 6, 2009 now U.S. Pat. No. 7,909,484, which is a continuation of U.S. patent application Ser. No. 11/269,074, filed on Nov. 8, 2005, now U.S. Pat. No. 7,500,763, issued on Mar. 10, 2009, titled "LED-Based Incapacitating Apparatus and Method," the entire contents of all these applications and issued patents are incorporated herein by reference.

STATEMENT REGARDING FEDERALLY SPONSORED RESEARCH OR DEVELOPMENT

The U.S. Government has certain rights in this invention pursuant to Contract No. NBCHC080093 by Department of Homeland Security.

BACKGROUND

1. Field

This disclosure relates to a method and apparatus for producing flashing electromagnetic energy for incapacitating a person or animal. More particularly, the present disclosure describes flashing visible light for individual or crowd control.

2. Description of Related Art

Security devices using visible light are known in the art. For example, U.S. Pat. No. 6,007,218 describes a laser based security device that uses visible laser light at predetermined wavelengths and intensities to create temporary visual impairment to cause hesitation, delay, distraction and reductions in combat and functional effectiveness. U.S. Pat. No. 6,190,022 describes a visual security device that uses sequentially flashing multiple LEDs.

As indicated above, flashing light incapacitating apparatus may employ lasers to achieve desired incapacitating effects. However, lasers are typically expensive and, when employed in incapacitating devices, may result in unacceptable levels of eye damage. Hence, the market has not found laser-based visual incapacitating devices to be acceptable for use, especially for civilian use.

LED-based incapacitating devices are also known in the art. However, such devices typically provide insufficient irradiation levels to produce desired incapacitating effects at weights that allow desirable levels of portability.

SUMMARY

Embodiments of the present invention are based on the realization that although LEDs are an attractive alternative to lasers for use in an incapacitating apparatus, LEDs require a significant increase in power to obtain an acceptable incapacitating effect. According, an embodiment of the present invention employs a LED cluster which has, at least, a first plurality of LEDs of a first color and a second plurality of LEDS of a second color, where the first color LEDs and the second color LEDs are interspersed within the cluster. The LEDs are spaced apart a minimum distance to provide a high power level which produces an incapacitating effect over a desirable field of view and at significant distances. In a preferred embodiment, a third plurality of LEDs of a third color is interspersed within the first and second pluralities.

One embodiment of the present invention comprises an apparatus that has an array of light emitting elements, a beam former, and an element that controls flashing of the light emitting elements. The light emitting elements are flashed in a pattern that has at least two phases, where the phases are a train of light pulses. The phases preferably differ from each other in the frequency or randomness of the light pulses within a phase and/or the number or colors of the light emitting elements flashed during each phase. Another embodiment of the present invention is method for incapacitation where a light pattern having multiple phases is used to enhance the incapacitation effect.

Another embodiment of the present invention comprises an apparatus that uses a range finder to control the output optical power from an array of light emitting elements. If a subject is within a range of the light emitting elements so as to be exposed to a power level greater than a maximum permissible exposure, the range finder detects the subject's range and reduces or eliminates the optical output accordingly. Still another embodiment comprises a method for incapacitation where the range to a subject is detected and the optical power output is controlled.

Additional embodiments of the present invention provide apparatus and method for using a light source having spatially separated light emitting areas emitting light at different wavelengths to incapacitate a subject by a pattern of temporal flashing and/or color flashing of the light source. The apparatus is preferably provided in a small size and weight form factor so that the apparatus can be hand held. The apparatus preferably also embeds a power source, such as a battery, in a removable handle. A parabolic radiator or a lens may be used to concentrate light emitted from the light source and direct it towards the subject to be incapacitated. The light source preferably comprises a high brightness multiple color LED module, where each color is generated by a planar LED substrate rather than discrete LEDs.

DETAILED DESCRIPTION

Figure 1:
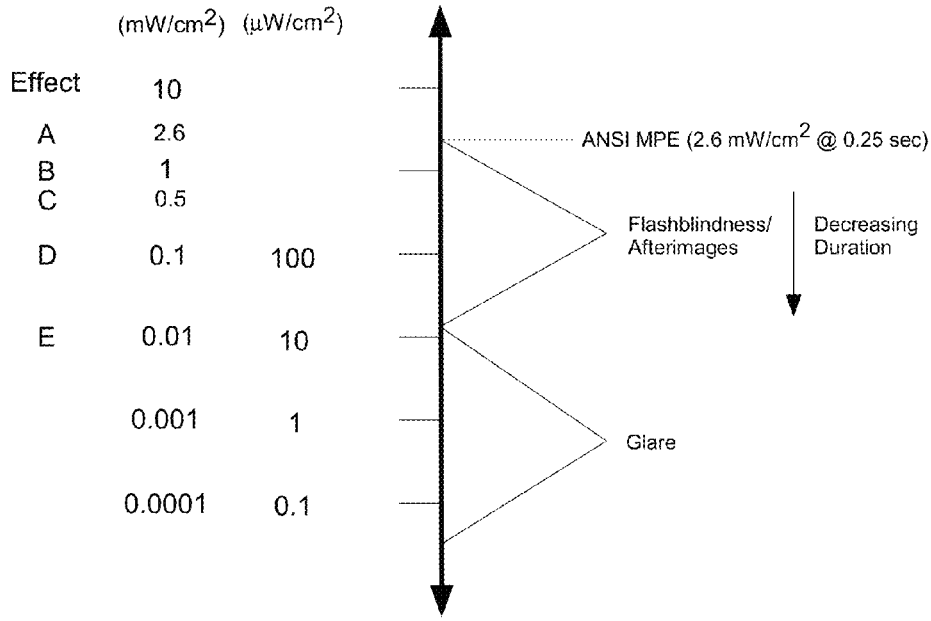
FIG. 1 shows the different levels of physiological effects that are produced from visual impairment induced by various levels of irradiance.

Embodiments of the present invention are based upon the impact on human beings when their eyes are exposed to bright, flashing light. There are three types of non-damaging effects that impact human vision when the eyes are exposed to a bright light: (1) glare, (2) flashblindness, and (3) bio-physiological effects. Which effect will occur depends on the wavelength of the light (measured in nanometers), the energy of the light beam at the pupil of the eye (measured in watts/square centimeter), whether the light source is pulsed or continuous-wave, exposure time and how many colors of light are flashing.

The glare effect is a reduced visibility condition caused by contraction of the pupil induced by a bright source of light in a person's field of view. It is a temporary effect that disappears as soon as the light source is extinguished, turned off, or directed away from the subject. Flashblindness is a reduced visibility condition that continues after a bright source of light is switched off. It appears as a spot or afterimage in an individual's vision that interferes with the ability to see in any direction. The nature of this impairment makes it difficult for a person to discern objects, especially small, low-contrast objects, or objects at a distance. The duration of the visual impairment can range from a few seconds to several minutes. The major difference between flashblindness and glare is that flashblindness persists after the light source is extinguished, whereas the glare effect does not.

The psychophysical effects of exposure to pulsed light sources are less investigated. In general, these effects are composed of a number of subjective responses ranging from distraction, to disruption, to disorientation, and to even incapacitation. This type of effect is directly related to the brain activity, and in particular to brain waves. Brain waves, periodic electrical signals that mirror shifting patterns of mental activity, tend to fall into four categories: beta, alpha, theta, and delta.

Brainwave activity tends to mirror flickering light, particularly in the alpha and theta frequencies; this effect is known as the "frequency-following effect." These findings have been used by psychologists for the therapeutic treatment of psychologically unstable patients. A number of studies, however, have indicated that many subjects find flashing lights to be very uncomfortable. Instead of treating disturbed patients, these machines cause harm, especially when the light is relatively bright.

This has led to the use of the frequency-following effect to provide a destructive effect, in nonlethal weapons. Various "less than lethal" weapons based on the frequency-following effect in military investigations have been investigated; in the majority of cases, the results of these studies are classified. Unclassified sources also report that high intensity strobe lights, which flash at or near human brain wave frequencies, cause vertigo, disorientation, and vomiting. Some devices that use stroboscopic flashing have been employed against demonstrators. In the 5-15 hertz range, these devices can cause various physical symptoms, and, in a small portion of the population, may trigger epileptic seizures.

[Flash durations, colors, and the effects of rapidly changing frequencies within the alpha-theta band have been, and are still being, investigated for their effects on brain activity. The general rule of light-brain interaction from the frequency-following effect is that all three factors play an important role in modulating brain rhythms. As these factors become more variable and more random, they introduce more modulation, and thus more confusion in the brain rhythms.

Since the early 1970s, programs related to optical nonlethal weapons have been started and stopped several times. On some occasions, safety measures were ignored, and lasers (which were used as light sources in virtually all cases) caused permanent damage to an individual's eye. Embodiments of the present invention will generally use the guidance of the safety standards developed by the Laser Institute of America, ANSI Z136.1-2000, Safe Use of Lasers and Bright Light Sources. The Laser Institute safety standards provide a number of rules that should be followed for the safe use of lasers and extended sources of bright light. It is preferred that use embodiments of the present invention is non-damaging to the human eye, therefore, the intensity present at a subject's eye should be below the threshold for permanent damage. The definitive safety parameter, as defined in ANSI Z136.1-2000, is the Maximum Permissible Exposure (MPE). ANSI Z136.1-2000 presents an MPE diagram that shows the relationship between intensity and exposure, and the Eye-Damage Threshold.

The Eye Damage Threshold defines the upper boundary of the regime for eye-safe operation (typically measured in $W/cm^2$) and ranges from 0.0583 $W/cm^2$ for extremely short exposures to less than 0.0001 $W/cm^2$ for extended exposures. The lower boundary of 0.0001 $W/cm^2$ is also considered to be the lower limit of intensity for any useful degree of glare and flashblindness. For pulses shorter than 0.01 seconds, the eye typically does not respond sufficiently for any useful effects to occur. The MPE diagram provides parameters for a single exposure, but embodiments of the present invention rely upon a train of pulses to obtain an effective bio-physiological effect. Calculations for MPE for a train of pulses are discussed below.

Different levels of irradiance at the eye will have different levels of incapacitating effects. R. J. Rockwell, et al. in "Safety Recommendations of Laser Pointers," Laser-Resources, http://www.laser-resources.net/pointer-safety.htm (Apr. 15, 2003), show a chart that classifies visual impairment effects according to different intensities of light for exposure of 0.25 sec (the time equal to the aversion response or blink effect). FIG. 1 summarizes this data. FIG. 1 shows effects ranging from very strong flashblindness (which includes vertigo, disorientation, and startle) to simple glare (see right column of FIG. 1) versus irradiance level on the eye (left column of FIG. 1). The strongest effects appear when the irradiance is at the MPE level, which is 2.6 $mW/cm^2$, or above. The arrow on the right side of FIG. 1 pointing down indicates a decrease of the effectiveness, as the exposure time diminishes.

Table 1 below summarizes the various levels of impairment produced by various levels of irradiance as shown in FIG. 1. These levels (levels A-E) provide guidance as to the effects expected to be produced by some embodiments of the present invention equivalent to the effects produced by a single exposure for 0.25 seconds.

TABLE 1

| Effects Produced | Equivalent to Irradiance Levels Shown in FIG. 1 | Required Power (% of MPE level) |
|---|---|---|
| A. Very strong: severe flashblindness with afterimages, startle, disorientation, vertigo, occasional vomiting. | 2.6 $mW/cm^2$, MPE for a single exposure | 100% |
| B. Strong: strong flashblindness with afterimages, startle, disorientation, vertigo | 1 $mW/cm^2$ | 38.4% |
| C. Moderate to strong: strong flashblindness with afterimages, disorientation, startle | 0.5 $mW/cm^2$ | 19.23% |
| D. Moderate: flashblindness with afterimages, disorientation, occasional startle | 0.1 $mW/cm^2$ | 3.84% |
| E. Weak: strong glare, flashblindness, occasional afterimages | 0.01 $mW/cm^2$ | 0.384% |

The table above summarizes the effects caused by a single exposure to continuous light, but embodiments of the present invention provide trains of light pulses. Hence, MPE calculations for a train of pulses should be performed. The light sources used in embodiments of the present invention may be considered to be extended sources of radiation. An extended radiation source is defined as a source viewed by the observer at an angle larger than $\alpha_{min}$, which is 1.5 mrad. The formula for calculating $MPE_{pulses}$ in terms of source energy level for extended light sources is given in ANSI Z136.1-2000:

$$MPE_{pulses} = 1.8 \times C_E \times n^{-0.25} \times \tau^{0.75} \frac{\text{mJ}}{\text{cm}^2}, \quad \text{Eq. 1}$$

where $\tau$ is the pulse duration or exposure time, n is the number of pulses in the train, $C_E = \alpha/\alpha_{min}$ when $\alpha_{min} \leqq \alpha \leqq \alpha_{max}$, and where $\alpha_{max}$ is 100 mrad ($\alpha$ is the angle at which the aperture of the device is observed from the target plane).

In terms of irradiance, for average pulse power, $$MPE\text{: } E_{pulses} = MPE_{pulse} \frac{F}{d},$$

where F is the frequency, and d is the pulse duty cycle. Since only part of the energy reaches the human retina through the iris (approximately 7 mm in diameter), the $MPE_{pulses}$ must be reduced by a factor of 0.775. The final formula is:

$$MPE\text{: } E_{pulses} = \frac{1.8 \times \tau^{0.75} \times C_E \times n^{-0.25} \times F}{0.775 \times d} \frac{\text{mW}}{\text{cm}^2}. \quad \text{Eq. 2}$$

At the preferred frequencies of 7-15 Hz, a single exposure duration of 0.25 sec is not achievable, therefore, a number of pulses should be applied to accomplish an incapacitating effect. As shown in Eq. 2, the MPE, and hence the strongest effect, could be provided at any level of irradiance by applying the respective number of pulses, while maintaining the equivalence of the other parameters. There would be more pulses at lower irradiance and vice versa. In turn, the number of pulses will define the incapacitating time. To estimate this time, the formula is rewritten as:

$$n = \left( \frac{1.8 \times \tau^{0.75} \times C_E \times F}{0.775 \times d} \times \frac{1}{MPE : E_{pulses}} \right)^4, \quad \text{Eq. 3}$$

and the irradiance emitted by the device considered to be the MPE. The number of pulses derived from Eq. 3 gives the estimated time necessary to produce the highest level of the incapacitating effect at a given irradiance, frequency, pulse duration, device aperture size, and distance to the target.

The visual impairment that is produced by intense flashing light has a cumulative effect; therefore, the dosage of radiation received depends on the number of pulses delivered. As fewer pulses are delivered, the MPE would be higher (see Eq. (1)). The number of pulses necessary to produce a visual impairment effect at a level of irradiance lower than MPE can be estimated by using the equation:

$$n_I = \frac{n_{MPE}}{A}, \quad \text{Eq. 4}$$

where $$A = \frac{I_{MPE}}{I}$$

($I_{MPE}$ is the irradiation produced by a device (which is considered the MPE), and I is the level of irradiance under consideration).

By substituting Eq. 1 for Eq. 4, the final Eq. 3 is rewritten as:

$$n = \left(\frac{1.8 \times \tau^{0.75} \times C_E \times F}{0.775 \times d} \times \frac{1}{A \times MPE : E_{pulses}}\right)^4 \quad \text{Eq. 5}$$

Eq. 5 may then be used to calculate the time durations necessary to produce visual impairments effects at levels equivalent to the single irradiance levels of 2.6, 1, 0.5, 0.1 and 0.01 mW/cm$^2$ for a given frequency of pulses. The values of A are 1, 2.6, 5.2, 26 and 260, respectively. These values were selected to provide the degrees of incapacitation (A, B, C, D, and E) shown in Table 1.

The spectral sensitivity of the human eye to visible light is well documented in numerous references. The human eye has a maximum sensitivity to green light at 532 nm in daytime conditions, and to cyan (blue-green) color at nighttime. In contrast, the sensitivity to red light (620-630 nm) is a few times less during daytime, and is extremely low at nighttime. Hence, one embodiment of the present invention flashes with at least two colors: green and cyan. This combination of colors provides for effectiveness during both daytime and nighttime conditions.

The strictly physiological effects of color are known in the art. Blue stimulates the anterior hypothalamus, which harbors the main regulating part of the parasympathetic nervous system. This means that all colors in the bluish spectrum—from blue/green through blue to violet—normally have a sedating, digestion-activating, sleep-inducing effect. Red simulates the posterior hypothalamus and therefore the sympathetic nervous system. Red provokes anger. All colors in the red spectrum—from magenta through red/orange to yellow—have a stimulating, sometimes even provocative, character. Green mediates between both systems.

A side-branch of the optic nerve tract reaches the amygdala directly, bypassing the hypothalamus. The two corpora amygdaloidea comprise the color sensitive area of the limbic system, and are highly responsive to the color to which the eyes are exposed. One study demonstrated that each monochromatic color frequency excites specific neurons. If adjacent, but dissimilar color-wavelengths are used, the same neuron stays unexcited. Each frequency in the color spectrum therefore has its own specific neurological and psychological effect. A neurosurgeon, Norman Shealy, M.D., Ph.D. conducted a study investigating biochemical changes in the brain after beaming different colors into the eye. Remarkable changes were evident in the concentration of the following neurotransmitters in the cerebro-spinal fluid: norepinephrin (having an identical structure to epinephrine, increasing heart rate, as well as blood pressure), serotonin (mood regulator, lack of norepinephrin causes depression), beta-endorphin (pain killer), cholinesterase (cholinesterase inhibition is associated with a variety of acute symptoms such as nausea, vomiting, blurred vision, stomach cramps, rapid heart rate), melatonin, oxytocin, growth-hormone, LH, prolactin, and progesterone. (These results explain why emitting different colors into the eye can have a profound effect on the hormonal system, the emotions, stress levels, sleep, brain function, and many other aspects of the person's biochemistry and well-being.)

Hence, embodiments of the present invention take advantage of both the exposure of a person to bright flashing lights and to light of selected colors.

Figure 2:
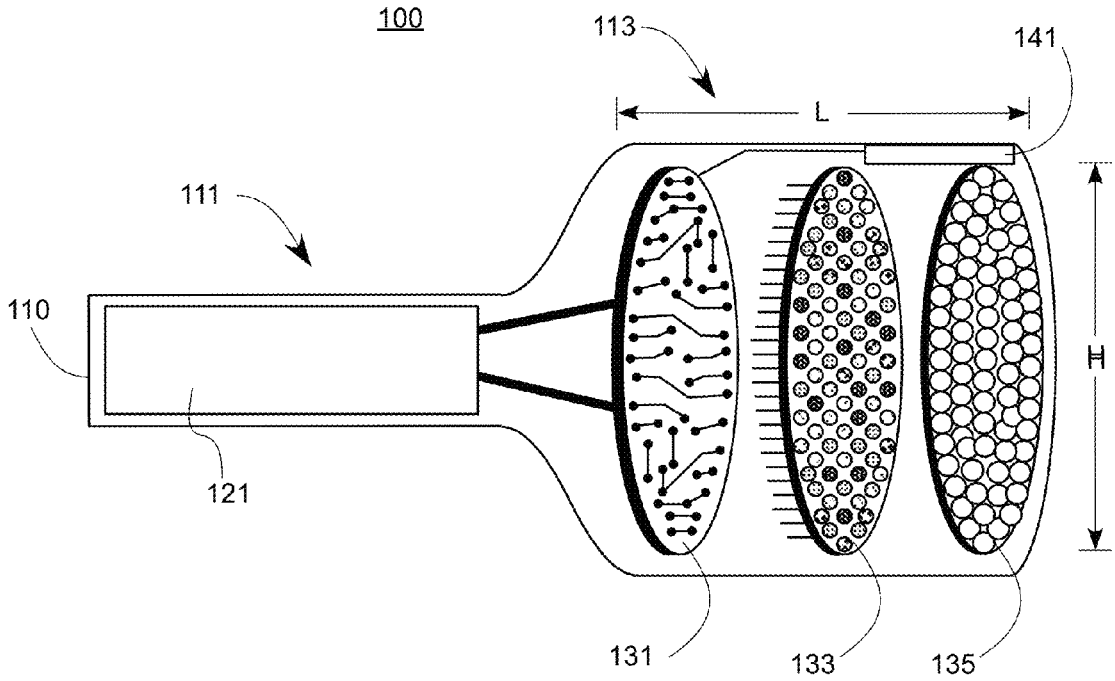
FIG. 2 is a schematic view of an exemplary embodiment of the present invention.

FIG. 2 illustrates an apparatus 100 in accordance with one embodiment of the present invention. The apparatus 100 has a case 110, which contains the operating components of the apparatus 100. The operating components comprise a power supply 121, an electronics control module 131, a LED array 133, and a beam former 135. The operating components may also include a range finding device 141.

FIG. 2 shows the case 110 having the general shape of a typical flashlight, having a handle portion 111 and a head portion 113. The handle portion is preferably sized to contain the power supply 121. The head portion 113 is preferably sized with a length L and a diameter D to contain the electronics control module 131, the LED array 133, and the beam former 135. Other embodiments of the present invention may place at least some of the components in other areas of the case or may have altogether different case shapes.

The power supply 121 preferably comprises a rechargeable battery or rechargeable battery pack. One type of rechargeable battery used in an embodiment of the present invention is a high power lithium battery, such as Model TLM-1550HP from Tadiran Batteries assembled in a battery pack. This type of battery has the ability to handle pulses of up to 15 A with a 5 A maximum continuous load at 4.0V. The power supply 121 may also comprise a receptacle for connection to an external power source. The power supply 121 may also additionally comprise power conditioning electronics or circuitry for provision of proper power forms to the electronics control module 131.

The electronics control module 131 receives power from the power supply 121 and controls the emission of light from the LEDs on the LED array 133. As is described in additional detail below, the electronics control module 131 controls the flashing of the LEDs on the LED array 133 to achieve desired flash patterns. FIG. 2 depicts the electronics control module 131 as being circuitry disposed on a single circular shaped substrate, but other embodiments may use multiple substrates, electronic circuit modules, or other means or apparatus known in the art for providing and/or containing electronic circuitry.

Figure 3:
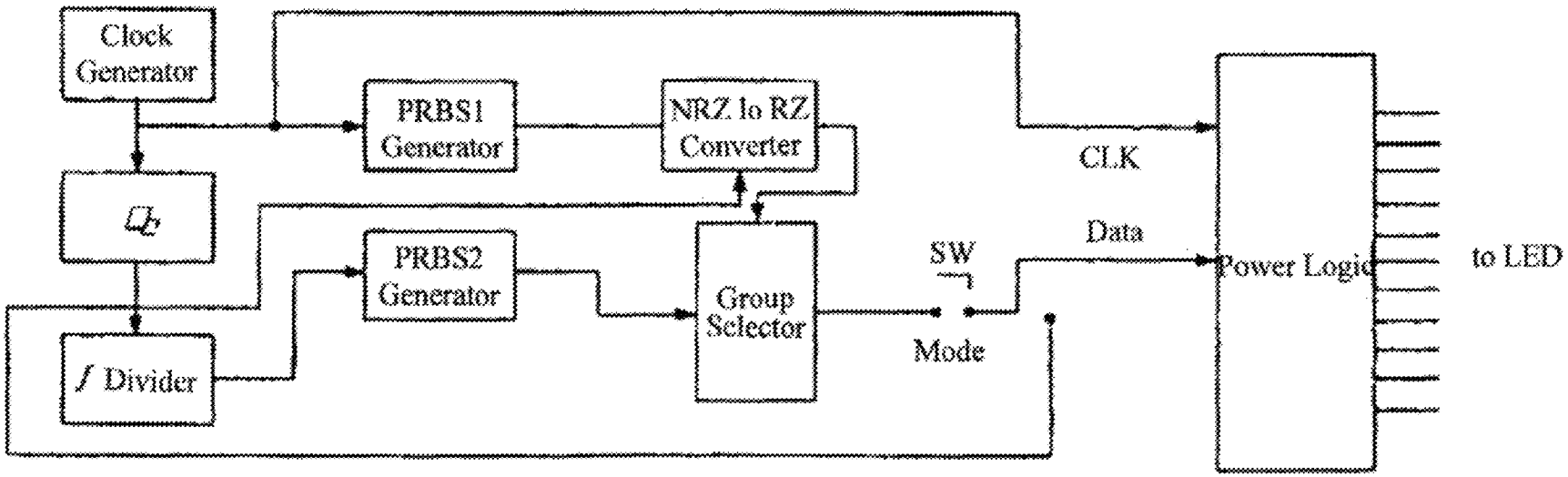
FIG. 3 shows a block diagram of a system to provide pseudorandom flashing of LEDs.
Figure 4A:
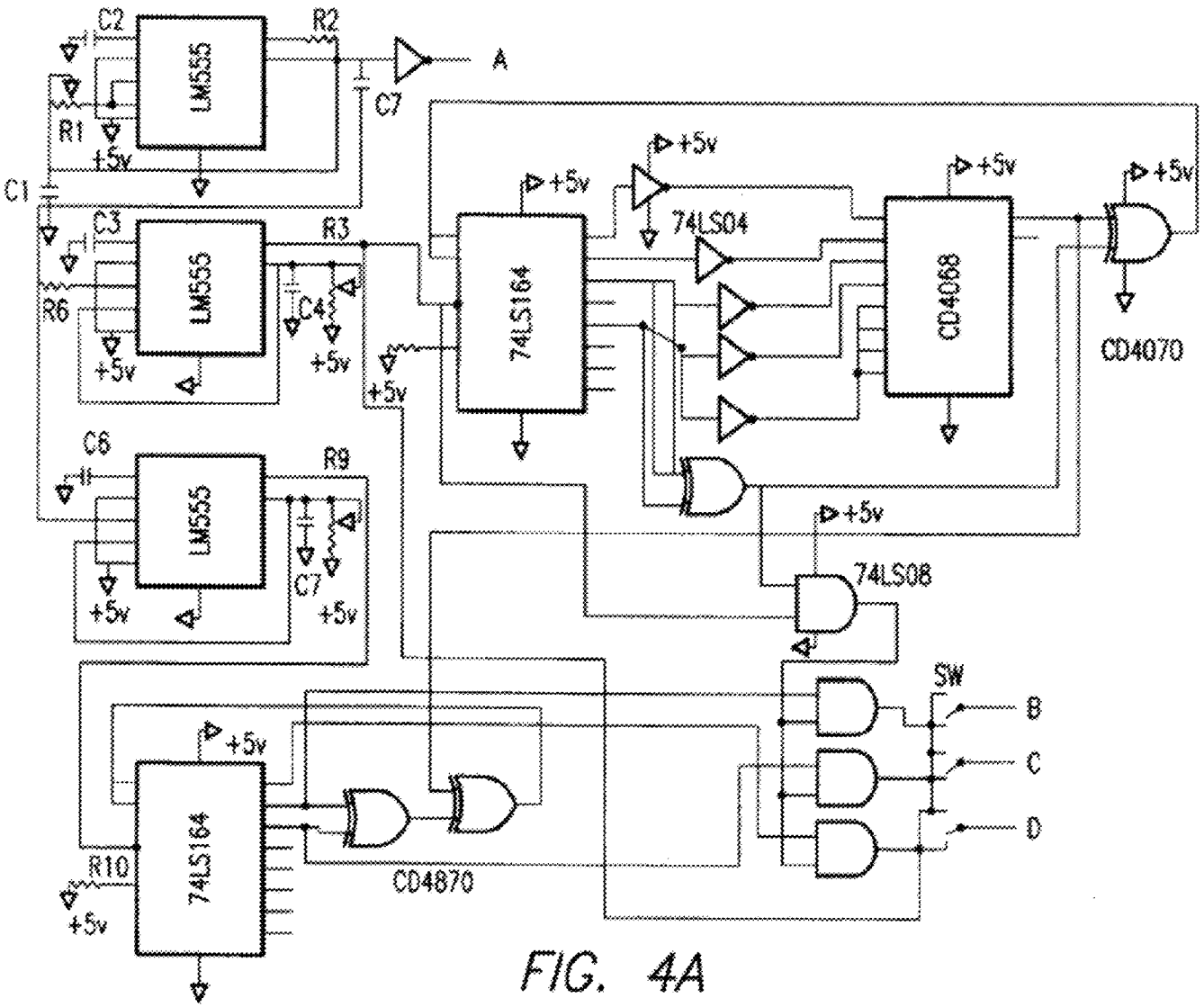
FIGS. 4A and 4B shows a circuit schematic for a pseudorandom flashing control circuit.
Figure 4B:
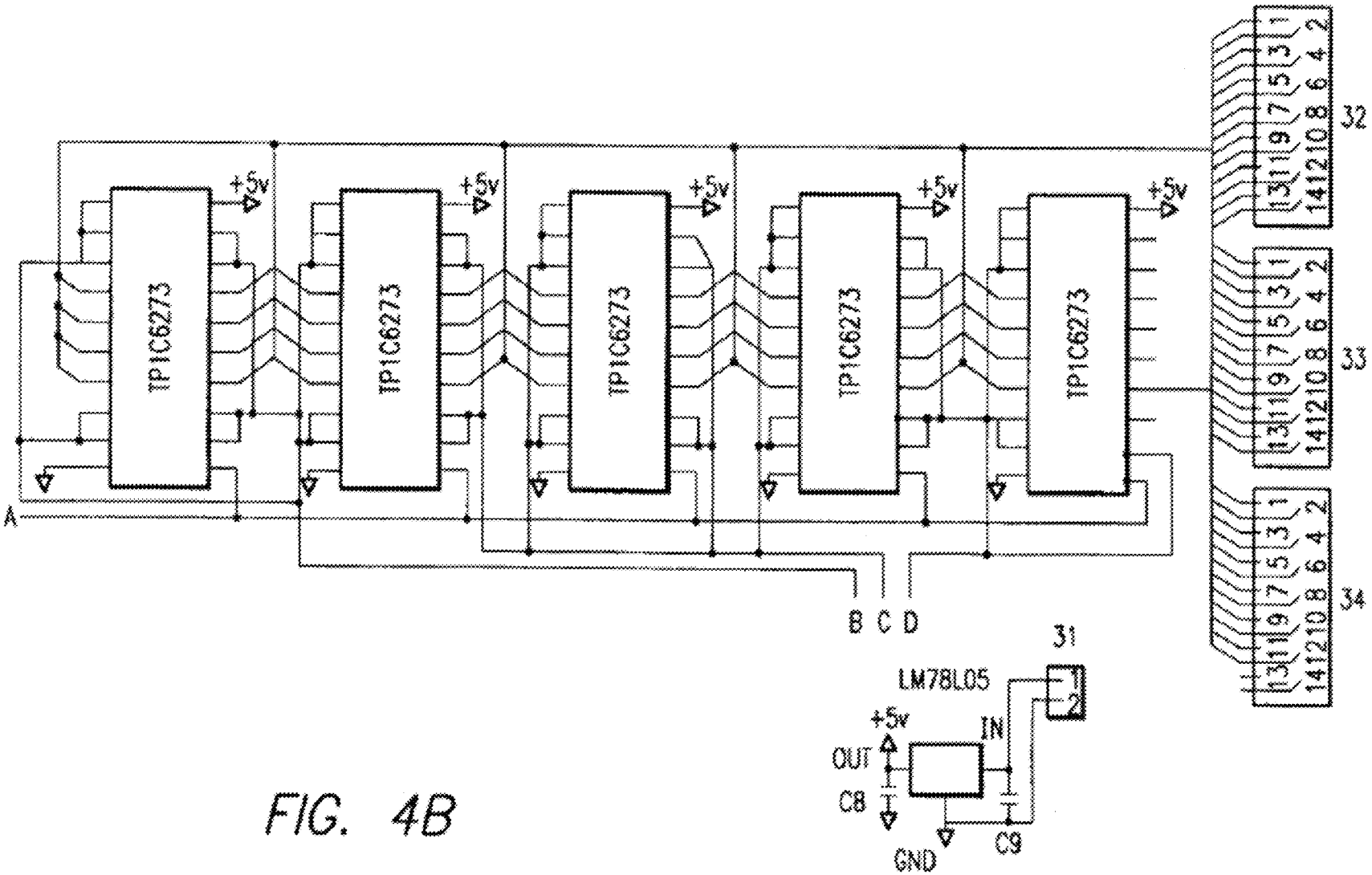

The electronics control module 131 provides the ability to flash some or all of the LEDs on the LED array 133 in a periodic and/or nonperiodic manner. The periodic manner comprises pulsing the LEDS on and off at a selected frequency, where the on duration of the LEDs is preferably less than the off duration. The selected frequency is preferably between 5 Hz and 15 Hz. The nonperiodic manner comprises pulsing the LEDs on and off, where the on durations are preferably the same, while the off durations vary randomly or pseudo randomly. In this nonperiodic flashing, the time from the start from one light pulse to the start of the next light pulse preferably varies between 0.666 seconds and 0.2 seconds. FIG. 3 shows a block diagram for a system to provide pseudorandom flashing of the LEDs and FIGS. 4A and 4B show a circuit schematic for pseudorandom flashing control.

The LED array 133 can be an array of discrete LEDs or it can be one or more LED clusters. For example, one embodiment may employ high power discrete LEDs, such as the Luxeon V emitters from Lumileds, which are disposed on a surface and coupled to the electronics control module 131.

The discrete LEDs preferably comprise LEDs of different colors. The Luxeon V emitter can provide a luminance flux of 160 lm, which helps obtain the high radiance that is preferred in embodiments of the present invention.

As indicated, the LED array 133 may comprise one or more LED clusters, such as those LED clusters available from Norlux Corp. Such LED clusters typically comprise a number of light emitting dies incorporated on a metal substrate in a honeycomb arrangement. Dies emitting different colors can be fabricated on one substrate plate. The number of dies, the dimensions of the dies, and the separation between the dies define the luminance flux (or radiant power) of the cluster. Norlux has provided LED clusters with green and red dies, where the green cluster has provided a luminous flux up to 850 lm (1.9 W of radiant power) in a continuous wave mode and the red cluster has provided a luminous flux up to 600 lm (4 W of radiant power) in the continuous wave mode. Higher radiant powers are to be expected when the LED clusters are operated in a pulsed mode.

The beam former 135 is an optical element that functions to form a desired beam or beams from the light emitted by the LED array 133. LEDs typically emit light with a high divergence angle, so the beam former preferably functions to form a light beam with a smaller divergence angle. If individual LEDs are used in the LED array 133, individual collimating LED lenses may be used with each LED. Collimating, non-imaging, single LED lenses with divergence angles of 12°, 8°, and 4° are known in the art. The use of such lenses helps increase the irradiance produced by the apparatus 100. However, as the divergence angle decreases with such a lens, the overall diameter of the lens increases. This then increases the overall diameter of the apparatus or reduces the number of individual LEDs that may be used.

Figure 5:
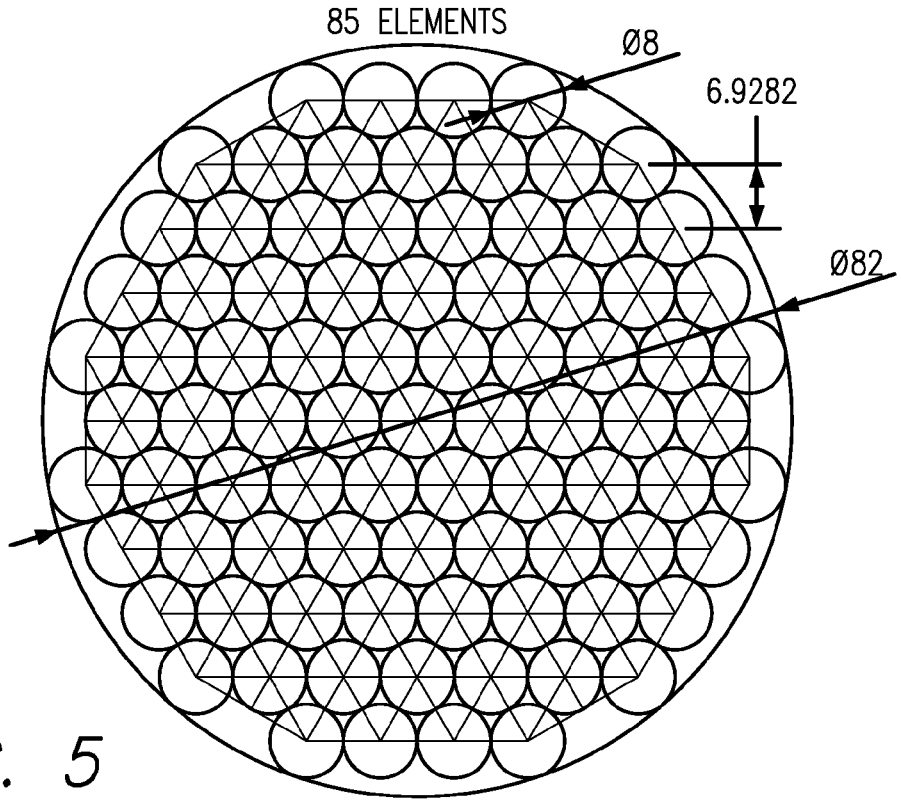
FIG. 5 illustrates the geometry of an exemplary LED cluster.
Figure 6:
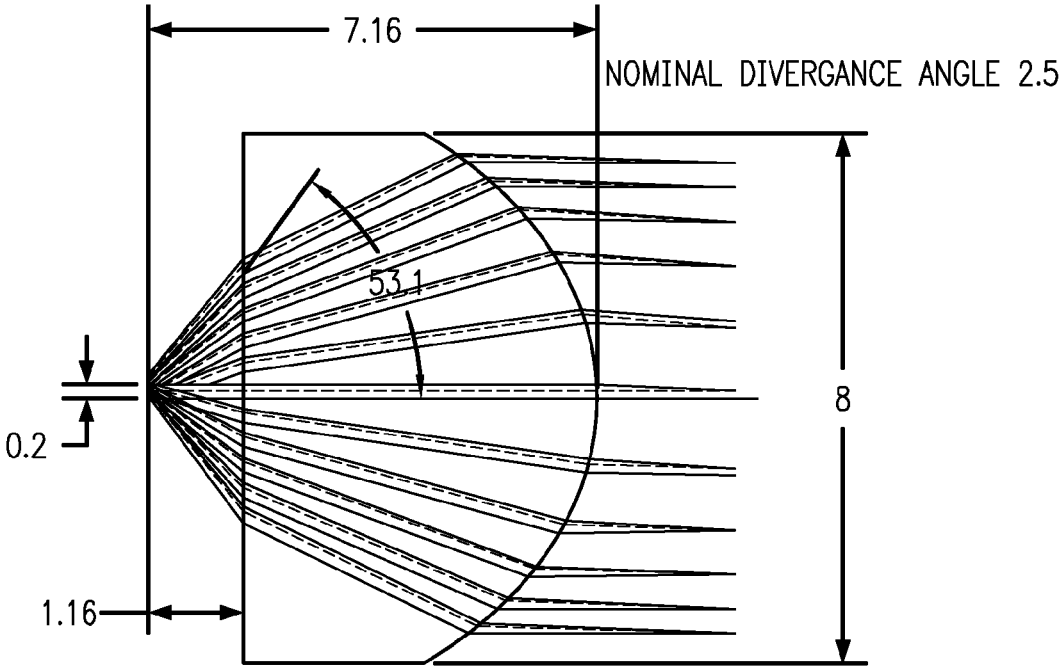
FIG. 6 illustrates the basic lens for a single lens microstructure.
Figure 7A:
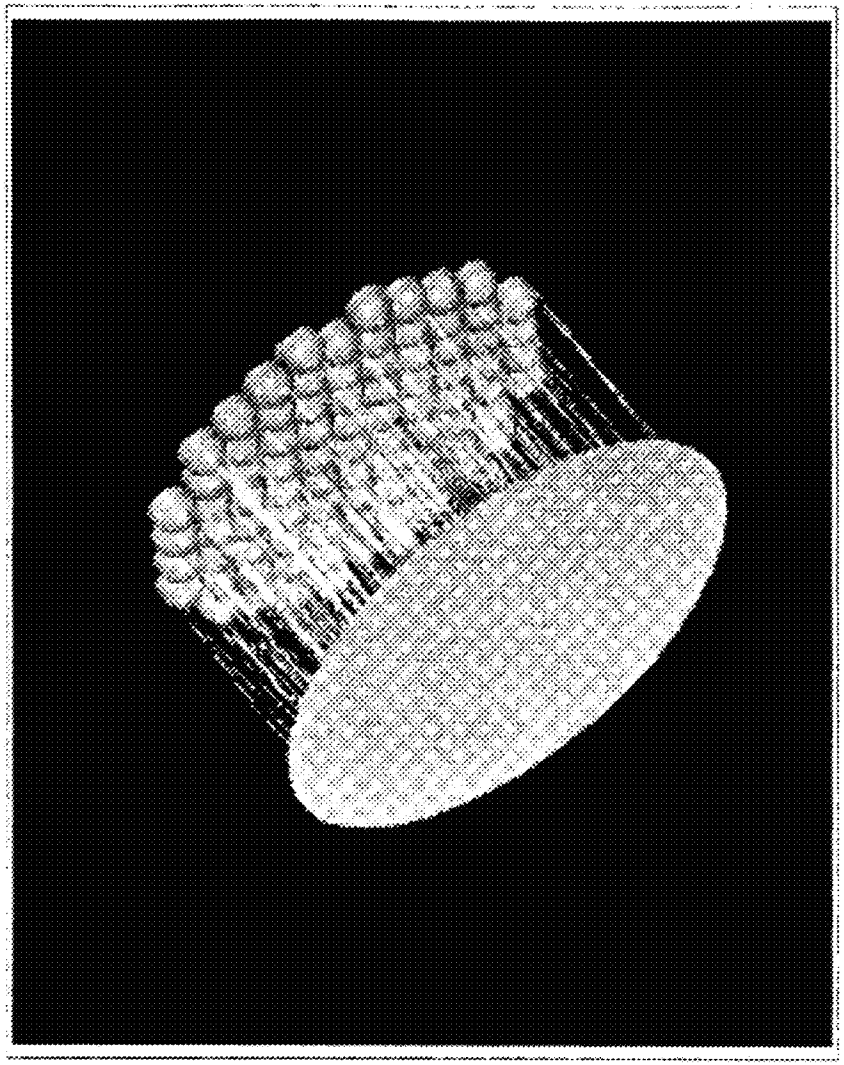
FIG. 7A shows a three-dimensional view of the lens microstructure shown in FIG. 6.

If the LED array 133 comprises one or more LED clusters, the use of microstructured lens is preferred to provide the beam former 135 for light emitted from the dies of the LED clusters. FIG. 5 illustrates a geometry for arranging the dies on a substrate. A single lens microstructure may be preferred to provide the beam former 135 for preferred embodiments of the present invention. FIG. 6 illustrates the basic lens for a single lens microstructure (where a lens is disposed at each die location on the LED cluster). FIG. 7A illustrates a three dimensional view of the entire microstructured beam former using the lens depicted in FIG. 6.

Figure 7B:
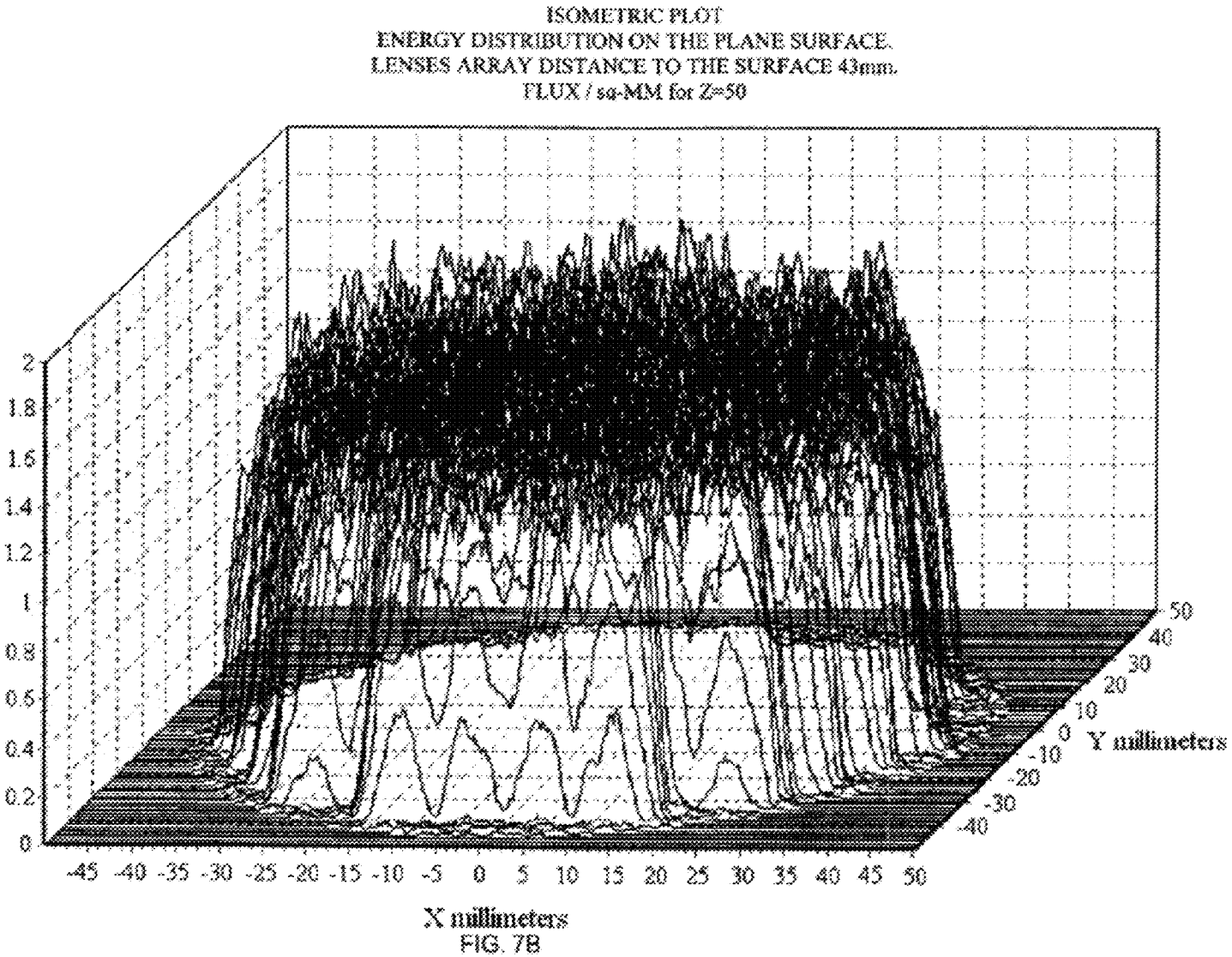
FIGS. 7B-7D show the results for calculations based on the lens microstructure depicted in FIG. 6.
Figure 7C:
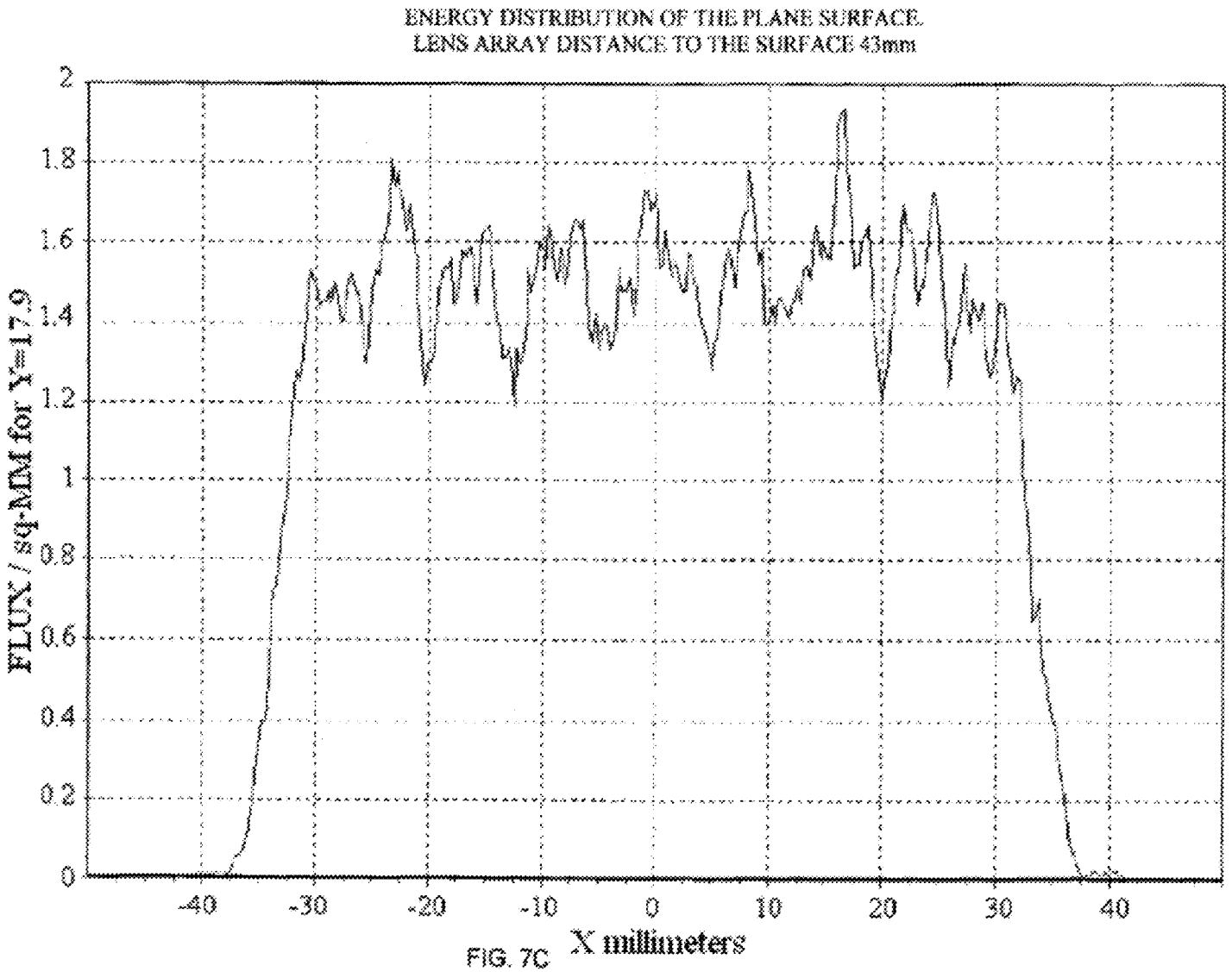
Figure 7D:
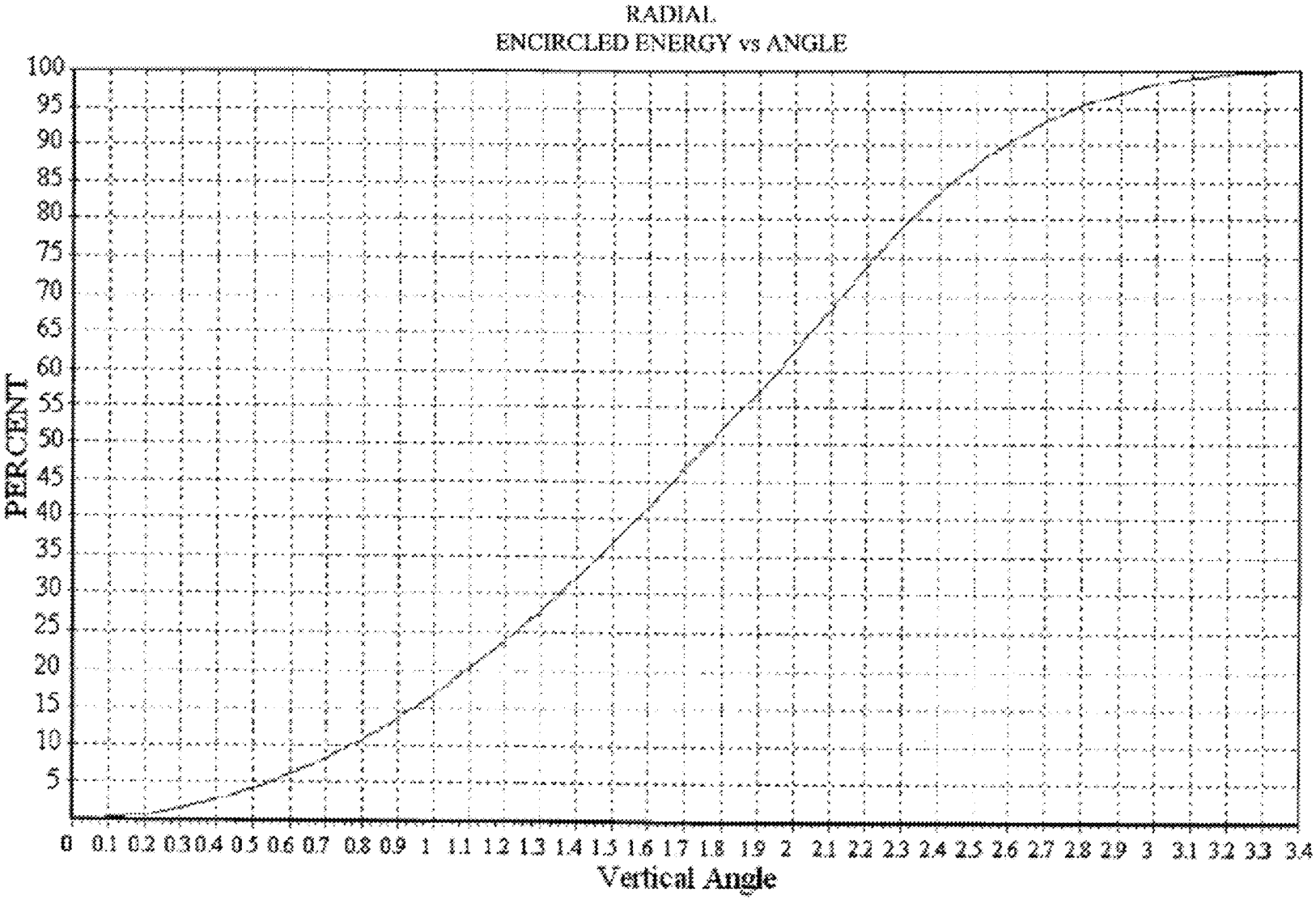
Figure 8A:
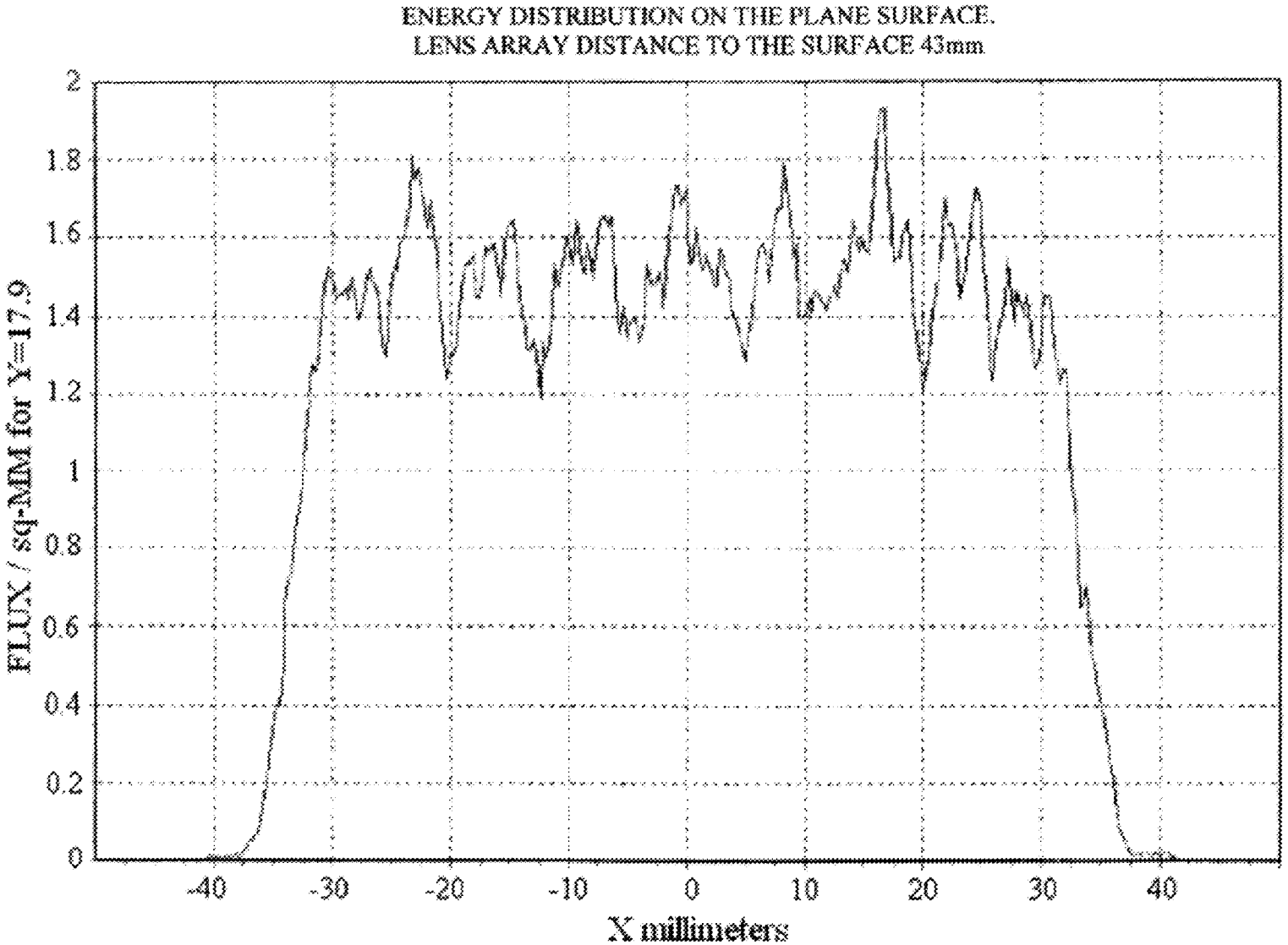
FIGS. 8A-8D show the energy distribution along an illuminated area at different distances from the lens microstructure shown in FIG. 6
Figure 8B:
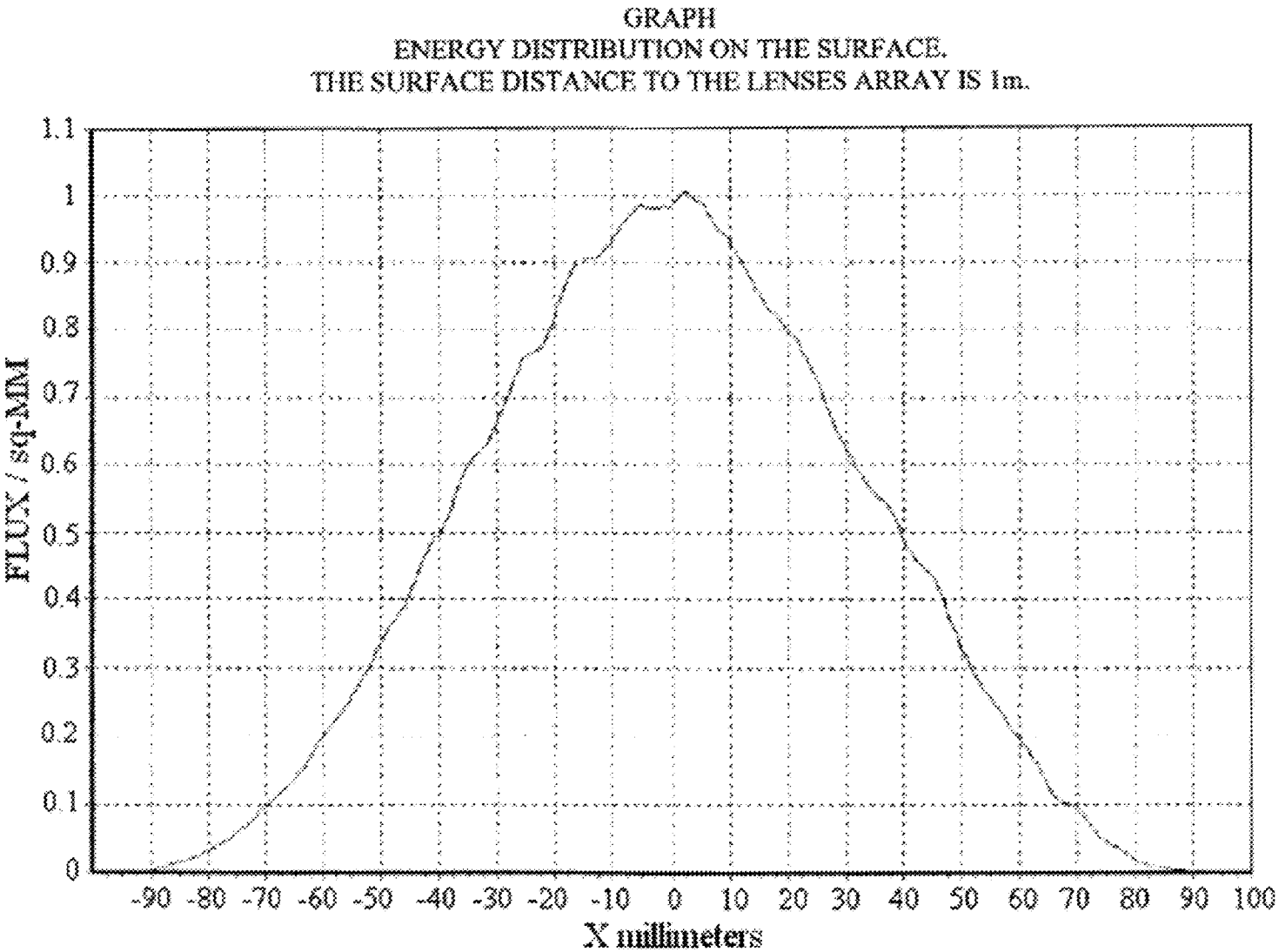
Figure 8C:
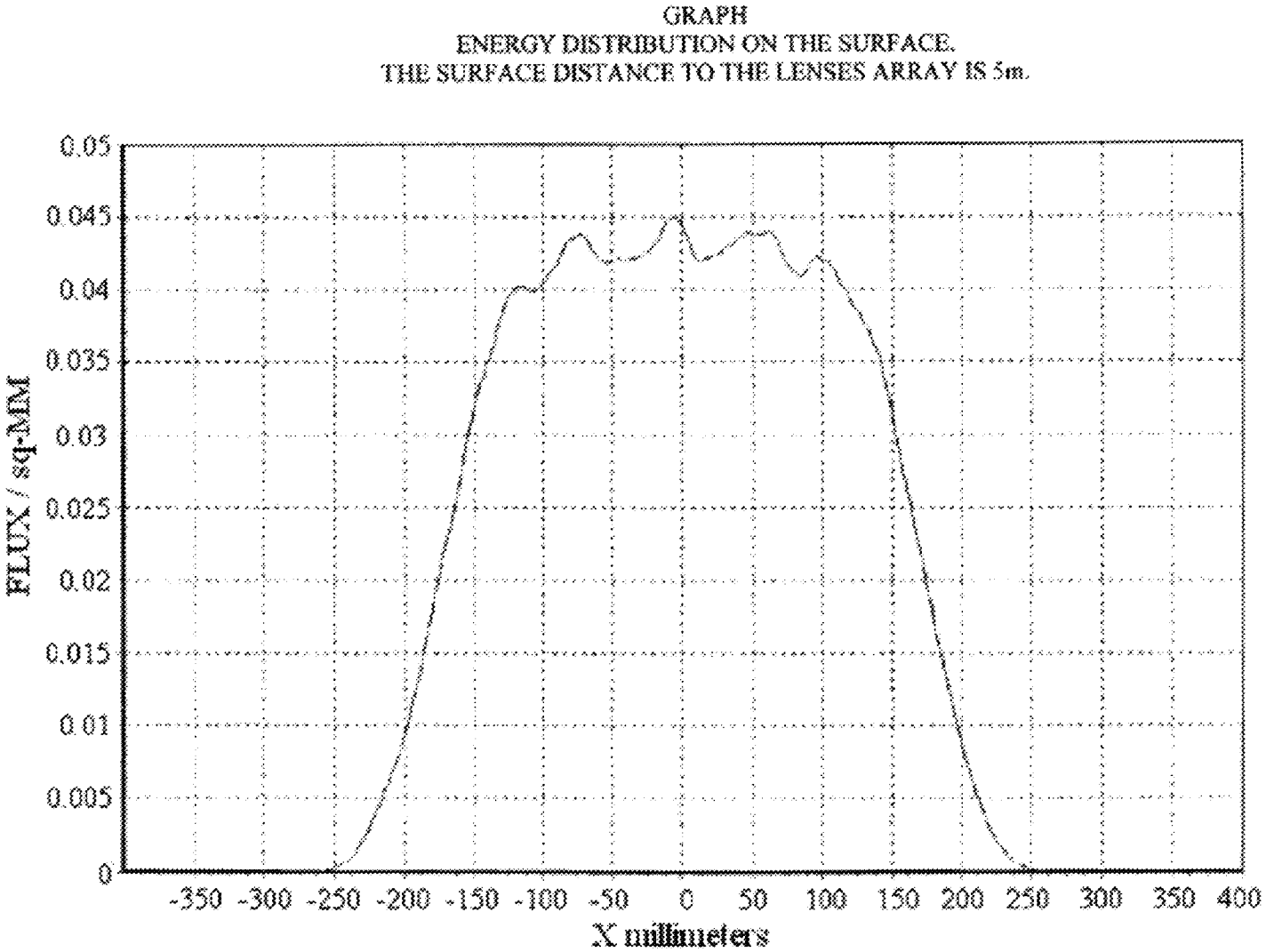
Figure 8D:
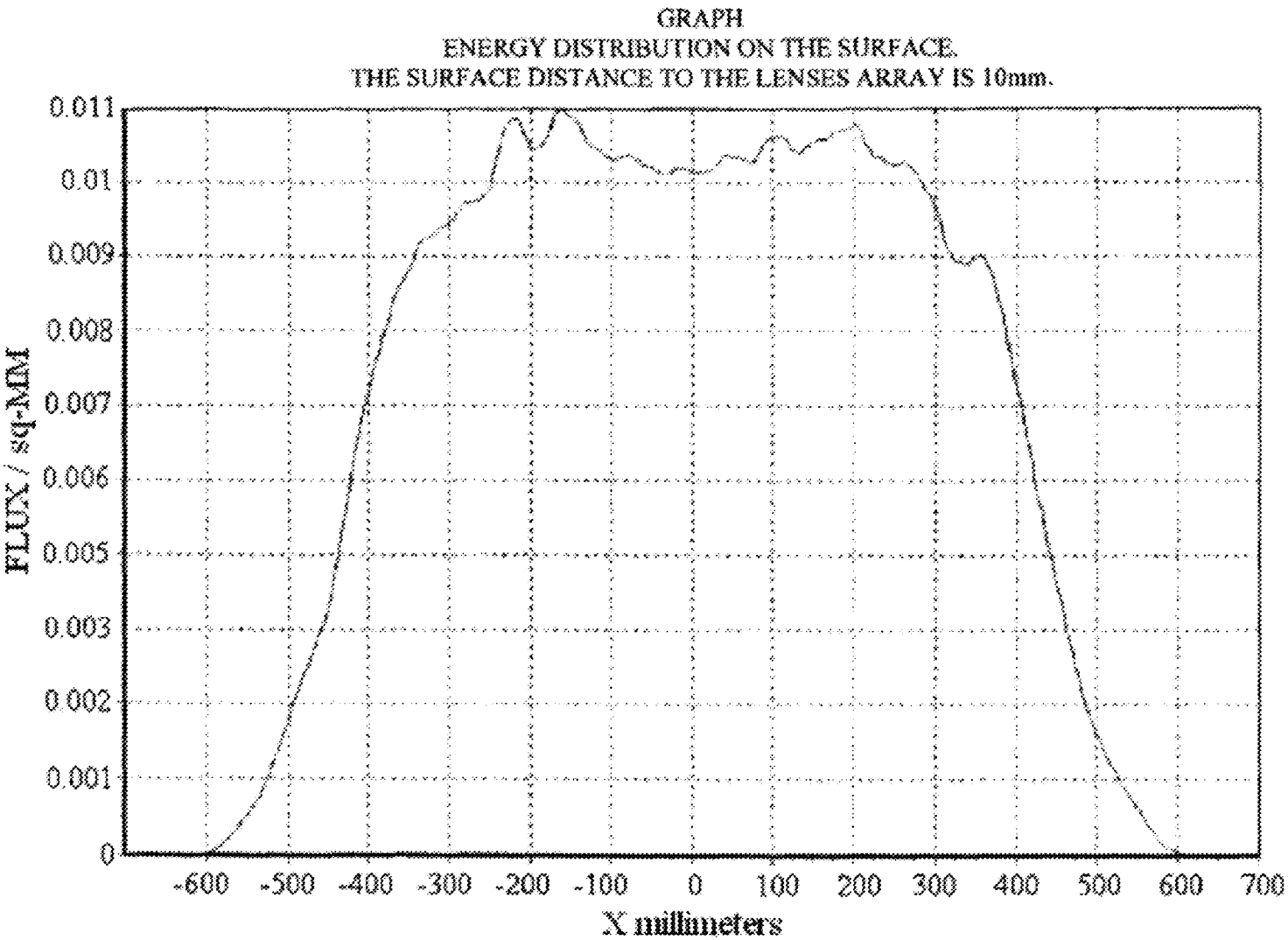

Calculations were performed to determine the performance of a round LED cluster with the spacing shown in FIG. 5 and a lens microstructure such as the one depicted in FIGS. 6 and 7A. The calculations were performed assuming circular dies on the LED cluster with diameters of about 0.4 mm and die spacing of about 7 mm. The diameter of each lens in the microstructure is 8 mm and the overall diameter of the microstructure is equal to or just slightly later than the LED cluster. The lens microstructure is preferably made with plastic from Carl Zeiss/Claret with n=1.74 and the thickness of the micro structural lens is about 7.5 mm. Such a lens could be manufactured with polycarbonate. Calculations based on the lens microstructure are shown in FIGS. 7B-7D. FIG. 7B shows the expected 3D flux distribution from the lens microstructure. FIG. 7C shows the total flux distribution graph. FIG. 7D shows the angular radiant power distribution. FIGS. 8A-8D show the energy distribution along an illuminated area at different distances from the lens microstructure: 8A is at 43 cm; 8B is at 1 m; 8C is at 5 m; and 8D is at 10 m.

With the lens microstructure and LED cluster combination described above, the expected divergence angle is ±2.5°, the light coupling from the source is close to 90% (the full coupling angle is greater than 90°), and the loss of light in the output beam outside the 5° full angle is less than 10%. These results present a significant over other lens designs used with LED clusters, where coupling efficiencies between the cluster and lens of only 70% were seen. Hence, this combination provides a way to achieve increased output powers.

With the die diameter and die spacing described above, the overall cluster diameter would be 3.5 inches and the substrate would have 91 dies. Increased power would be obtained by increasing the number of dies on the substrate, but this would also result in an increased overall cluster diameter. Table 2 summarizes the number of dies and cluster diameters used in additional performance calculations.

TABLE 2

| Substrate Diameter (inch) | 3 | 3.25 | 3.5 | 3.75 | 4 | 4.25 | 4.5 | 4.75 | 5 | 5.25 | 5.5 | 5.75 | 6 | 6.25 |
|---|---|---|---|---|---|---|---|---|---|---|---|---|---|---|
| N of dies | 61 | 85 | 91 | 121 | 127 | 163 | 169 | 211 | 217 | 265 | 271 | 325 | 331 | 391 |

Additional calculations were performed to account for manufacturing tolerances that may be seen in the manufacture of clusters and in lens microstructures. The die dimensions and pitches typically do not vary more that 0.1 mm. If the lens is fabricated with the usual tolerances for optics (less than 0.05 mm for stock optics), the overall tolerances would be in the 0.1 mm range. With such tolerances, the increase in beam divergence would be increased to 2.32°.

Figure 13A:
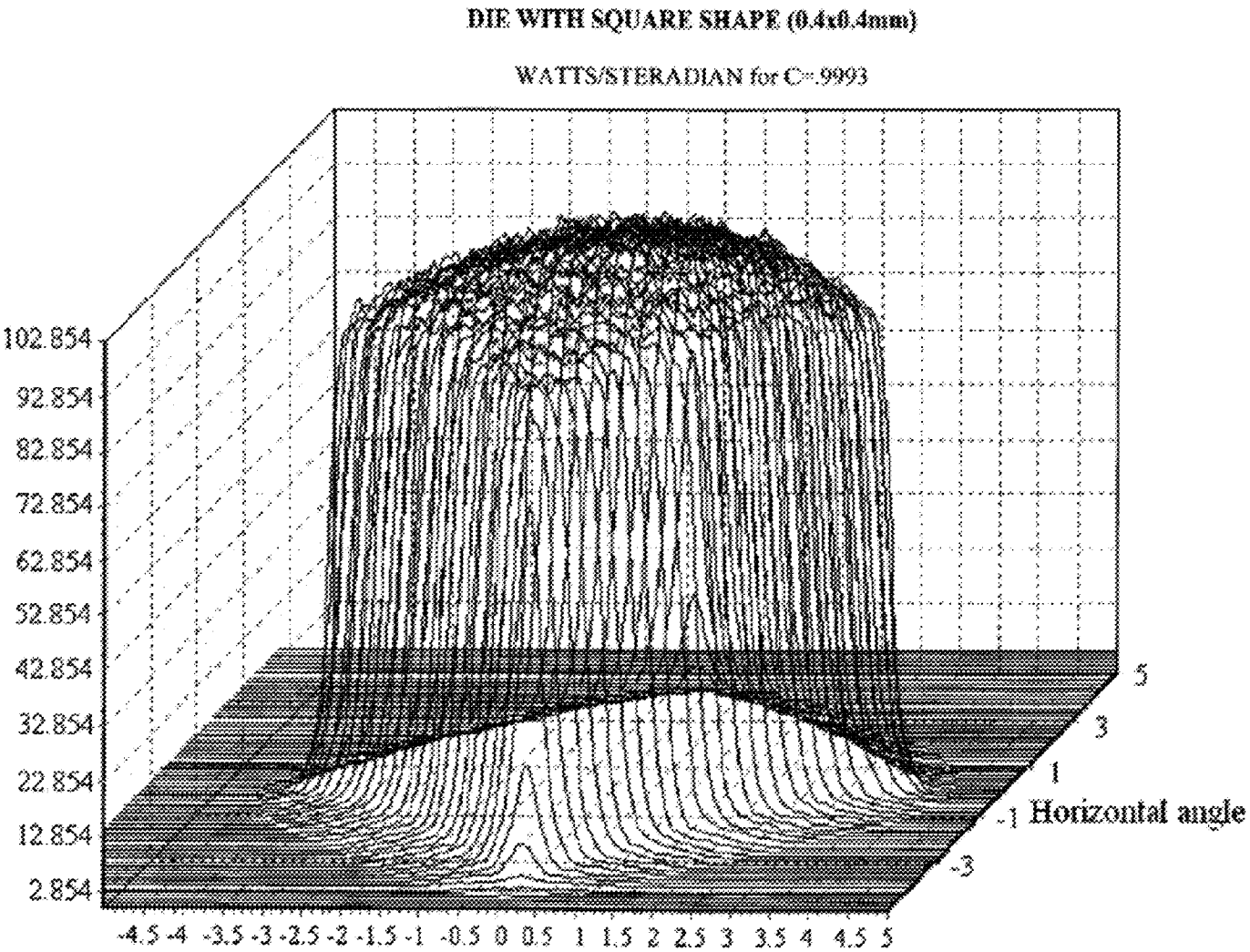
FIGS. 13A-13B show the calculation results for a beam shape for a square die with a dimension of 0.4 mm×0.4 mm
Figure 13B:
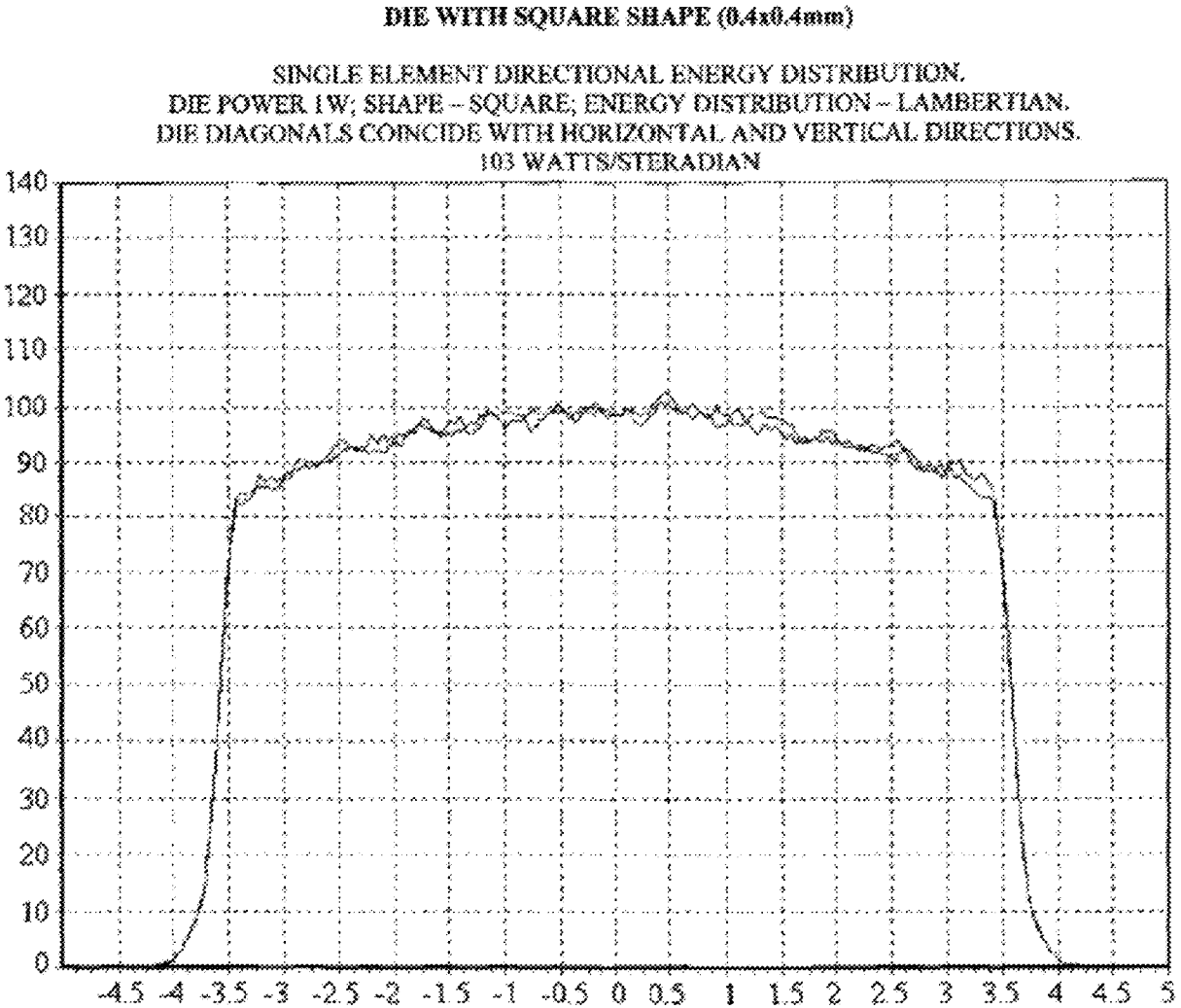

The calculations performed above were based on the use of circular dies in the LED cluster. While circular dies are available in LED clusters, manufacture of LED clusters with rectangular or square dies is typically less expensive. FIGS. 13A and 13B show the calculation results for a beam shape for a square die with a dimension of 0.4 mm×0.4 mm. FIG. 13A shows the 3-D beam shape pattern and FIG. 13B shows the beam divergence. The use of a square die would lead to an increase in the divergence angle of about 2-2.5° and would square the beam shape. Such changes would not be considered as being an appreciably reduction in performance.

A target range for operation of an apparatus according to an embodiment of the present invention is 21 feet. That is, it is desirable to be able to operate at the MPE level at a distance of 21 feet from the apparatus, since, in law enforcement conditions, this provides a minimum stand off distance for a law enforcement officer to take action if a subject tries to move within that distance. It is estimated that to achieve the MPE level at 21 feet having a spot with a radius of 28 cm with a device according to an embodiment of the present invention with a divergence angle of 5° would require that the radiant power of the device should be 40 W. LED clusters presently available from Norlux Corp. typically provide about 0.066 W optical output per die on average for dies with an area of 0.7 mm×0.7 mm at an operating frequency of 1 kHz with a duty factor of 0.1. However, at lower frequencies, the clusters can be operated at elevated duty cycles. With a duty factor of 0.3 or 0.5, the radiant power can be three to five times higher. AT a duty factor of 0.3, the output power per die is 0.2 W. For the lens described above, the die size should be reduced to 0.4 mm×0.4 mm, but this will result in a decreased output power per die of about 0.065 W. At a duty factor of 0.5, the output power per die would be about 0.11 W. As discussed above, the desired output power is 40 W, so the number of dies required to produce that power is about 614 dies at a duty factor of 0.3 and 366 dies at a duty factor of 0.5. With these dies, the cluster diameter would be close to 8" for a 614 dies and 6.25" for 366 dies. If the output power from each die could be doubled, the number of dies could be cut by one-half and 307 dies used at a duty factor of 0.3 and 183 dies at a duty factor of 0.5. This would result in cluster diameters of 5.75" and 4.75" respectively.

A preferred embodiment of the present invention comprises an LED cluster with a mix of LED colors. LED clusters from Norlux Corp. typically demonstrate a radiant power of about 33 mW/die for blue green or cyan dies and about 165 mW/die for red dies. Calculations show that using such an LED cluster from Norlux Corp. would require 682 dies and the light would be concentrated in an angle of 9° with a head format of 4-4.5 inches to achieve the desired MPE power level at 21 feet. Further enhancement of the LED cluster technology may allow for a reduction in the number of dies and a reduction in the diameter of the head. Table 3 shows the head diameter achievable at different die separations, where the head size and die calculations for irradiance angle of 9° and considering 5% loss for cyan and blue dies (square dies of 0.5 mm×0.5 mm) and 30% loss for red dies (square dies of 0.7 mm×0.7 mm).

TABLE 3

| Die separation | Head diameter at 9° angle (3.3 foot spot) at 21 feet (number of dies) | Head diameter at 5° angle (1.8 foot spot) at 21 feet (number of dies) |
|---|---|---|
| 8 | 9.44 inch (682 dies) | 5.75 inch (294 dies) |
| 6 | 7.08 inch (682 dies) | 4.7 inch (294 dies) |
| 4 | 4.72 inch (682 dies) | 3.5 inch (294 dies) |
| 3.39 | 4 inch (682 dies) | |
| 2.96 | 3.5 inch (682 dies) | |

Hence, a preferred embodiment of the present invention comprises an LED cluster combined with a lens microstructure. Such an embodiment has been shown to achieve desired MPE levels at 21 feet with relatively small-sized clusters. Such an embodiment can be easily fit within a flashlight-sized housing, which provides for portability and easy of use.

The range finding device 141 shown in FIG. 2 is used to lower or eliminate the light output from the apparatus if a subject may be exposed to power in excess of the MPE. The eye safe operation of the apparatus can be provided by a feedback electrical signal from the rangefinder to the electronics control module 131. If an object appears between the target and the apparatus, the feedback signal can be used to command the electronics to reduce or eliminate the output power.

Figure 12A:
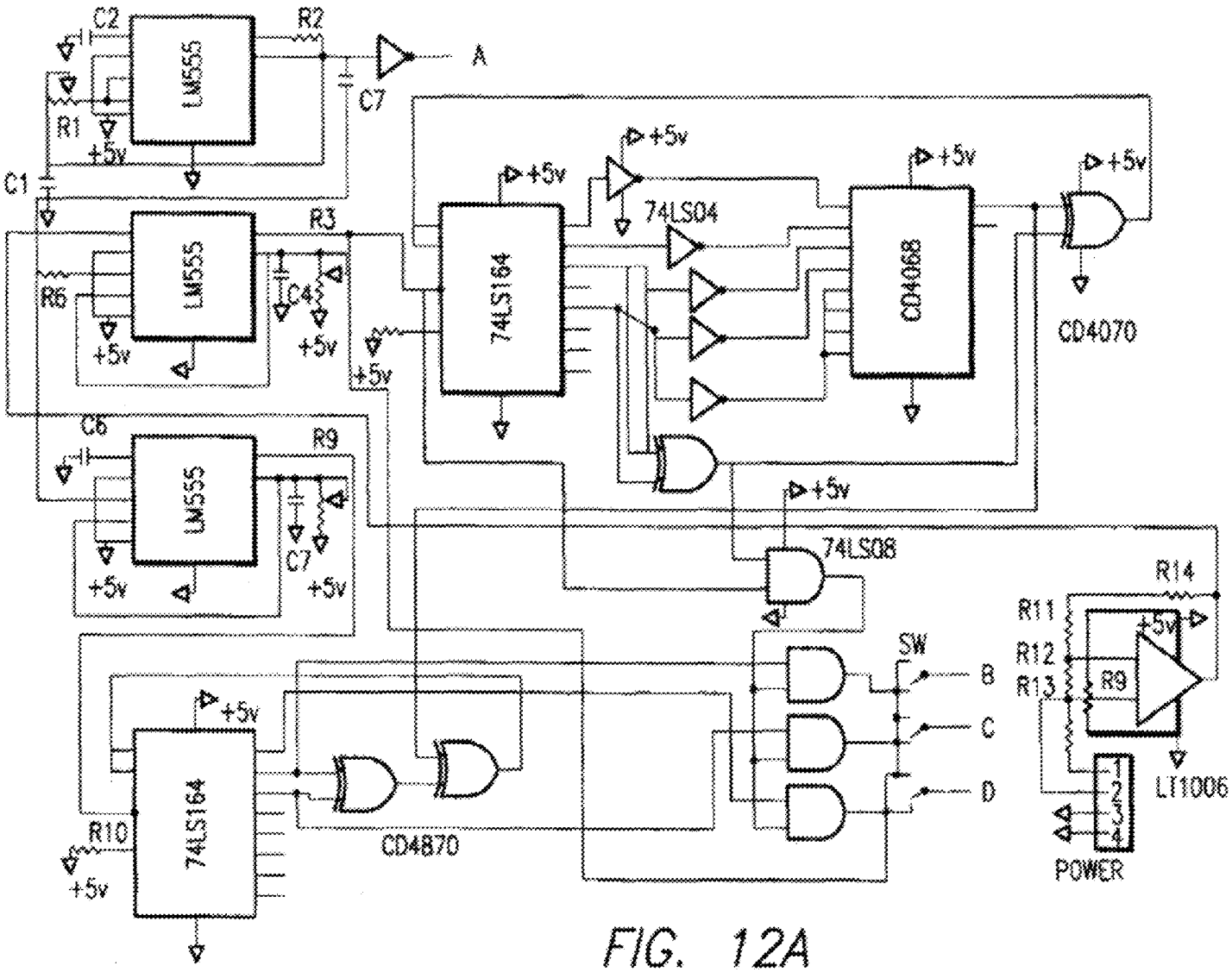
FIGS. 12A and 12B show a circuit schematic having rangefinder feedback control for LEDs.
Figure 12B:
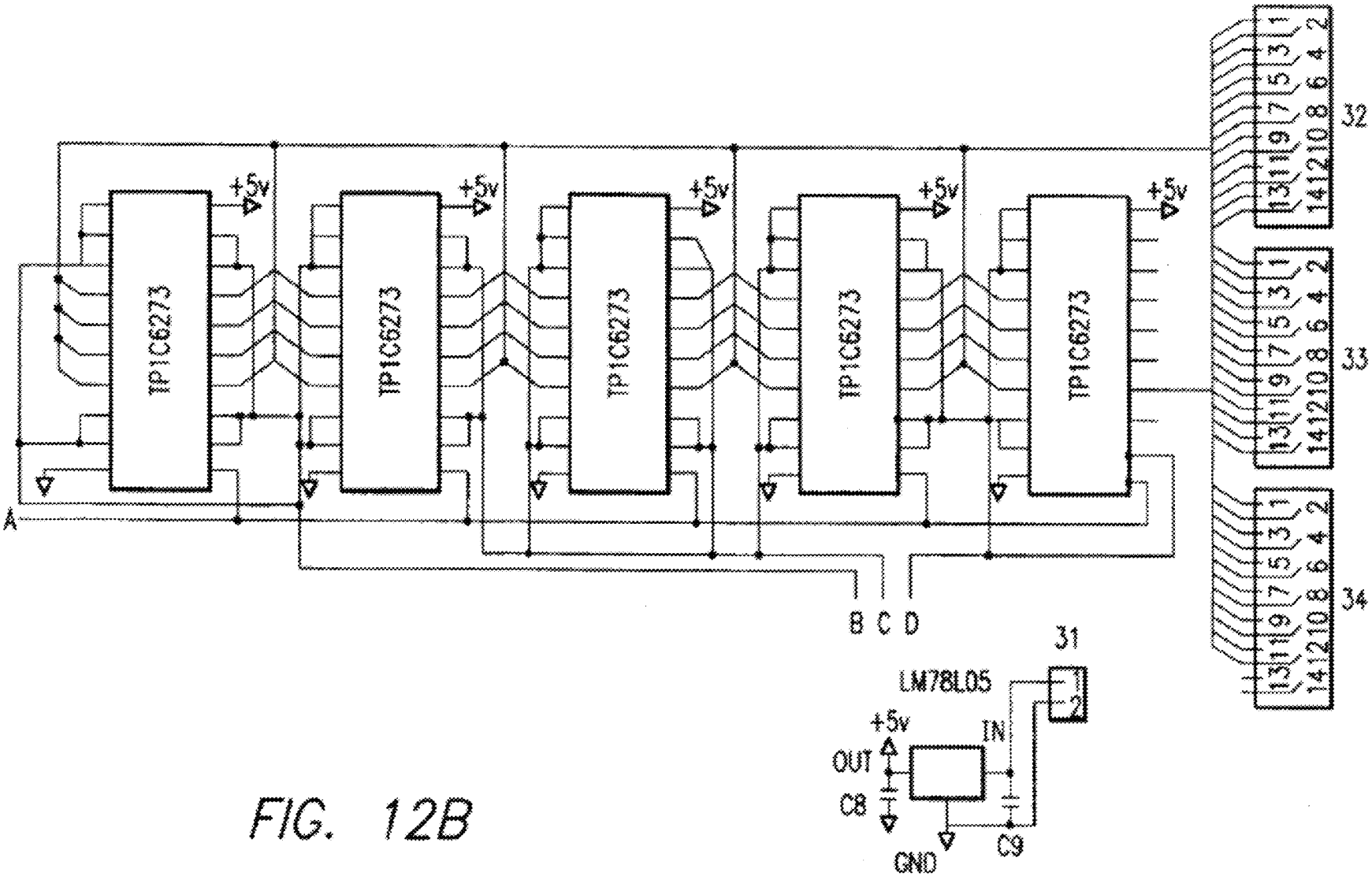

The rangefinder may comprise range finding devices known in the art, such as laser range finding devices or acoustic rangefinders. Preferred embodiments of the present invention use an acoustic rangefinder, such as the self-contained, ultrasonic analog output sensor Model SM906 from Hyde Park Electronics, LLC. FIGS. 12A and 12B show a schematic of a circuit used to control LEDs with rangefinder feedback control. Note that the rangefinder may be used to shut off all of the LEDs in the apparatus to eliminate all output optical power or shut off selected groups of LEDs to merely reduce the output optical power.

Figure 9:
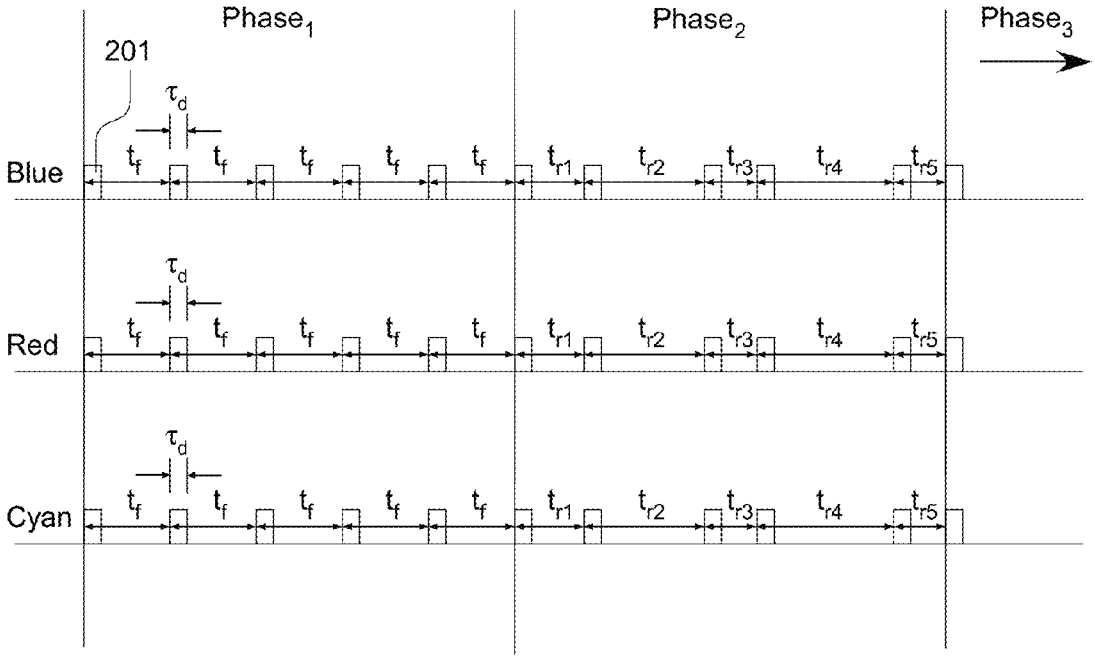
FIG. 9 shows a timeline for phases of a light pattern according to an embodiment of the present invention.

As discussed above, preferred embodiments of the present invention provide a flashing light pattern that has distinct phases. FIG. 9 shows a general timeline for two phases of a light pattern according to an embodiment of the present invention. FIG. 9 shows the timeline for light produced from LEDs of three separate colors, Blue, Red, and Cyan. Other embodiments of the present invention may have different color LEDs and may also have fewer than or more than three colors. Also note that the number of LEDs producing each color may also vary.

In FIG. 9, light pulses 201 have a constant duration $\tau_d$ seconds, while other embodiments may have lights pulses with varying durations. FIG. 9 also shows that each phase has the same duration of $t_{phase}$ seconds, while other embodiments of the present invention may have phases that vary in duration. FIG. 9 depicts the difference between a periodic phase, Phase 1, and a random or pseudorandom phase, Phase 2. In a periodic phase, the time spacing $t_f$ from the start of one light pulse 201 to the start of the next light pulse 201 is the same. Hence, the pulses repeat at a frequency of $1/t_f$. In a random or pseudorandom phase, the time spacing $t_{rx}$ from one pulse 201 to the next pulse 201 varies in a random or pseudorandom manner. Note that while FIG. 9 shows a pattern having five light pulses in each phase, each phase will typically comprise more than five light pulses. Note also that the overall light pattern may comprise repeating the phases after the phase sequence is completed.

As briefly discussed above, embodiments of the present invention typically have pulse frequencies of the periodic phases between 5 and 15 Hz, with preferred frequencies between 7 and 9 Hz. One preferred frequency is 7 Hz. In a periodic phase, the frequency remains generally fixed throughout the phase. The time spacing for pulses in random or pseudorandom phases also preferably fit within pulse frequencies between 5 Hz and 15 Hz. That is, the time spacing of random pulses vary between 0.066 seconds and 0.2 seconds. The duration of each phase is preferably between 3 seconds and 15 seconds. The duration $\tau_d$ of the light pulses is generally such that the duty factor of the light pulses is less than 50%.

FIG. 9 illustrates a preferred first phase where all or substantially all of the light emitting elements are flashed on and off in a periodic manner for some duration of time. This first phase takes advantage of the flashblindness and other incapacitating effects described above by irradiating a subject with light at or near the MPE with a flashing pattern. The random second phase of flashing all or substantially all of the light emitting elements in a random fashion has an incapacitating effect due to the bright flashing light that has a random periodicity within the frequency range of 5 Hz and 15 Hz.

Figure 10:
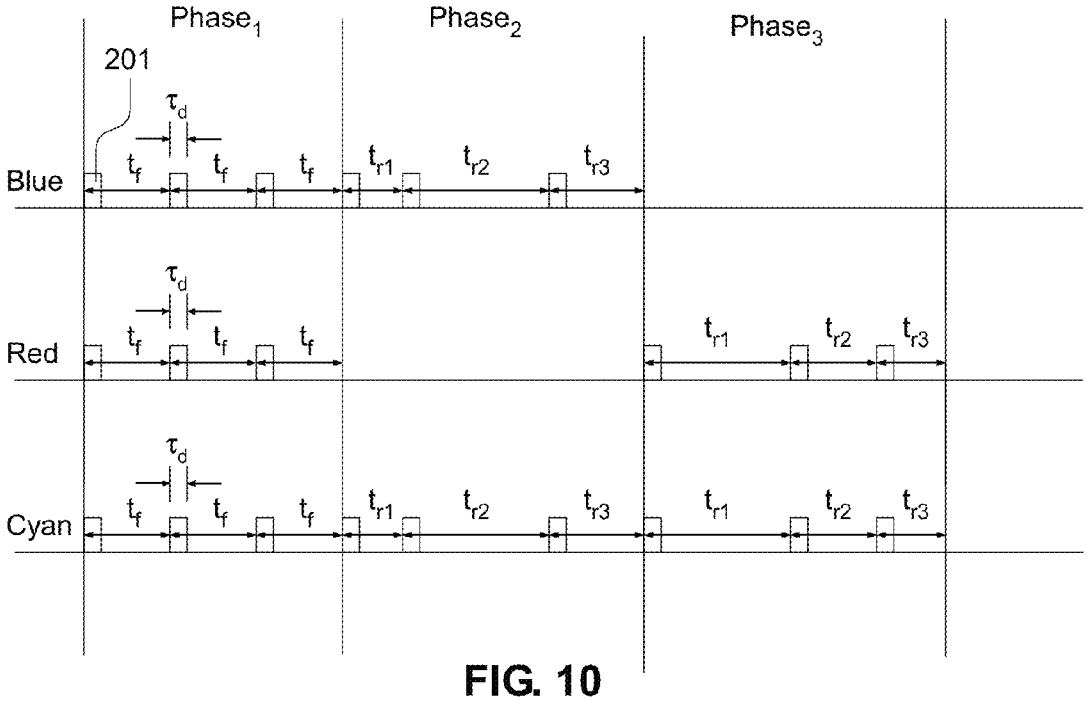
FIG. 10 shows a three phase light pattern.

FIG. 10 illustrates a three phase light pattern. The first phase comprises flashing on and off all or substantially all of the light emitting elements in a periodic manner. The second phase comprises a phase with a different duration than the first phase where two of three colors are flashed in a random manner. The third phase comprises another phase having a different duration than the first phase where a different two of the three colors are flashed in a random manner.

Figure 11:
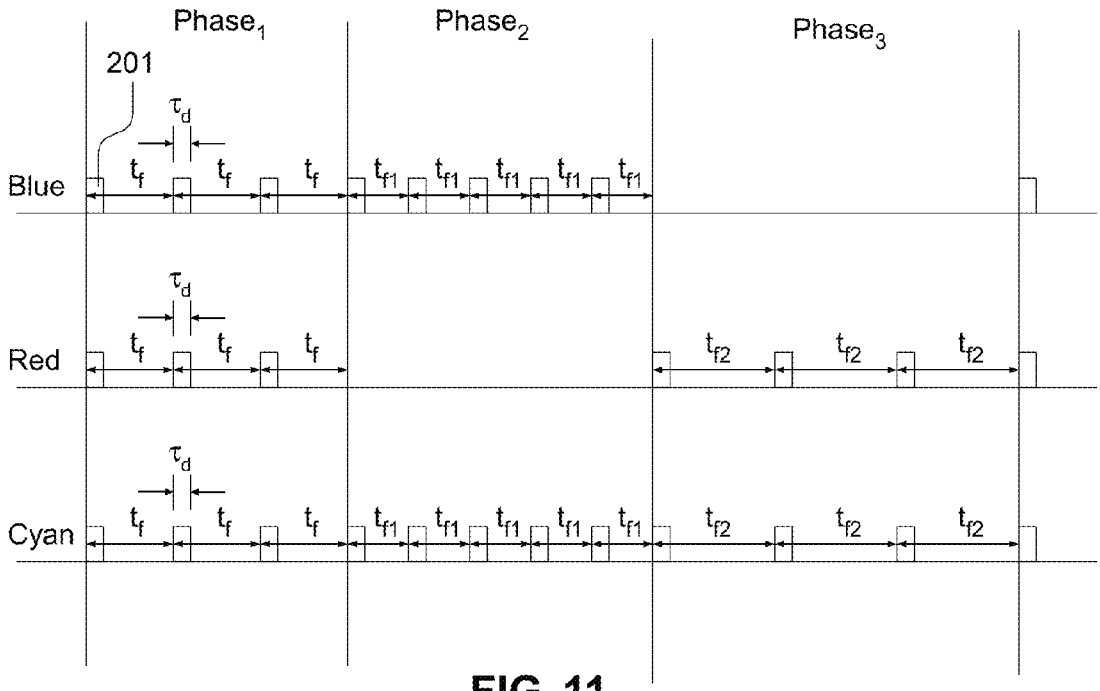
FIG. 11 shows another three phase light pattern.

FIG. 11 illustrates another three phase pattern. The first phase again comprises flashing on and off all or substantially all of the light emitting elements in a periodic manner. The second phase comprises periodically flashing two of three available colors at a first frequency, where the first frequency is preferably at a frequency near the lower bound or the upper bound of the preferred frequency range. The third phase comprises periodically flashing a different two of three available colors at a second frequency, where the second frequency is preferably at a frequency near the opposite bound of the preferred frequency range from the first frequency.

FIGS. 9, 10, and 11 do not illustrate all of the light patterns that may be used by embodiments of the present invention. Table 4 shows some additional light patterns that may be used by embodiments of the present invention, but Table 4 does not show all of the light patterns that may be used by embodiments of the present invention. In general, each phase of a light pattern differs from an adjacent phase in the power, frequency, and/or color output by the apparatus during the phase. This variation in phases is performed to overcome any adaptation by a subject to the flash pattern in any one phase.

from round dies in an LED cluster and focuses it in a 5° angle with 87.5% of the light uniformly distributed in the 5° angle. The beam former diameter is not more that 10% larger than the diameter of the LED cluster and may be fabricated from optical grade plastic with an n=1.74. The manufacturing tolerances for stock optics leads to an increase in the beam divergence of 2.32°. Using a square die instead of a circular die leads to an increase in the divergence angle of approximately 2-2.5° and a squaring of the beam shape. FIGS. 13A and 13B show calculated results of the beam shape for a square die 0.5 mm×0.5 mm. This demonstrates that the wide cluster beam can be concentrated with one inexpensive microstructured element into a narrow angle without substantial energy losses.

TABLE 4

| Pattern | Phase 1 | Phase 2 | Phase 3 | Phase 4 | Phase 5 | Phase 6 | Phase 7 |
|---|---|---|---|---|---|---|---|
| 1 | All colors pulsed periodically | All colors pulsed randomly | Repeat phases 1 and 2 | | | | |
| 2 | All colors pulsed periodically | Cyan and red pulsed randomly | Blue and red pulsed randomly | Repeat phases 1-3 | | | |
| 3 | All colors pulsed periodically | Blue and cyan pulsed randomly | Cyan and red pulsed randomly | Repeat phases 1-3 | | | |
| 4 | All colors pulsed periodically | Red and cyan pulsed periodically at a low freq (pref. 5 Hz) | Cyan and blue pulsed periodically at a high freq (pref. 15 Hz) | Repeat phases 1-3 | | | |
| 5 | All colors pulsed periodically | All colors pulsed randomly | Cyan pulsed periodically (pref. 7 Hz) | Blue pulsed periodically (pref. 7 Hz) | Red pulsed periodically (pref. 7 Hz) | Repeat phases 1-5 | |
| 6 | All colors pulsed periodically | Cyan and red pulsed randomly | Blue and red pulsed randomly | All colors pulsed randomly | Repeat phases 1-4 | | |
| 7 | All colors pulsed periodically | Cyan and red pulsed randomly | Cyan and blue pulsed randomly | All colors pulsed randomly | Repeat phases 1-4 | | |
| 8 | All colors pulsed periodically | Red and cyan pulsed periodically at a low freq (pref. 5 Hz) | Cyan and blue pulsed periodically at a high freq (pref. 15 Hz) | All colors pulsed periodically at a freq diff. than freq of phase 1 | Repeat phases 1-4 | | |
| 9 | All colors pulsed periodically (pref. 7-9 Hz) | All colors pulsed randomly (pref. 5-15 Hz) | First color pulsed periodically | All colors pulsed randomly (pref. 5-15 Hz) | Second color pulsed periodically | All colors pulsed periodically | Third color pulsed periodically |

As discussed above, illumination near the MPE will have the most incapacitating effects. Hence, in the phases of the light patterns according to embodiments of the present invention, the power produced by the apparatus is an important factor in the overall effectiveness of the apparatus. Since flash frequencies near the fundamental frequencies of the brain have an effect, the frequency (or randomness) of the light pulses are also an important factor in the overall effectiveness of the apparatus, but probably less a factor than the power. As also discussed above, the color of the output also has en effect on a subject, but probably less an effect than power or frequency. However, the color cyan (wavelength between 495 nm and 505 nm) appears to have a particularly effective incapacitating effect. Therefore, preferred embodiments of the present invention include cyan LEDs.

The microstructured beam former (compander) based on a single aspherical lens collects light from an angle of 106°

Another embodiment of the present invention may also provide for use of the apparatus as a standard flashlight. If the LEDs of the LED array 133 are flashed at an elevated frequency (more than 60 Hz), the flicker of the LEDs are not distinguishable by the human eye. If the LEDs of the LED array comprise red, blue and green LEDs, operation of the LEDs at full power may produce white light on a target, in effect, operating as a standard flashlight. However, production of white light may require that the ratio of the number of LEDs of different colors be set to optimize the production of white light.

Another embodiment of the present invention may also provide for scanning the light beam without operator control to increase the area covered by the embodiment. This is accomplished without compromising irradiance on the target, since the intensity of each flash will remain the same as for an unscanned beam, as will the number of flashes per second seen at an individual location. The light energy delivered to a target area covers an area greater than the beam footprint. This prevents a subject from escaping the effect of the flashing and can affect a few subjects simultaneously. This is done by setting the device to a sequence of directions to visit a sequence of flash points resulting in a pattern that defines an area in space. In such a case, it is necessary to spatially scan the beam through a sequence of positions while flashing to ensure the delivery of the energy to effect some level of incapacitation.

This feature is not substantial if the device operates at short distances with relatively wide beam, or if the action requires few seconds of operation. At the same time in a long term actions, such as crowd control, or the control of inmate riot in prison, for example, this feature can be helpful. In one embodiment, the main operational part of the apparatus, specifically, an electronics control module 131, a LED array 133, and a beam former 135 is housed in a rigid cylindrical body. This housing is placed inside an outer protective housing, and is attached to it via a rigid rubber cylinder with certain degree of flexibility. Two miniature step-motor actuators, displaced at 90° are attached to the inside wall of the external housing. These actuators will tilt the main unit in perpendicular directions, thus providing the multidirectional strobe. The relationship between the divergence angle of the beam, required operational distance, the relative speeds of both actuators, and the main unit tilt angle in each plane defines the covered area.

Copending and commonly assigned U.S. patent application Ser. No. 12/399,701 describes an apparatus that makes use of the impact that flashing, multi-color varying lights have on a human being. One embodiment of the apparatus disclosed in that application comprises an array of different color LEDs distributed across an area. A control mechanism is used to control the flashing of the LEDs to produce an incapacitating effect while lenses may be used to concentrate and focus light from individual LEDs. A preferred configuration of such a device would provide that a person illuminated by such a device would perceive lights of different colors coming from the same location.

Rather than using spatially distributed LEDs of different colors, additional embodiments of the present invention comprise multiple light emitting areas that are spatially located close together, but where each light emitting area comprises a single color. For example, one embodiment may provide the capability to radiate red, green, or blue light. Such an embodiment may then have only three light emitting areas: a red light emitting area; a green light emitting area; and a blue light emitting area. Spatial separation of the light emitting areas, while slight (see description below), may be sufficient for a person illuminated by such a device to perceive (either consciously or unconsciously) lights of different colors coming from slightly different locations. Turning on the red, green, and blue light emitting areas simultaneously in certain proportions may cause the person illuminated by the device to perceive white light. However a specific white light emitting area can also be provided.

Preferred embodiments of the present invention may provide both immediate physiological responses and cumulative psycho-physiological responses. The immediate physiological responses may include: a startle response where a target is immediately distracted; a blinking and squinting/avoidance response where the target experiences difficulties in keeping eyes open; decreased night vision where the target sees only as a very bright spot surrounded by a "wall" of light; and flashblindness (and further afterimages) which may be a lasting effect that results in impaired vision persisting between flashes and continues for minutes after the light is off. Cumulative psycho-physiological responses may include: discomfort followed by startling which adds to an avoidance response; disorientation which reduces the ability of an adversary to clearly target a user; and vertigo which results in feelings of physical imbalance that further limit an adversary's effectiveness. Such effects are very individual and depend on many factors including the time of exposure and surrounding conditions. The radiance provided by embodiments of the present invention, even at the prolonged exposure times, is preferably below the exposure limits determined according to the International Commission on Non-Ionizing Radiation Protection (ICNIRP) guidelines on the limits of exposure to incoherent, broadband optical radiation.

Figure 14:
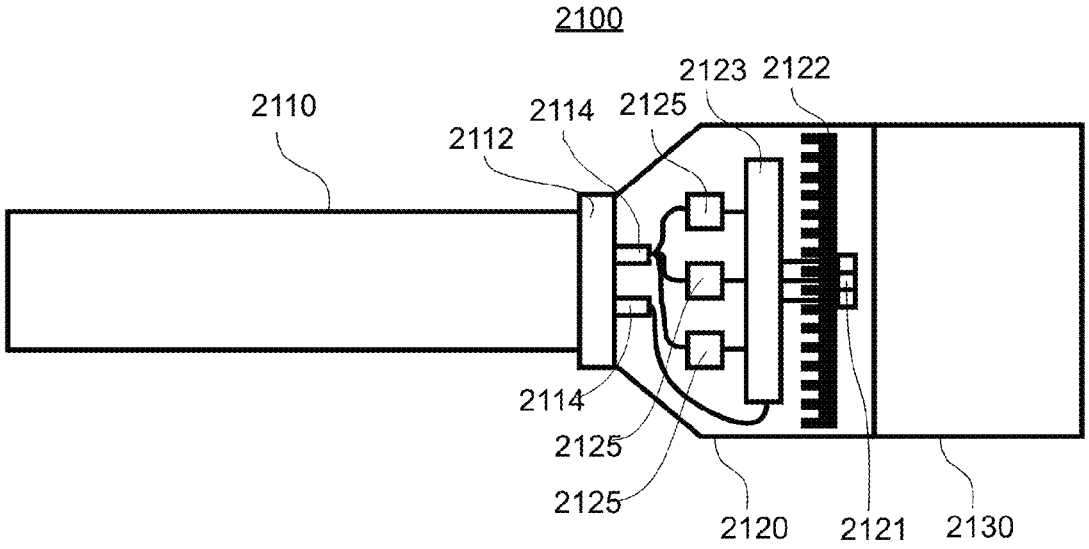
FIG. 14 shows an apparatus for incapacitation by the emission of light.

FIG. 14 illustrates an apparatus 2100 in accordance with an embodiment of the present invention. The apparatus 2100 has a handle 2110, which preferably contains a battery back or other power source used to power the apparatus 2100 through power terminals 2114. An electronics housing 2120 is preferably coupled to the handle 2110 and may be held in place by a securing nut 2112 or other securing means. Other possible securing means are described below. The electronics housing 2120 contains a high power light emitting chip 2121 disposed on a heat sink 2122. The electronics housing 2120 may also contain an electronics assembly 2123 for controlling the light emitting chip 2121. The electronics housing 2120 may also contain one or more electronic drivers 2125 for providing current to the light emitting chip 2121. For example, if the light emitting chip 2121 has red, green, and blue LEDs, a separate electronic driver 2125 may be used for each color LED. The apparatus 2100 may also have a light focusing or light concentrating element 2130 that helps concentrate the light from the light emitting chip 2121 into more of a focused beam.

The power source contained in the handle 2110 preferably comprises a rechargeable battery or rechargeable battery pack. One type of rechargeable battery used in an embodiment of the present invention may be a D-size, Power titanium NIMH rechargeable battery. Another type of rechargeable battery that may be used comprises a Lithium-Ion battery or battery pack. Preferably, the selected batteries provide for light output near that obtained from an externally powered DC source, while providing for desired portability and rechargeability. Alternatively, other embodiments may use simple D-sized alkaline batteries, but such batteries may provide for less optical power output due to the relationship between the internal resistance of the alkaline batteries and the dynamic resistance of the LED chip. The handle 2110 may be configured to itself be replaceable. Thus, when the apparatus 2100 runs low on power, the handle 2110 can be replaced with a fully powered handle 2110, allowing the apparatus to be used while the discharged handle 2110 is being charged or allowing the user to quickly substitute a new battery pack when the one in use is becoming depleted so as to be able to continue use of the device in a field situation. The handle 2110 may also have a receptacle or connector for connection to an external power source. Instead of deploying all of the electronics in the electronics housing 2120 as discussed above, the handle 2110 may also contain the electronics assembly 2123, the electronic drivers 2125, or other circuitry used for the operation of the apparatus. Preferably, the diameter of the handle is chosen to easily gripped by a human hand. A connection to a remote power source may also be provided so that, for example, a power pack could be carried on the user's belt or elsewhere, which would allow for greater power and/or greater time in use.

The electronics assembly 2123 receives power from the power terminals 2114 and controls the emission of light from the light emitting chip 2121. As is described in additional detail below, the electronics assembly 2123 controls the flashing of light from the light emitting chip 2121 to achieve desired flash patterns. The electronics assembly 2123 may comprise one or more field programmable gate arrays, microprocessors, microcontrollers, discrete devices or some combination thereof configured to provide the flashing capability described in additional detail below as well as previously.

The electronics assembly 2123 provides the ability to flash different colors provided by the light emitting chip in a periodic and/or nonperiodic manner. The periodic manner comprises pulsing different colors on and off at a selected frequency, where the on duration of the colors is preferably less than the off duration. The selected frequency is preferably between 5 Hz and 15 Hz. The nonperiodic manner comprises pulsing the colors on and off, where the on durations are preferably the same, while the off durations vary randomly or pseudo randomly. In this nonperiodic flashing, the time from the start from one light pulse to the start of the next light pulse preferably varies between 0.666 seconds and 0.2 seconds.

The light emitting chip 2121 preferably comprises high brightness red, green and blue LED substrates disposed on a single chip or module and spatially separated. It is preferred that the LED substrates be deployed on a single chip or module to provide for a smaller size of the electronics housing 2120 and to reduce or eliminate the need for complex optics. Due to the high power consumed by such devices, it is preferred that the light emitting chip be disposed on the heat sink 2122 to conduct excess heat away from the chip 2121.

Figure 16:
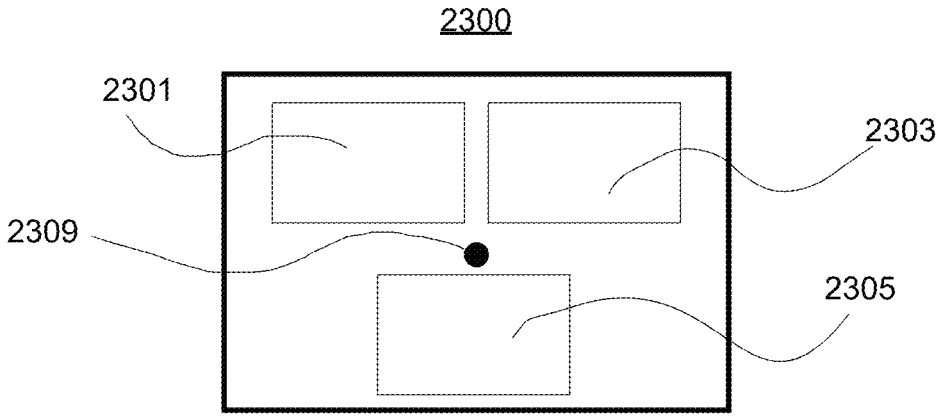
FIG. 16 shows a layout of three LED substrates within an LED module.

Preferred embodiments of the present invention use a light emitting chip 2121 that comprises high brightness differently colored LED substrates or dies disposed on a single chip or module and spatially separated. The LED substrates may comprise just two colors, such as amber and red; cyan and blue; amber and cyan; or red and blue, or three colors, such as red, green and blue or red, blue and cyan. FIG. 16 illustrates a typical layout of the LED substrates within such a module 2300. FIG. 16 shows a red LED substrate 2301, a blue LED substrate 2303, and a green LED substrate 2305. The green LED substrate 2305 and red LED substrate 2301 are larger than the blue substrate 2303 to allow for each substrate to generate light at approximately the same optical power. Preferably, the LED substrates 2301, 2303, 2305 are spatially separated from the optical axis 2309 of the apparatus. This provides that as separate colors are flashed, the source of the light appears to move, which may further increase the incapacitating effects of the flashing light.

Figure 17:
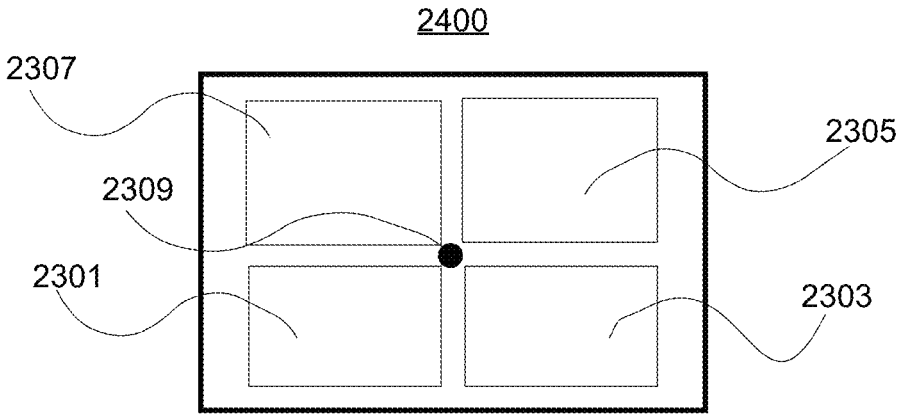
FIG. 17 shows a layout of four LED substrates within an LED module.

An embodiment according to the present invention also includes a "flashlight" mode. In the flashlight mode, red, green, and blue LED substrates are preferably concurrently operated at maximum current and are flashed on and off at a high frequency, e.g. a rate higher than 120 Hz. This should produce a white output light with flashes that are unresolvable by human eyes, hence producing a beam of white light. Other colored LED substrates may also be concurrently operated to produce the desired white light. The flashlight mode may be alternatively implemented by using a module having four LED substrates: red, green, and blue LED substrates (or other colors), as described previously; and a white LED substrate. FIG. 17 shows a module 2400 having red LED substrate 2301, a blue LED substrate 2303, and a green LED substrate 2305; and a white LED substrate 2307. With such a module 2400, the flashlight mode would be produced by flashing the white LED substrate 2307 at a high rate, e.g. a rate greater than 120 Hz. Further note that the "flashlight" mode provides another light color for use in incapacitation. That is, the apparatus may be operated to flash white light along with flashes of colored light.

Figure 18:
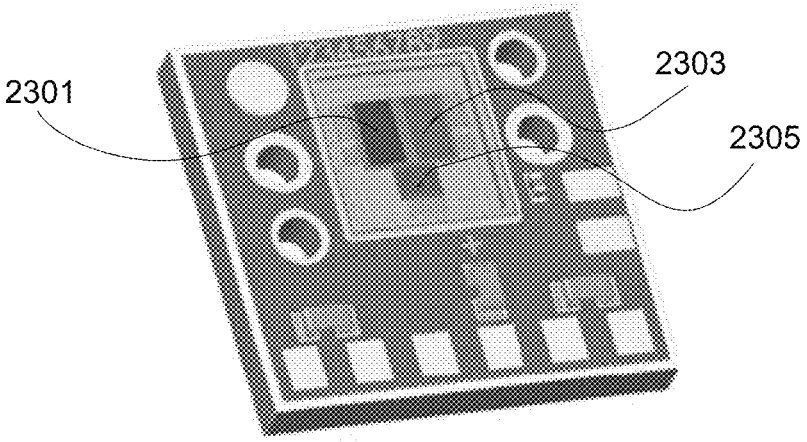
FIG. 18 depicts a multi-chip, multi-color LED module.

The chip 2121 may comprise an advanced solid state light source, such as those used in microdisplay-based rear projection television. One such light source may comprise a high brightness multiple-color LED module, such as the multi-chip, multi-color LED module depicted in FIG. 18 from Luminus Devices (Billerica, Mass.). Alternatively, multiple single color LED chips, (such as the PT120 module from Luminus devices), may be used. Such modules provide relatively high output light power at low voltages. For example, the PT120 module provides peak radiant powers of 5.6 W (red), 8 W (green), and 7.2 W (blue) with operating voltages of 3V (red), 5V (green), and 5.1V (blue) at a peak current of 30 A.

Figure 19:
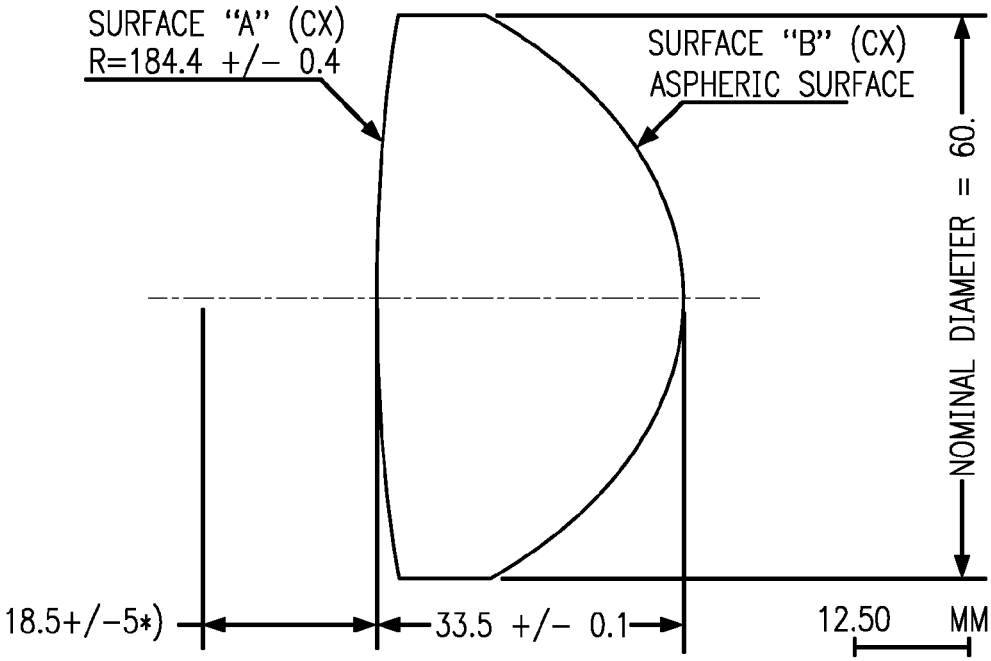
FIG. 19 illustrates an aspheric lens for light concentration.

The light focusing or light concentrating element 2130 comprises an optical element or structure that functions to form a desired beam or beams from the light emitted by the light emitting chip 2121. LEDs typically emit light with a high divergence angle, so the light focusing or light concentrating element 2130 preferably functions to form a light beam with a smaller divergence angle. The light focusing or light concentrating element 2130 may comprise an aspheric lens designed to provide for concentration of light with a preferred divergence angle. For example, a lens which provides for concentration of 73% of light with a 5 degree divergence angle has been demonstrated. FIG. 19 illustrates an aspheric lens having a diameter of about 60 mm that may collect about 70% of the light from a 4.6×2.6 mm LED chip. Such a lens may be fabricated using diamond turning for low quantities. Large quantities of such lenses may be fabricated by using an injection molding process or other low cost manufacturing processes.

Figure 15:
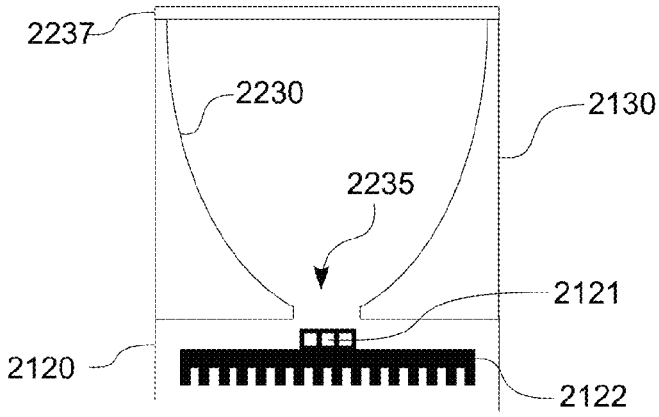
FIG. 15 shows a cross-section of a light focusing element with a contoured internal surface.

However, use of a lens may increase the cost, size, and weight of the apparatus. Therefore, it is preferred that the light focusing or light concentrating element 2130 comprise a structure that has an internal surface contoured to focus the beam. FIG. 15 illustrates a cross-section of a light focusing element 2130 with an internal surface 2230 contoured to help focus the light from the light emitting chip 2121 into a less divergent beam. The curvature of the internal surface 2230 is preferably chosen to provide for increased beam concentration. The internal surface preferably comprises a mirrored surface or a surface with high reflectivity to increase the effectiveness of the beam concentration. An opening 2235 at the bottom of the light concentrating element 2130 allows light from the light emitting chip 2121 to enter the light concentrating element 2130 to be concentrated by the internal surface 2230. The light concentrating element 2130 may also have a clear cap 2237 to protect light producing and/or electrical elements with the apparatus 2100. The cap 2237 may alternatively comprise a lens to further concentrate light reflected from the internal surface 2230.

Figure 20:
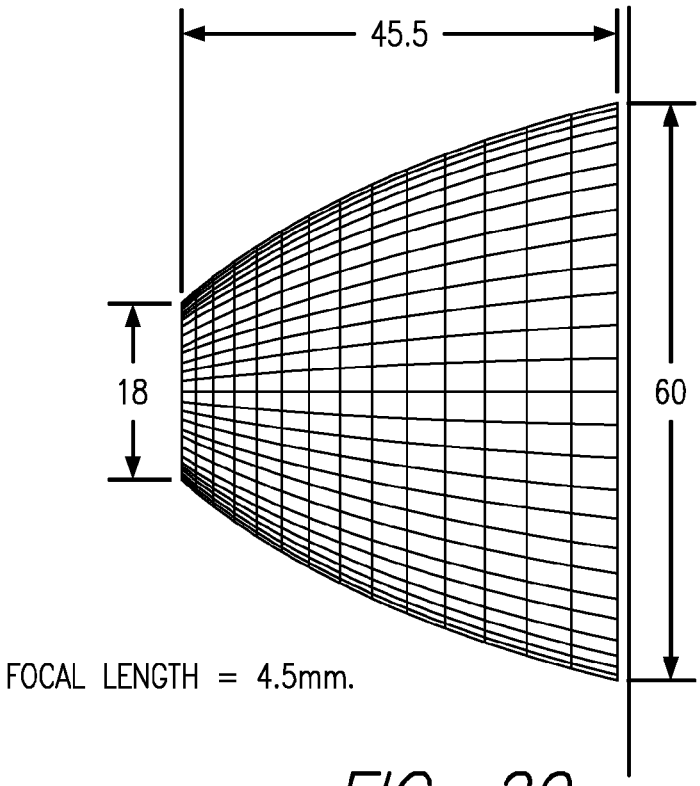
FIG. 20 shows a contour drawing of a parabolic radiator.

FIG. 20 shows a contour drawing of a parabolic radiator which may be used in an embodiment of the present invention for the light concentrating element 2130. With an LED chip size of about 4.6×2.6 mm and a light concentration angle of 5°, the diameter of the reflector on the output side was calculated to be 60 mm. However, any parabolic reflector typically concentrates only 30-35% of the light source in the calculated angle. The rest of the light (stray light) is spread in an angle defined by the focal length and the opening of the reflector. In the reflector depicted in FIG. 20, this angle was 72°. Hence, the embodiments of the present invention that utilize a reflector present a tradeoff with embodiments that utilize a focusing lens, where the reflector may provide for lower cost, size and/or weight, while concentrating less of the light from the LED chip.

The optical power provided by embodiments of the present invention using a single color LED chip was measured by directing light from such an embodiment at a screen placed two meters away. The diameter of the spot with the maximum concentration of light was measured, and the diameter of the entire surrounding spot in which the light was visible was also measured. The pulse power was measured on axis, at the edge of the bright spot, and in the middle of the ring surrounding the bright spot. The measured irradiance was then multiplied by the respective spot size to estimate the power per pulse. The average irradiance in the bright spot and the irradiance in the middle of the large spot were the values used for the calculations. The data for each color LED chip are presented in Table 5 below.

TABLE 5

| Parameters/Colors | | Blue LED | Green LED | Red LED |
|---|---|---|---|---|
| Bright Spot | Diameter (cm) | 15 | 15 | 15 |
| | Full angle | 8.6° | 8.6° | 8.6° |
| | Irradiance on axis (mW/cm$^2$) | 10.5 | 9.2 | 9.5 |
| | Irradiance at the edge (mW/cm$^2$) | 9.5 | 8.5 | 8.8 |
| | Average power in the spot (mW) | 1767 | 1564 | 1617 |
| Surrounding spot | Diameter (cm) | 150 | 150 | 150 |
| | Full angle | 74° | 74° | 74° |
| | Irradiance in the middle (mW/cm$^2$) | 0.14 | 0.13 | 0.14 |
| | Average power in the spot (mW/cm$^2$) | 2449 | 2274 | 2449 |
| Total power (mW) | | 4216 | 3838 | 4066 |

The light emitting chip 2121 may produce a large amount of heat during operation, therefore the use of a heatsink 2122, as shown in FIG. 14, is preferred to conduct heat away from the chip 2121 and keep it from over-heating. Also, the electronics board 2123 may also create significant amounts of heat. However, a desire to keep the electronics housing 2120 relatively small may require that the heatsink 2122 surface area be kept small. Hence, as additional cooling microfan may be disposed in the electronics housing 2120 to circulate air past the heatsink 2122 and expel it from the electronics housing 2120. Such a microfan may also serve to keep the electronics housing 2120 and the apparatus 2100 cooler overall.

Figure 21A:
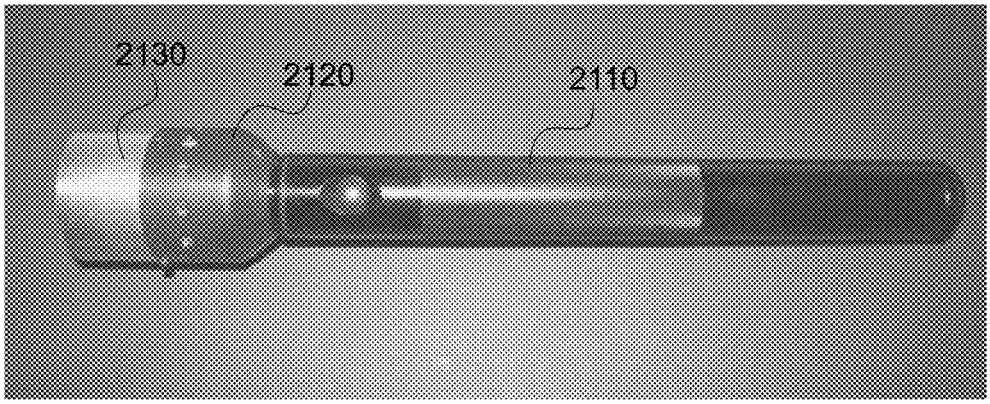
FIGS. 21A-21C show photographs of various elements of an embodiment according to the present invention.
Figure 21B:
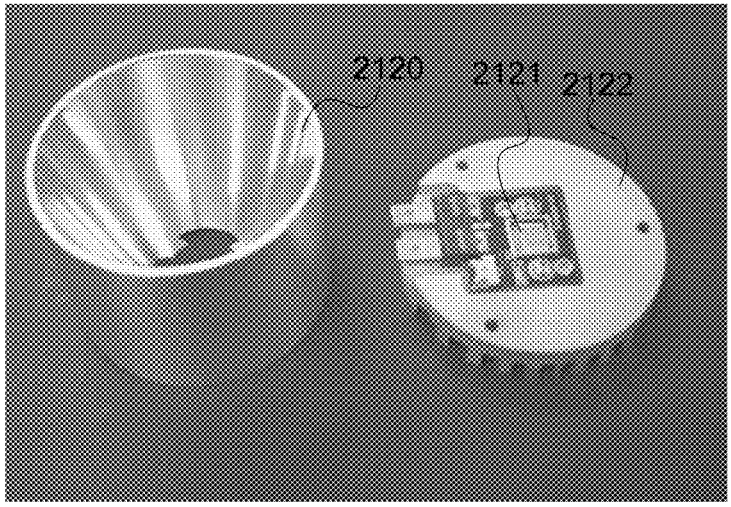
Figure 21C:
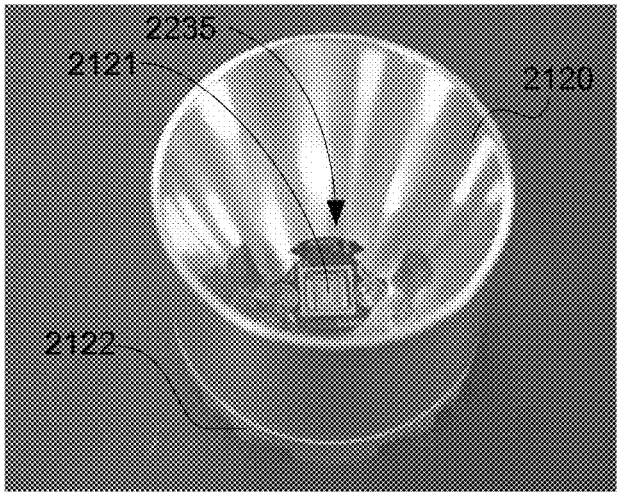

As indicated above, preferred embodiments of the present invention are provided in flashlight-like enclosures. FIG. 21A shows a photograph of one embodiment according to the present invention. FIG. 21A shows the handle 2110, the electronics housing 2120, and the light concentrating element 2130. FIG. 21B separately shows the light concentrating element 2130 and the light emitting chip 2121 mounted on the heat sink 2122. FIG. 21C shows the light emitting chip 2121 mounted in the bottom opening 2235 of the light concentrating element 2130.

Figure 22:
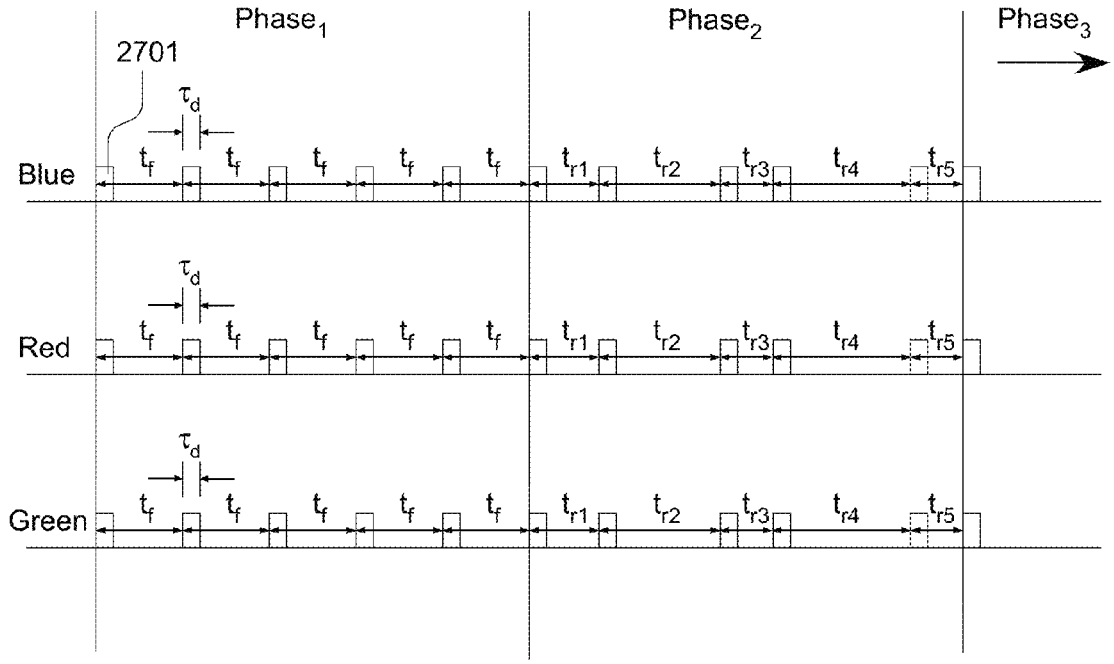
FIG. 22 shows a timeline for phases of a light pattern according to an embodiment of the present invention.

As discussed above, preferred embodiments of the present invention provide a flashing light pattern that has distinct phases. FIG. 22 shows a general timeline for two phases of a light pattern according to an embodiment of the present invention. FIG. 22 shows the timeline for light produced from LEDs of three separate colors, Blue, Red, and Green. Other embodiments of the present invention may have different color LEDs and may also have fewer than or more than three colors. Also note that the number of LEDs producing each color may also vary.

In FIG. 22, light pulses 2701 have a constant duration $\tau_d$ seconds, while other embodiments may have lights pulses with varying durations. FIG. 22 also shows that each phase has the same duration of $t_{phase}$ seconds, while other embodiments of the present invention may have phases that vary in duration. FIG. 22 depicts the difference between a periodic phase, Phase 1, and a random or pseudorandom phase, Phase 2. In a periodic phase, the time spacing $t_f$ from the start of one light pulse 2701 to the start of the next light pulse 2701 is the same. Hence, the pulses repeat at a frequency of $1/t_f$. In a random or pseudorandom phase, the time spacing $t_{rx}$ from one pulse 2701 to the next pulse 2701 varies in a random or pseudorandom manner. Note that while FIG. 22 shows a pattern having five light pulses in each phase, each phase will typically comprise more than five light pulses. Note also that the overall light pattern may comprise repeating the phases after the phase sequence is completed.

Embodiments of the present invention preferably have pulse frequencies of the periodic phases between 5 and 15 Hz, with preferred frequencies between 7 and 9 Hz. One preferred frequency is 7 Hz. In a periodic phase, the frequency remains generally fixed throughout the phase. The time spacing for pulses in random or pseudorandom phases also preferably fit within pulse frequencies between 5 Hz and 15 Hz. That is, the time spacing of random pulses vary between 0.066 seconds and 0.2 seconds. The duration of each phase is preferably between 3 seconds and 15 seconds. The duration $\tau_d$ of the light pulses is generally such that the duty factor of the light pulses is less than 50%.

FIG. 22 illustrates a preferred first phase where all or substantially all of the light emitting elements are flashed on and off in a periodic manner for some duration of time. This first phase takes advantage of the flashblindness and other incapacitating effects described above by irradiating a subject with a flashing pattern. The random second phase of flashing all or substantially all of the light emitting elements in a random fashion has an incapacitating effect due to the bright flashing light that has a random periodicity within the frequency range of 5 Hz and 15 Hz.

Figure 23:
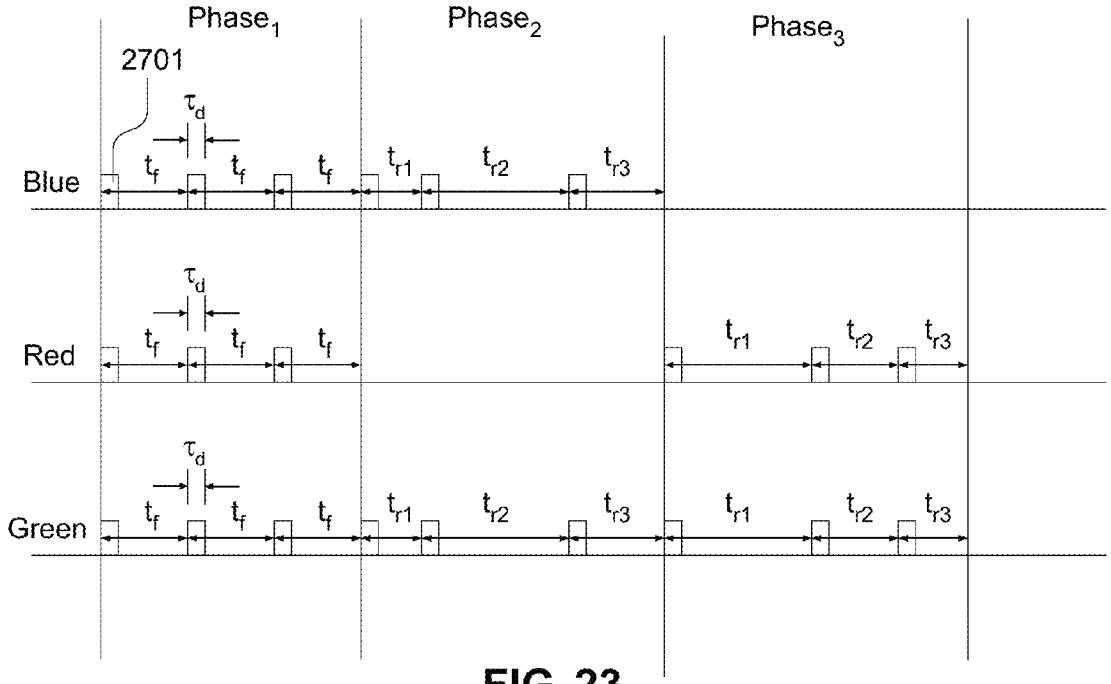
FIG. 23 shows a three phase light pattern.

FIG. 23 illustrates a three phase light pattern. The first phase comprises flashing on and off all or substantially all of the light emitting elements in a periodic manner. The second phase comprises a phase with a different duration than the first phase where two of three colors are flashed in a random manner. The third phase comprises another phase having a different duration than the first phase where a different two of the three colors are flashed in a random manner.

Figure 24:
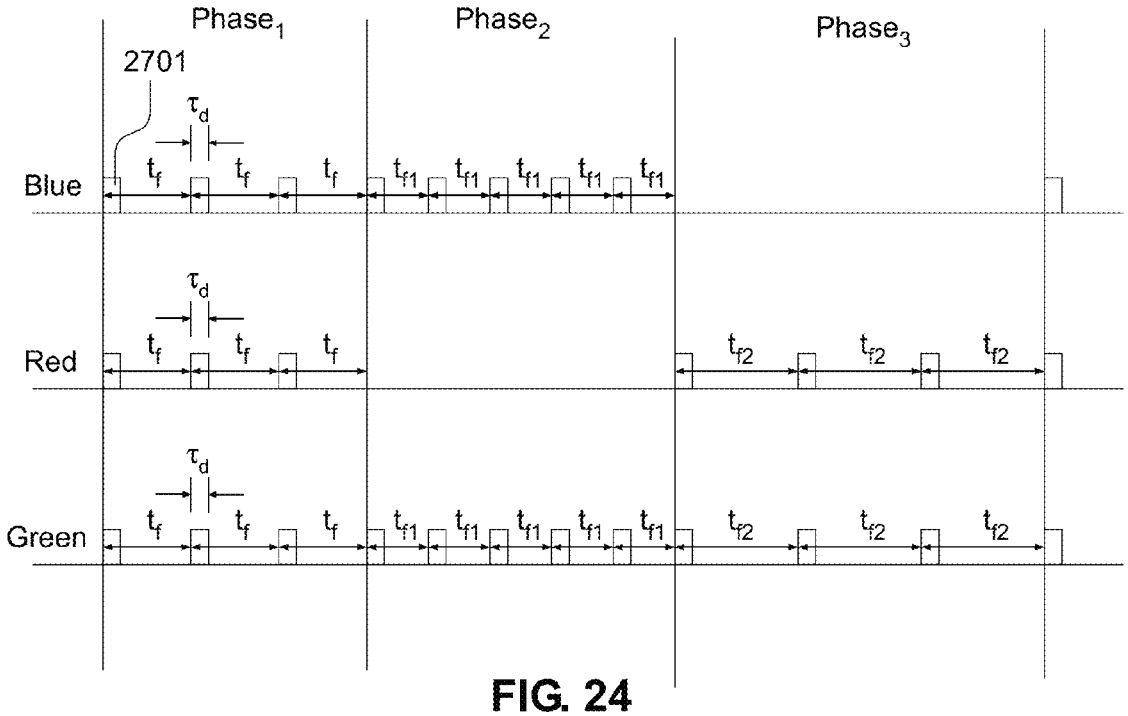
FIG. 24 shows another three phase light pattern.

FIG. 24 illustrates another three phase pattern. The first phase again comprises flashing on and off all or substantially all of the light emitting elements in a periodic manner. The second phase comprises periodically flashing two of three available colors at a first frequency, where the first frequency is preferably at a frequency near the lower bound or the upper bound of the preferred frequency range. The third phase comprises periodically flashing a different two of three available colors at a second frequency, where the second frequency is preferably at a frequency near the opposite bound of the preferred frequency range from the first frequency.

FIGS. 22, 23, 24 do not illustrate all of the light patterns that may be used by embodiments of the present invention. Table 6 shows some additional light patterns that may be used by embodiments of the present invention, but Table 6 does not show all of the light patterns that may be used by embodiments of the present invention. In general, each phase of a light pattern differs from an adjacent phase in the power, frequency, and/or color output by the apparatus during the phase. This variation in phases is performed to overcome any adaptation by a subject to the flash pattern in any one phase.

Human tests have shown that a combination of colored and white light flashes may be more effective in incapacitating a subject than either colored flashing light or white flashing light alone. Human tests have also shown that the most effective colors may be cyan and orange close to red. Human tests also indicate that incapacitation may be further increased when the colors and white light are flashed in a constant flashing mode rather than a random flashing mode. As indicated above, embodiments of the present invention may provide for white light generation by using outputs from three colored LED segments or have a fourth LED segment that outputs white light.

Figure 25:
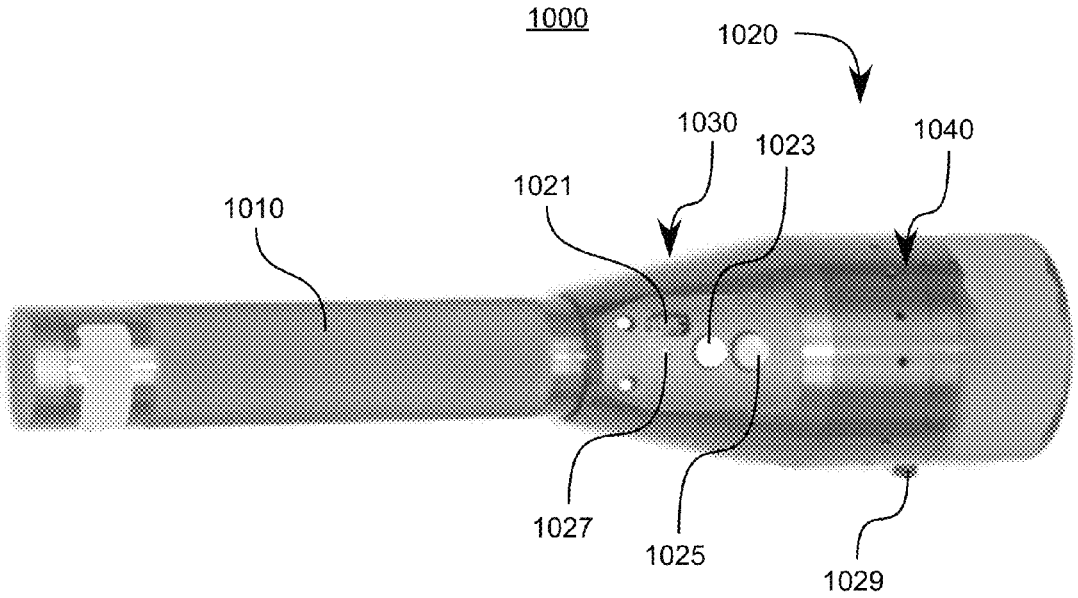
FIG. 25 shows an incapacitator according to an embodiment of the present invention.

An incapacitator according to an embodiment of the present invention is depicted in FIG. 25. As shown in FIG. 25, the incapacitator 1000 has a general "flashlight" shaped body, with a handle 1010 that is sized to be gripped by a single hand and a larger sized head 1020. The head 1020 may comprise an electronics housing 1030 and an optical housing 1040. The handle 1010 may contain a battery for supplying energy for the operation of the incapacitator 1000. The head 1020 may have switches 1023, 1025 used for controlling the incapacitator 1000. For example, one switch 1023 may be used to enable the "flashlight" mode described above. The other switch 1025 may then be used to trigger the incapacitating mode of the incapacitator 1000. An indicator 1027 may be used to provide status on the state of the incapacitator 1000, as described in additional detail below. A programming port 1021 may be used to provide access to electronics within the incapacitator 1000 to update or change programming used

TABLE 6

Figure 26:
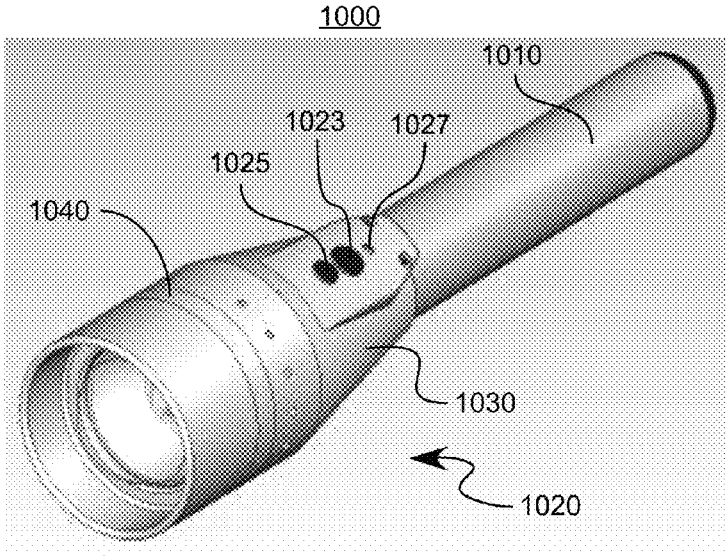
FIG. 26 shows a perspective view of an incapacitator.

| Pattern | Phase 1 | Phase 2 | Phase 3 | Phase 4 | Phase 5 | Phase 6 | Phase 7 |
|---|---|---|---|---|---|---|---|
| 1 | All colors pulsed periodically | All colors pulsed randomly | Repeat phases 1 and 2 | | | | |
| 2 | All colors pulsed periodically | Cyan and red pulsed randomly | Blue and red pulsed randomly | Repeat phases 1-3 | | | |
| 3 | All colors pulsed periodically | Blue and cyan pulsed randomly | Cyan and red pulsed randomly | Repeat phases 1-3 | | | |
| 4 | All colors pulsed periodically | Red and cyan pulsed periodically at a low freq (pref. 5 Hz) | Cyan and blue pulsed periodically at a high freq (pref. 15 Hz) | Repeat phases 1-3 | | | |
| 5 | All colors pulsed periodically | All colors pulsed randomly | Cyan pulsed periodically (pref. 7 Hz) | Blue pulsed periodically (pref. 7 Hz) | Red pulsed periodically (pref. 7 Hz) | Repeat phases 1-5 | |
| 6 | All colors pulsed periodically | Cyan and red pulsed randomly | Blue and red pulsed randomly | All colors pulsed randomly | Repeat phases 1-4 | | |
| 7 | All colors pulsed periodically | Cyan and red pulsed randomly | Cyan and blue pulsed randomly | All colors pulsed randomly | Repeat phases 1-4 | | |
| 8 | All colors pulsed periodically | Red and cyan pulsed periodically at a low freq (pref. 5 Hz) | Cyan and blue pulsed periodically at a high freq (pref. 15 Hz) | All colors pulsed periodically at a freq diff. than freq of phase 1 | Repeat phases 1-4 | | |
| 9 | All colors pulsed periodically (pref. 7-9 Hz) | All colors pulsed randomly (pref. 5-15 Hz) | First color pulsed periodically | All colors pulsed randomly (pref. 5-15 Hz) | Second color pulsed periodically | All colors pulsed periodically | Third color pulsed periodically |

within the device, as described in additional detail below. In alternative embodiments, the programming port 1021 may be disposed within the head 1020 and accessible only when the handle 1010 is removed. The incapacitator 1000 may also have a set screw 1027 or other adjustable fastener to allow positions of a lens or lenses within the incapacitator 1000 as described in additional detail below. FIG. 26 shows a perspective view of the incapacitator 1000.

Figure 27:
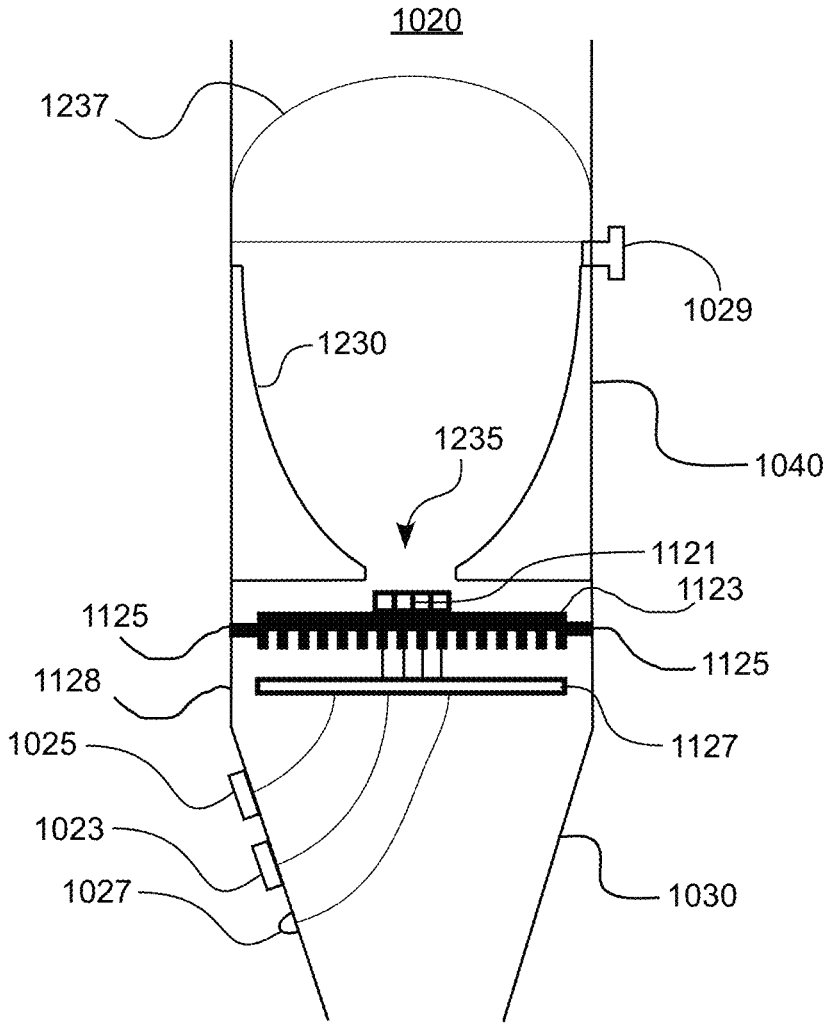
FIG. 27 shows a cross-section of an incapacitator head.

FIG. 27 shows a cross-section of the incapacitator head 1020 with the electronics housing 1030 and optical housing 1040 according to an embodiment of the present invention. The optical housing 1040 contains a reflector 1230 with an opening 1235 positioned above a light emitting apparatus 1121. The reflector 1230 and opening 1235 are oriented to direct light from the light emitting apparatus 1121 towards a lens 1237. The electronics housing 1030 comprises the light emitting apparatus 1121 and an electronics circuit 1127. The light emitting apparatus 1121 is preferably positioned on a heat sink 1123 in a fashion to conduct excess heat away from the light emitting apparatus 1121. Further, the heat sink 1123 may also contain one or more additional mechanical structures 1125 to conduct heat from the heat sink 1123 to a shell 1128 surrounding the electronics housing 1030. Preferably, the heat sink 1123, mechanical structures 1125, and/or the shell 1128 are fabricated from materials conducive to heat conduction, such as metal. The optical housing 1030 may also comprise heat conductive material to further facilitate heat dissipation. The electronics circuit 1127 receives inputs from the switches 1023, 1025 and controls the light emitting apparatus 1121.

Figure 28:
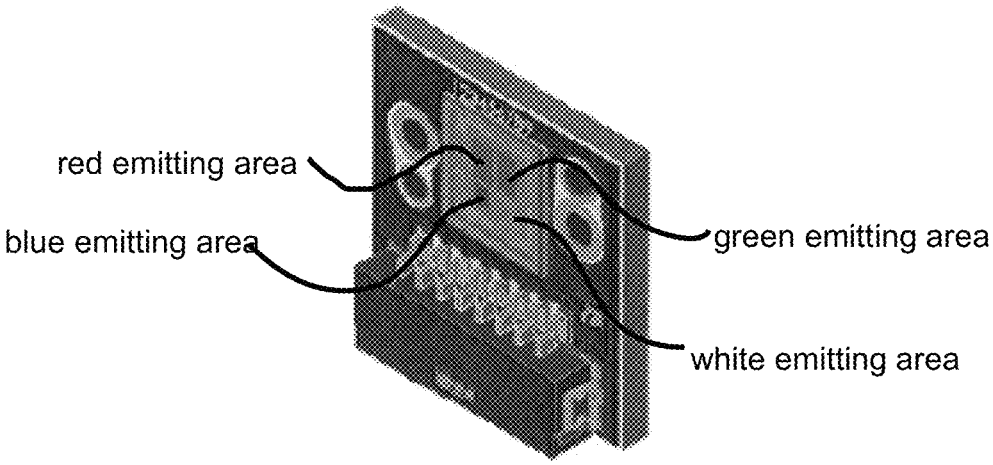
FIG. 28 depicts a commercially available LED module.

Similar to apparatus 2100 described above, the light emitting apparatus 1121 may comprise a light emitting diode array for operating in both the flashlight mode and the incapacitating mode. Preferably, the light emitting diode array comprises a four element array having three colored light emitting substrate areas and a fourth substrate area emitting white light. The light emitting diode array may comprise a high brightness multiple-color LED module, such as the Phatlight CBT-380RGBW module from Luminus Devices. FIG. 28 depicts the Phatlight CBT-380RGBW module. Table 7 below shows the radiant power versus current that may be obtained from the CBT-380RGBW module.

Figure 29A:
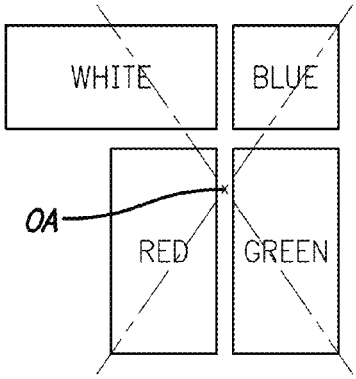
FIGS. 29A-29E depict possible arrangements of colored LED arrays on LED modules.
Figure 29B:
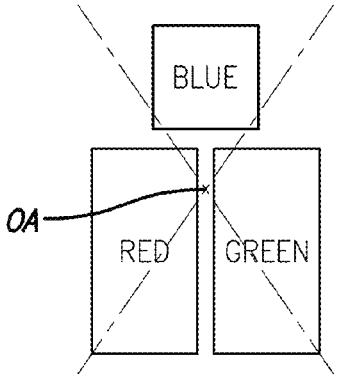
Figure 29C:
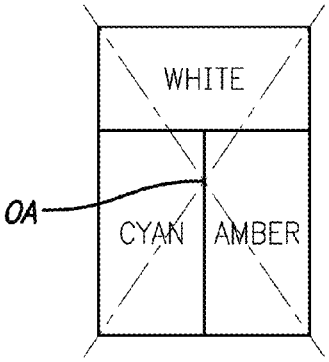
Figure 29D:
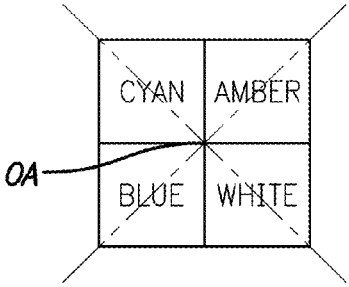
Figure 29E:
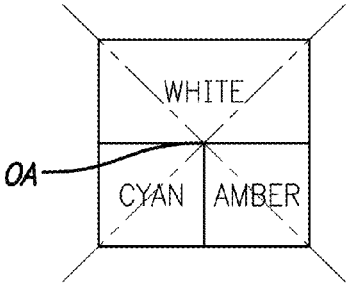

FIG. 29A depicts the arrangement and relative size of the light emitting areas on the CBT-380 GBW module. In FIG. 29A, the rectangular areas depict LED arrays of 4.6×2.6 mm and the square areas depict LED arrays of 2.6×2.6 mm. FIGS. 29B-29E depict other arrangements of LED arrays where the rectangular areas again depict LED arrays of 4.6×2.6 mm and the square areas depict LED arrays of 2.6×2.6 mm. The LED array will be placed as shown with respect to the optical axis OA for the lens system so that each LED is spaced away from the optical axis. The LED array is placed relative to the optical axis (OA) such that a the OA is centered at the diagonals from the outer corners of the LEDs as shown in FIGS. 29A through 29E (in FIG. 29A, the diagonal is approximate due to the larger size of the white LED). FIG. 29B shows a similar configuration with three LED dies. For FIGS. 29A and 29B. the spacings S are 0.15 to 0.2 mm. FIGS. 29C-29E depict arrays using amber and cyan colored LED arrays rather than red and green. They may be similarly spaced as in FIGS. 29A and 29B, or as depicted, they may be substantially adjacent. Those skilled in the art will understand that other arrangements of LED arrays, sizes of LED arrays, and other colors of LED arrays than those depicted in FIGS. 29A-29E may be used in accordance with embodiments of the present invention.

Returning to FIG. 27, the reflector 1230 preferably has a shape and dimensions to concentrate and focus light at a desired distance from the incapacitator 1000. As discussed above, a parabolic radiator, such as that depicted in FIG. 20, provides light direction and focus with desirable characteristics. Simulated results and achieved using a model of the reflector depicted in FIG. 20 with the CBT-380RGBW module are presented in Table 8 below. Note that these simulated results are obtained from a LED flash frequency of 5 Hz, with an on time of 20 msec, and a target distance of 2 m. Note, however, reflectors of other shapes and dimensions may also provide desirable characteristics, depending upon such parameters as size of the light emitting element and the desired focus and distance at which light focus is to be maintained. Note that for certain applications, the reflector 1230 may be used without a lens 1237 in the incapacitator head 1020.

TABLE 7

| Parameters/Chip | Red | | Green | | White | | Blue | |
|---|---|---|---|---|---|---|---|---|
| Chip Size | 4.6 × 2.6 mm | | 4.6 × 2.6 mm | | 3 × 3 mm | | 2.0 × 2.7 mm | |
| Output | R.power (W) | Flux (lumen) | R.power (W) | Flux (lumen) | R. (W) | Flux (lumen) | R.power (W) | Flux (lumen) |
| 3.2A | | | | | | 510 | | |
| 4A | | | | | | | 1.88 | 115.6 |
| 6A | 2.34 | 443 | 2.09 | 1089 | | | 2.57 | 154.5 |
| 8A | | | | | | | 3.12 | 185 |
| 9A | 3.29 | 599 | 2.89 | 1481 | | 650-1350 (depends on the bin code) | | |
| 12A | 4 | 703 | 3.46 | 1795 | | | | |
| 13.5A | | | | | | 1500 | | |
| 18A | 5.26 | 936 | 4.05 | 2044 | | | | |
| 30A | 8.2 | 1478 | 6.8 | 3327 | | | | |

TABLE 8

| Par/LEDs | | Blue | Red | Green | White | Combination | Comments |
|---|---|---|---|---|---|---|---|
| Current (A) | | 8 | 12 | 12 | 9 | 41 max | |
| Radiant Power (W) | simulation | 0.5 | 1 | 1 | 1 | | |
| | specification | 3.1 | 3.42 | 3.4 | | | |
| Luminance Flux (Lm) | specification | 190 | 600 | 1700 | 1100 | | |
| Illuminance (lux) | measurement | | | | 2100 | | |
| Irradiance ($mW/cm^2$) | simulation | 0.2 | 0.53 | 0.53 | 10200* | | *illuminance (lux) |
| | theoretical | 0.62 | 1.81 | 1.8 | | | |
| | measurement #1 | 0.75 | 1.38 | 0.7 | 0.37 (460 nm) | 5.2 | refl. closer to chip |
| | measurement #2 | 0.54 | 1.0 | 1.22 | 1.57 (460 nm) | 5.9 | refl. in calculated position |
| Spot Size (cm × cm) | simulation | 7.5 × 10 | 2.5 × 5 | 2.5 × 5 | 5 × 7.5 | 25 × 25 | at the brightest spot |
| | measurement | 38 × 38 | 25 × 25 | 25 × 25 | 34 × 34 | 30 × 30 | spot distributed |
| Divergence Angle (°) | simulation | 2.3 | 1 × 1 | 1 × 1 | 1.6 × 2.5 | 6.8 × 6.8 | |
| | measurement | 11 | 7 | 7 | 9.7 | 8.6 | |
| Spot Separation (cm) | simulation | 120 | 50 | 50 | 100 | large | |
| | measurement | | | | | | distributed |

Figure 30A:
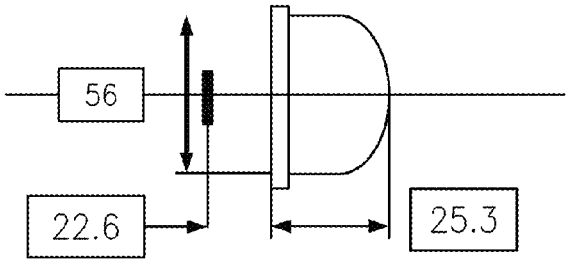
FIG. 30A depicts a Commercial-Off-the-Shelf lens.
Figure 30B:
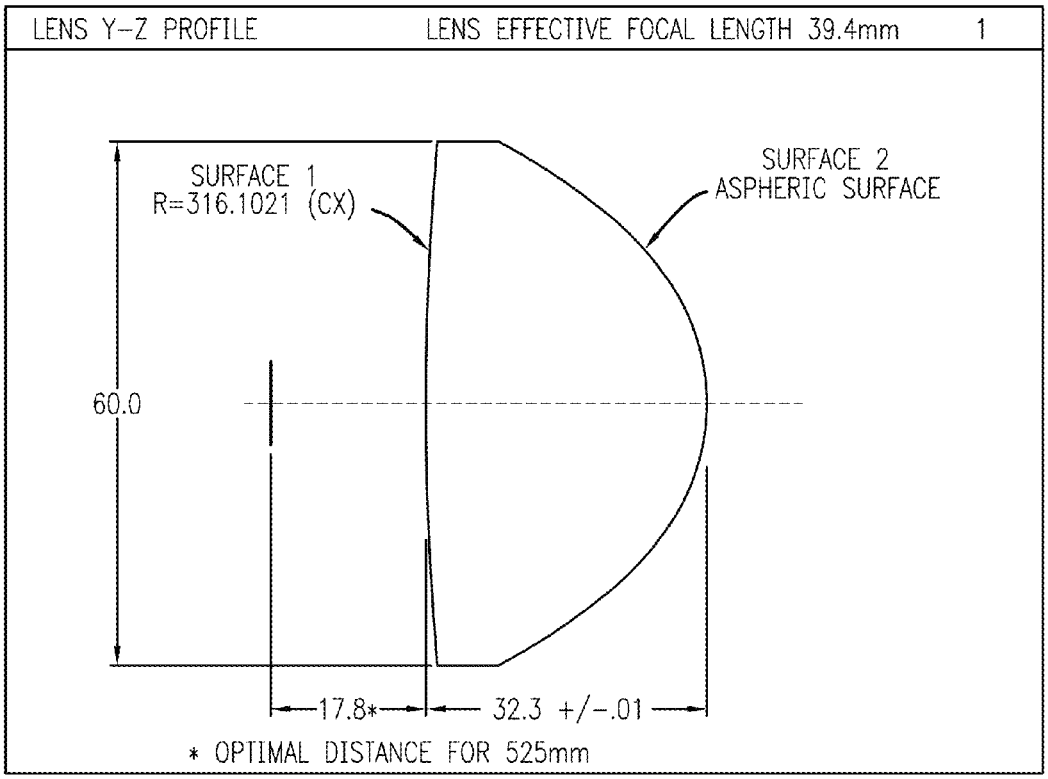
FIG. 30B depicts an aspheric lens.

The lens 1237 in the incapacitator head 1020 may also be used to concentrate and focus light. The lens may be an aspheric lens such as that depicted in FIG. 19 above. FIG. 30A shows a COTS lens with a diameter of 56 mm, a back focal length of 22.6 mm, and a thickness of 25.3 mm available from JML Optical Industries, Inc with characteristics near the desired characteristics. FIG. 30B depicts an aspheric lens with characteristics near the desired characteristics. Particular exemplary parameters for the aspheric lens of FIG. 30B are shown in Table 9 below. This lens gives about 2 to 2.5 times higher power than the lens shown in FIG. 19.

TABLE 9

Notes for Aspheric Convex-Convex Lens as in FIG. 30B *)

| Surface | Radius | Thickness | Material | Diameter | Surface Type |
|---|---|---|---|---|---|
| 1 | 316.1021 | 32.30 | Polystyrene or Rexolite | 60 | Spherical |
| 2 | −24.5950 | — | | 60 | Aspheric |

*) linear dimensions are in millimeters.

The aspheric equation is:

TABLE 9-continued

Notes for Aspheric Convex-Convex Lens as in FIG. 30B *)

| Surface | Radius | Thickness | Material | Diameter | Surface Type |
|---|---|---|---|---|---|

$$Z = \frac{Y^2/R}{1 + (1 - (k+1)\cdot Y^2/R^2)^{0.5}} + AY^4 + BY^6 + CY^8 + DY^{10}$$

Where:

Z—Sag;

Y—Semi-Aperture;

R —Radius of vertex;

K—Conic Constant = −1.00;

A—$4^{TH}$ Order Coefficient = $-8.28266 \cdot 10^{-06}$;

B—$6^{TH}$ Order Coefficient = $-1.339242 \cdot 10^{-09}$;

C—$8^{TH}$ Order Coefficient = $+3.42497 \cdot 10^{-12}$;

D—$10^{TH}$ Order Coefficient = $-3.367105 \cdot 10^{-16}$.

Table 10 below shows simulated results using a lens such as that depicted in FIG. 30A and measured results using a lens such as that depicted in FIG. 30B with the CBT-380RGBW module. The results are again based on a LED flash frequency of 5 Hz, with an on time of 20 msec, and a target distance of 2 m. As shown in Tables 8 and 10, the lens generally produced more concentrated and brighter light.

TABLE 10

| Par/LEDs | | Blue | Red | Green | White | Combination | Comments |
|---|---|---|---|---|---|---|---|
| Current (A) | | 8 | 12 | 12 | 9 | 41 max | |
| Radiant Power (W) | simulation | 0.5 | 1 | 1 | 1 | | |
| | specification | 3.1 | 3.42 | 3.4 | | | |
| Luminance Flux (Lm) | specification | 190 | 600 | 1700 | 1100 | | |
| Illuminance (lux) | measurement | | | | 14820 | | |
| Irradiance ($mW/cm^2$) | simulation | 1.9 | 1.9 | 1.9 | 38000* | | *illuminance (lux) |
| | theoretical | 5.89 | 6.5 | 6.46 | | | |
| | measurement | 5.7 | 4.2 | 3.15 | 3.17 (460 nm) | 14.25 (R3.8, G3.17, B4.57, W2.7) | |

TABLE 10-continued

| Par/LEDs | | Blue | Red | Green | White | Combination | Comments |
|---|---|---|---|---|---|---|---|
| Spot Size (cm × cm) | simulation | 16 × 12 | 25 × 12.5 | 25 × 12.5 | 23 × 23 | | |
| | measurement | 15 × 10 | 25 × 13 | 24 × 15 | 18 × 18 (26 × 26) | | |
| Divergence Angle (°) | simulation | 5.1 × 5.0 | 6.8 × 3.4 | 6.8 × 3.4 | 6.6 × 6.6 | | |
| | measurement | same | same | same | same | | |
| Spot Separation (cm) | simulation | 14 | 12.5 | 12.5 | 10 | | |
| | measurement | 21 | 16 | 6 | 20 | | installation |

As briefly discussed above, one mode of operation of the incapacitator 1000 may be a "flashlight" mode, where only the white LED area is turned on to produce white light with a flashlight-like effect. Table 11 presents a comparison of the results achieved from directing light from the white LED area of the CBT-380RGBW module (at various currents) using a reflector or lens with the conventional white flashlights. Table 10 again, shows the brighter light obtained from using a lens.

TABLE 11

| Device/Parameters | Current | Spot Size (In.) | Irradiance at 2 m (lux) |
|---|---|---|---|
| LEDI-3, Lens | 1 A | 7 × 7 | 2,722 |
| | 4.2 A | 7 × 7 | 8,509 |
| | 9 A | 7 × 7 | 14,870 |
| LEDI-3, Reflector | 1 A | ≈12 × 12 | 460 |
| | 4.2 A | ≈12 × 12 | 1,330 |
| | 9 A | ≈12 × 12 | 2,100 |
| StreamLight | | 9 × 9 | 3,000 |
| Q5 | | 5 × 5 bright 14 × 14 total | 5,200 |

Aspheric lenses may be relatively expensive to fabricate or purchase. A suitable alternative lens may be a Fresnel lens. A Fresnel lens may have a larger spot due to a shorter focus, but may provide good color mixing when defocused. Overall, the Fresnel will generally provide less light than an aspheric lens, but a Fresnel lens should be much less expensive to fabricate. Table 12 below presents a comparison of test results obtained from an aspheric lens and a Fresnel lens.

TABLE 12

| Color/ Parameter Screen at 2 m | Aspheric Lens Spot Size (in.) | Aspheric Lens Irradiance mW/cm² | Fresnel Lens Spot Size (in.) | Fresnel Lens Irradiance mW/cm² | Power Drop Theory | Power Drop Experiment | Power Drop Unspecified Losses |
|---|---|---|---|---|---|---|---|
| Red | 6 × 11 | 6.6 | 8 × 13 | 3.1 | 63% | 46% | 17% |
| Green | 6 × 11 | 4.8 | 8 × 12 | 2.6 | 67% | 54% | 13% |
| Blue | 6 × 6 | 10.04 | 6 × 8 | 5.7 | 78% | 57% | 21% |
| White | 6.5 × 6 | 7.8 | 7 × 8 | 4.1 | 69% | 53% | 16% |

Further improvements may be made to the lens by using an antireflection coating on the lens. Table 8 shows the results obtained with a hard antireflection coating on the aspheric lens described above. As shown in Table 13, a gain of around 8-9% was achieved due to the coating.

TABLE 13

| Color | Uncoated Lens Irrad (mW/cm²) | Coated Lens Irrad (mW/cm²) |
|---|---|---|
| White | 6.7 | 8.6 |
| Red | 5.3 | 5.8 |

TABLE 13-continued

| Color | Uncoated Lens Irrad (mW/cm²) | Coated Lens Irrad (mW/cm²) |
|---|---|---|
| Green | 4.4 | 5.23 |
| Blue | 11.5 | 12.5 |

Returning again to FIG. 27, the set screw 1027 may be used to adjust the position of the lens 1237, based on the desired focusing point of the incapacitator. For example, the set screw 1027 may be loosened to allow the lens 1237 to be moved forward or back while the incapacitator 1000 is operated and the emitted beam is observed. When the desired beam mixing is seen, the set screw can be tightened to hold the lens 1237 in place. If the concentrated beam setting is desired, the set screw 1027 can be loosened to allow the lens 1237 to return to its original position. In other embodiments, a sliding mechanism may be used in place of the set screw 1027, to allow a user to slide the lens 1237 forward or back to achieve a desired focusing or defocusing of the emitted light beam.

In some embodiments of the present invention, it is preferred that a light beam producing a square or rectangle around the illuminated target be generated. As discussed above, light emitting areas may be configured as square or rectangular arrays. The reflector and/or lens within the incapacitator may be configured to radiate light to maintain the square or rectangular shape of the light emitting area so that the beam pattern on a target is also square or rectangular. A square or rectangular beam pattern may facilitate the identification and tracking of a target with a light beam. However, as discussed above, the position of the lens 1237 may be changed to defocus the beam to produce more of a circular pattern, such as the beam seen with a typical flashlight.

As described above, the incapacitating mode generally involves the flashing of lights of different colors at the eyes of an intended target.

In one embodiment, light is directed such that one eye receives light of one color and the other eye receives light of another color. Therefore, it is preferable that the reflector 1230 and/or lens 1237 of the incapacitator 1000 be configured so that the light coming from the different colored light emitting areas not be totally combined, but that the target perceives the light as coming from spatially separated locations. The target will then perceive the flashing light coming from the incapacitator as "bouncing" back and forth between two separate locations along with a different color in each eye.

Figure 31:
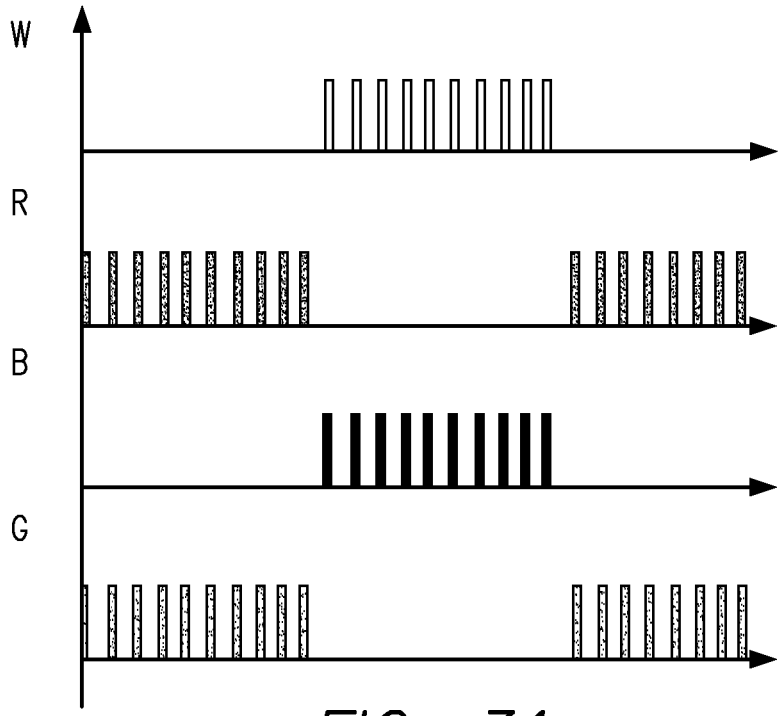
FIG. 31 shows a flash pattern that may be useful in incapacitating a single individual.

The incapacitating mode flashes light with a desired pattern. The patterns may differ depending upon whether it is desired to incapacitate an individual in a stand-off situation or impact multiple people in a crowd. FIG. 31 shows a pattern that may be useful in incapacitating a single individual. In FIG. 31, the flashing pattern is: red (shown by the row labeled R) and green (shown by the row labeled G) colors flash simultaneously for 5 seconds; followed by blue (shown by the row labeled B) and white (shown by the row labeled W) colors flashing for 5 seconds; than the flashing pattern repeats. The on duration for each flash is preferably 25 ms, but may be longer or shorter. Note again that with this flashing pattern, it is preferable that the light from the incapacitator be directed such that one eye receives light of one color and the other eye receives light of the other color. Note, incapacitators according to embodiments of the present invention are not limited to the pattern depicted in FIG. 31. Other patterns may also be useful in affecting a target individual.

Although different patterns of flashing have been explained one variable is significant for all patterns and that is that greater intensity results in greater incapacitating effect.

Figure 43A:
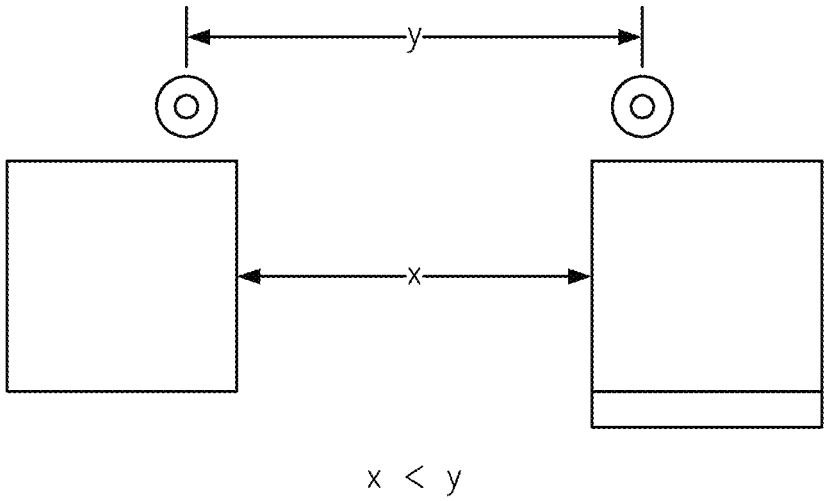
FIGS. 43A and 43B show the exposure of different light spots on each eye within the a range of distance.
Figure 43B:
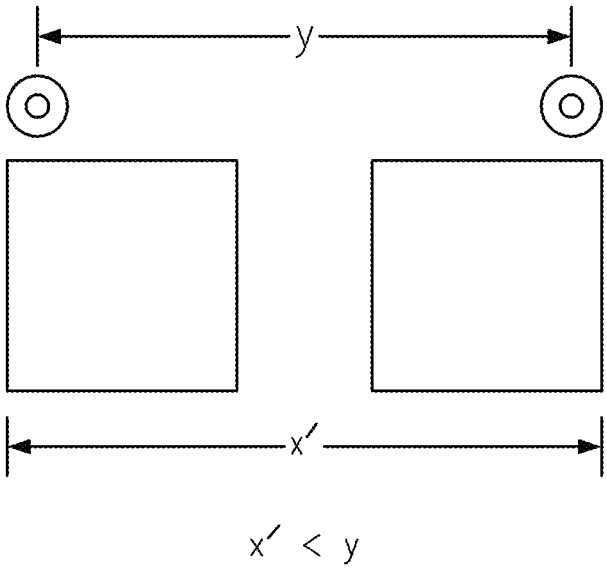

In order to effect having one eye receiving one color and the other eye receiving another color certain variables must be determined and/or assumed. The color images must be separated when received by the target individual. First, the field operating desired range or working distance for law enforcement with respect to an individual is about 7 to about 21 feet. An interpupillary distance of about 68-72 mm is assumed. Therefore the left/right separation of dies should be in the range of about not less than about 0.15 mm. FIGS. 43A and 43B illustrate how the separated color can be implemented for a given distance range. In FIG. 43A at the maximum distance, the separation x of the light spots must be somewhat less than the interpupillary distance Y. In FIG. 43B there is illustrated the configuration for a minimum distance in which the distance x' to the outer edges of the light spots must be somewhat greater than the interpupillary distance Y. For this type of individual target control operation, the same two LEDs are used in order to place the light spots in the eye during the pattern. a constant color selection is used for a time of 5-10 seconds. Then another two colors with the appropriate spacing on the targets eyes is used. For example, in a first series, red and green and in a second series, blue and white. A flash rate of 8-9 Hz is used. Another flash sequence for this purpose is:

red and green at 11 Hz for 5 seconds
white and blue at 7 Hz for 5 seconds
red and green at 7 Hz for 5 seconds
white and blue at 11 Hz for 5 seconds'
This pattern can then be repeated but with the frequency randomized.
In a single target situation the square dies provide an officer the opportunity to target the individual and move in to overcome the target.

An aspheric lens of the type in FIG. 30B with Effective Focal Length 39.4 mm provides the achievement of the goal. The optical parameters of the lens are defined to direct light to each eye individually within this range of distance and eye spacing. A specific aspheric lens design is outlined in Table 9. An angle of dispersion of from about 5° to about 5.5° can be achieved with such an aspheric lens.

Figure 32:
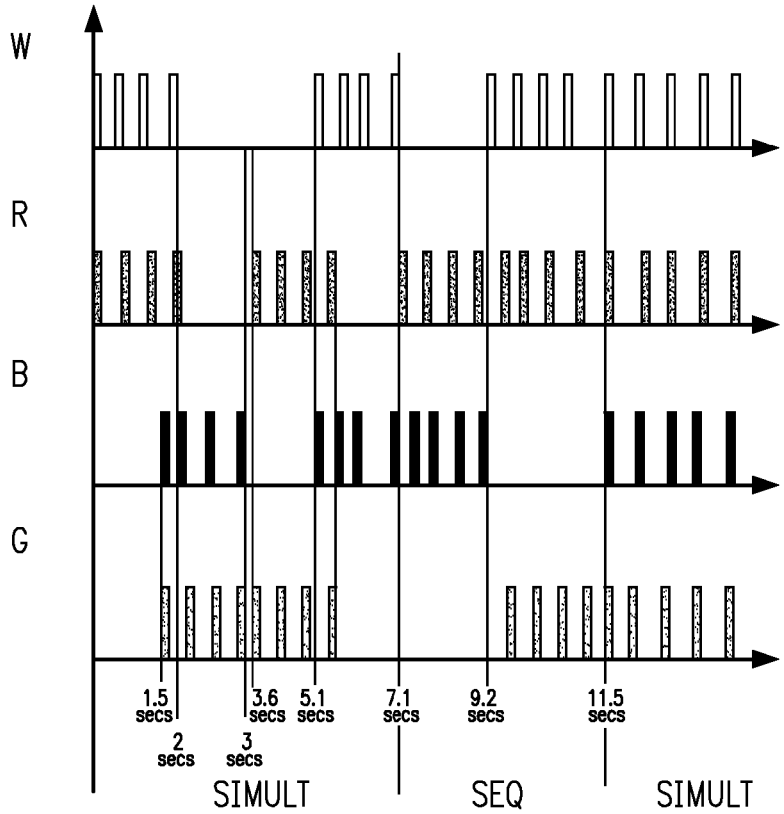
FIG. 32 depicts a pseudo-random pattern of various color pulses that may be useful for crowd control.

Other patterns may be useful in affecting groups of individuals for crowd control. FIG. 32 depicts a pseudo-random pattern of various color pulses over a 20 second time period. In FIG. 32, the row labeled R indicates red flashes; the row labeled W indicates white flashes; the row labeled B indicates blue flashes; and the row labeled G indicates green flashes. As shown in FIG. 32, there is a time period where multiple flashes may occur simultaneously, followed by a time period where the flashes may occur sequentially, and followed by another time period of simultaneous flashes. Again note that incapacitators according to embodiments of the present invention are not limited to the pattern depicted in FIG. 32 for crowd control. Other patterns may also be useful for crowd control. Also, this type of pattern is useful for individuals but lacking the color-eye separation feature.

As briefly discussed above, incapacitator 1000 may also have the capability to run in a "flashlight" mode. The "flashlight" mode may be provided by turning on only the white LED emitting area. Using the CBT-380RGBW module, the white LED provides an illumination of 24,142 lux at a distance of 2 meters when operated in constant current mode. This is four times higher than the best flashlights generally known in the art and available for purchase. However, to provide such illumination, active cooling of the CBT-380RGBW module may be necessary, which may not be acceptable in a handheld device. For the "flashlight" mode, it is preferred that the white LED area be operated in a pulsed mode to decrease the power required and heat generated. Operation of the incapacitator 1000 in the "flashlight" mode using a pulsed mode at a frequency of around 200 Hz, and at a duty cycle of approximately ⅕ is preferred. At this frequency and duty factor, the incapacitator 1000 (using the aspheric lens described above) provides an average illuminance of 5,600 lux (with antireflection coated lens), which is close to that of the brightest flashlights. Moreover, the illuminated spot is generally larger than most commercial flashlights. The flashlight mode may also be programmed to operate in a full-power mode to provide maximum light from the incapacitator or an "energy saving" mode where less power (e.g. 50% of full power) is used, but the light from the incapacitator is also less. Duty factor settings between the full power and energy saving modes may be ⅙ and 1/12 or ⅓ and ⅙. Note that higher duty factors may result in operating times before a battery recharge or replacement is required.

Due to the currents needed to drive the high brightness LEDs, heat generation and dissipation is a concern in the fabrication and operation of incapacitators according to embodiments of the present invention. As shown in FIG. 27, the light emitting element 1121 is preferable disposed on a heat sink 1123 providing for dissipation of heat from the light emitting element 1121. Further, the heat sink 1123 may be coupled to other structures 1125 that allow for the conduction of heat to the surface of the incapacitator head 1120. The incapacitator head 1120 itself may also be made of metal to allow for additional heat conduction away from the light emitting element 1121. For example, the other structures 1125 may comprise a copper plate used to conductively couple the heat sink 1123 to the incapacitator head 1120. However, such heat conducting elements are generally constructed of relatively heavy metal, resulting in an overall increase in weight for the incapacitator.

Heat generated by the light emitting element 1121 may be reduced by controlling the operating time for the element 1121. For example, electronics within the incapacitator may be programmed to automatically turn off the light emitting element 1121 after 20 seconds of continuous operation or some other time duration. The cessation of operation after some pre-determined time period allows the light emitting element some time to cool down and thus prevents heat-related damage from occurring to the light emitting element 1121 or other electronics within the incapacitator. The automatic shutoff may also lengthen battery operating time before requiring a recharge by essentially preventing the incapacitator from unintentionally being left on for long periods of time.

Further protection of the light emitting element 1121 or other incapacitator electronics may be provided by mounting a thermocouple or other temperature sensitive device at or near the light emitting element 1121. For example, a thermocouple may be used to trigger an automatic shutoff of the incapacitator 1000 if the temperature of the light emitting element 1121 reaches 70° C. or some other desired temperature. The light emitting element 1121 may require additional power electronics to drive its light emitters and the power electronics may also heat up during the operation of the incapacitator. Therefore, a thermocouple or other heat sensing device may be used to sense the heat from the power electronics in additional to or as an alternative to the thermocouple for the light emitting element 1121. The power electronics thermocouple would also trigger a shutdown of the device if a selected temperature is reached.

Figure 33A:
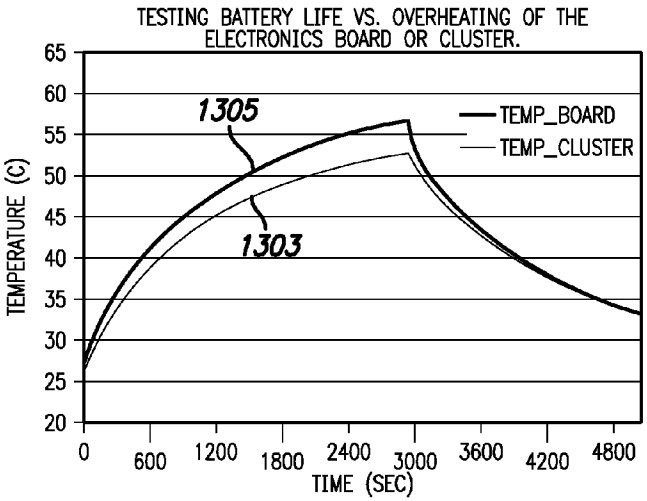
FIGS. 33A and 33B show temperature versus time results for an all metal body incapacitator.
Figure 33B:
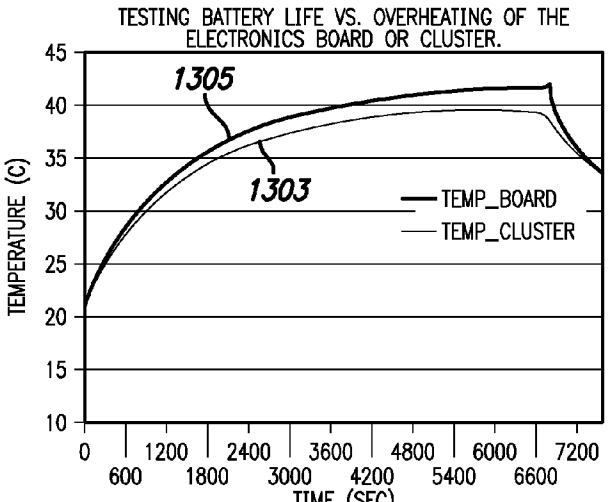

FIG. 33A shows the results of triggering several cycles of the crowd control pattern depicted in FIG. 32 in an incapacitator having a metal head and using the CBT-380RGBW module, until the unit reaches an automatic shutdown of 50% of battery capacity. Curve 1303 shows the temperature sensed on a power electronics board and curve 1305 shows the temperature sensed at the CBT-380RGBW module. The decline in temperature appears when the unit shuts off due to the battery capacity shutdown. FIG. 33B shows a similar set of curves when the incapacitator is operated in the flashlight mode. These graphs show that the battery was exhausted before the LED module or power electronics overheated. The graphs also show that the LED module warms a few degrees faster than the electronics.

Figure 34A:
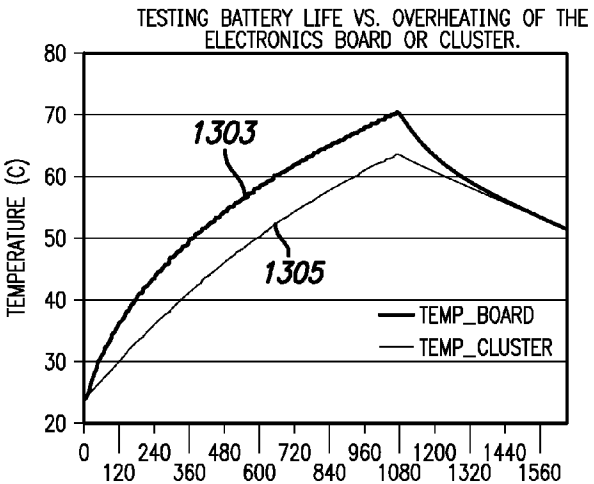
FIGS. 34A and 34B show temperature versus time results for a partially plastic incapacitator.
Figure 34B:
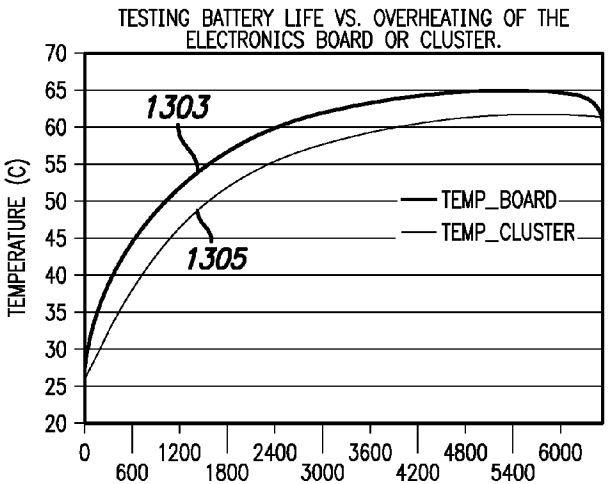

As discussed above, it may be preferred to reduce the overall weight of the incapacitator by reducing the size and weight of the heat sink and/or other heat conducting structures within the incapacitator. These structures or portions of them may be replaced with structures made of plastic or other such lighter weight materials. Such materials may reduce the weight of the incapacitator, but may also reduce the heat conduction capabilities of the unit, resulting in thermal issues for the unit. FIGS. 34A and 34B show the temperatures at LED module and power electronics sensors using a similar test to that used for the results shown in FIGS. 33A and 33B for an incapacitator using plastic rather than metal for some structures and using a reduced weight heat sink. FIG. 34A shows that the power electronics board temperature (represented by curve 1303) actually heated up faster than the LED module temperature (represented by curve 1305) when the partially plastic incapacitator operated in the crowd control mode. FIG. 34B shows the temperatures when operating the partially plastic incapacitator in the flashlight mode. FIG. 34A shows that the thermal limits within the incapacitator were reached before the battery drained when operating the incapacitator in the crowd control mode. FIGS. 33A and 33B show that there was no significant difference in flashlight operating time between the all metal and partially plastic incapacitators.

Figure 35:
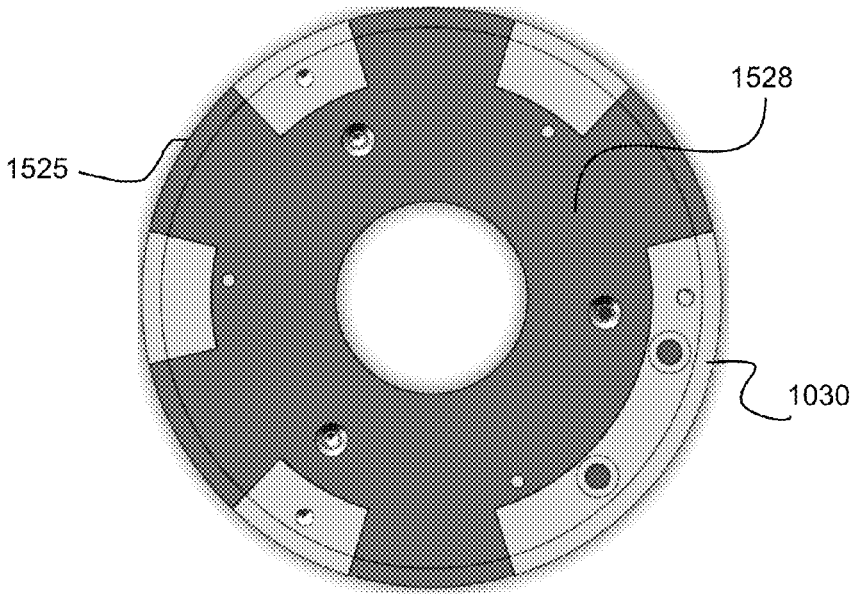
FIG. 35 shows a heat-dissipating ground plane.

As noted above, one method of dissipating heat from the head 1020 is provided by disposing a heat sink 1123 under the light emitting apparatus 1121 as shown in FIG. 27. However, as discussed above, the electronics circuit 1127 used to control the light emitting apparatus 1121 may itself be a significant source of heat. Therefore, some embodiments of the present invention may use a thick metal ground plane disposed beneath the electronics circuit 1127 to dissipate heat from the electronics circuit 1127. FIG. 35 shows a heat-dissipating ground plane 1528 disposed within the electronics housing 1030. The ground plane 1528 may comprise copper, a copper allow, or other metal or other materials providing appropriate electrical grounding and heat dissipation. The electronics circuit 1127 (not shown in FIG. 35) is then disposed upon the ground plane 1528 to allow heat to be conducted away by the ground plane 1528. The heat dissipation is facilitated by tabs 1525 that project from the ground plane 1528 to the external surface of the electronics housing 1030. This allows heat from the electronics circuit 1127 disposed on the ground plane 1528 to be conducted to the external ambient environment of the electronics housing 1030. The ground plane 1528 may also be configured to conductively couple to the light emitting apparatus 1121 (not shown in FIG. 25) and/or a heat sink conductively coupled to the light emitting apparatus 1121 to allow the ground plane 1528 to also conduct heat away from the light emitting apparatus 1121.

Figure 36A:
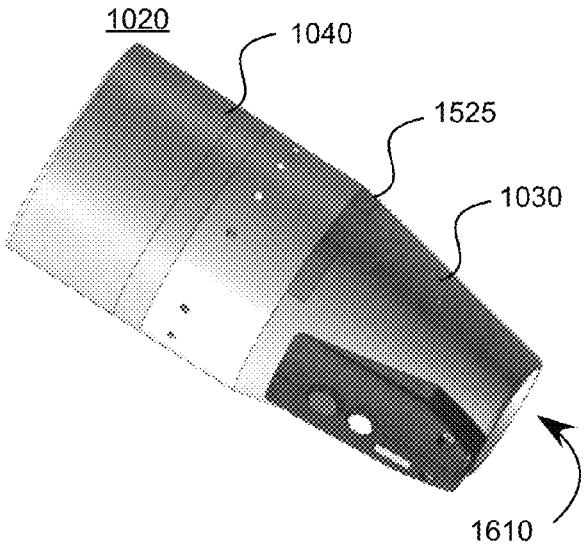
FIG. 36A shows an incapacitator head using a heat-dissipating ground plane and using internal coupling for attaching a handle to the head.
Figure 36B:
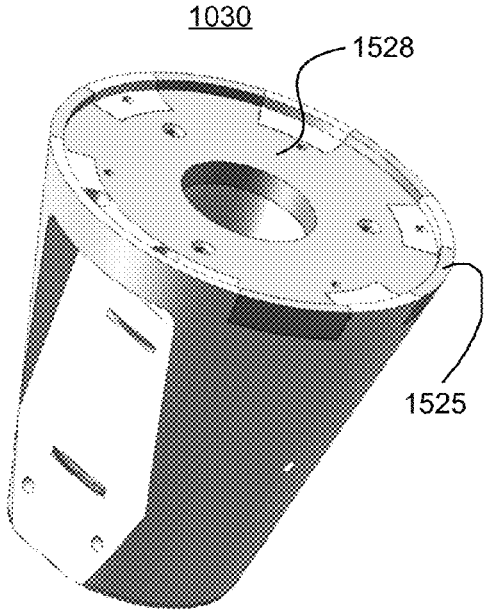
FIG. 36B shows an electronics housing with a heat-dissipating ground plane.

FIG. 36A shows an external view of an embodiment of the incapacitator head 1020 where the tabs 1525 of the ground plane 1528 extend to and are flush with the external portions of the electronics housing 1030. In this embodiment, tabs 1525 are configured to perform the majority of the heat conduction from the electrical circuit within the head 1020. Therefore, the electronics housing 1030 and/or the optical housing 1040 may comprise metal, plastic, a mix of metal and plastic, or other materials, since the external portion of the electronics housing 1030 (other than the ground plane tabs 1525) is not relied on to provide conductive coiling for the items within the housing 1030. FIG. 36B shows a drawing of the electronics housing 1020 with the ground plane 1528 disposed within the housing 1020.

Figure 37A:
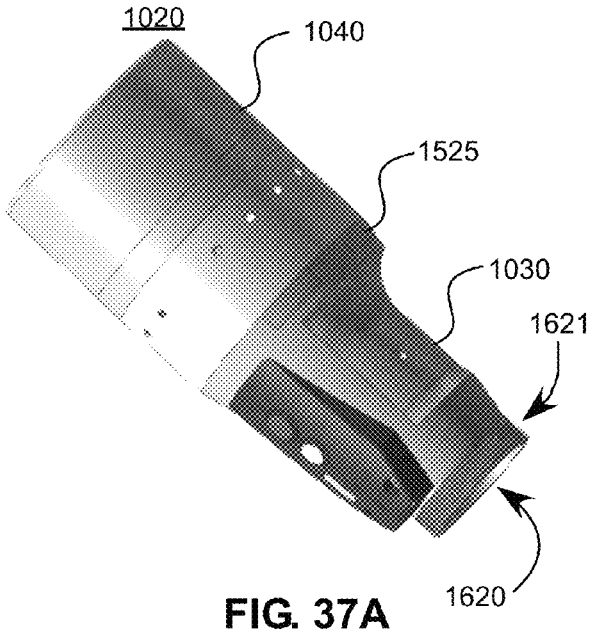
FIG. 37A shows a smaller diameter incapacitator head using a heat-dissipating ground plane and using external coupling for attaching a handle to the head.
Figure 37B:
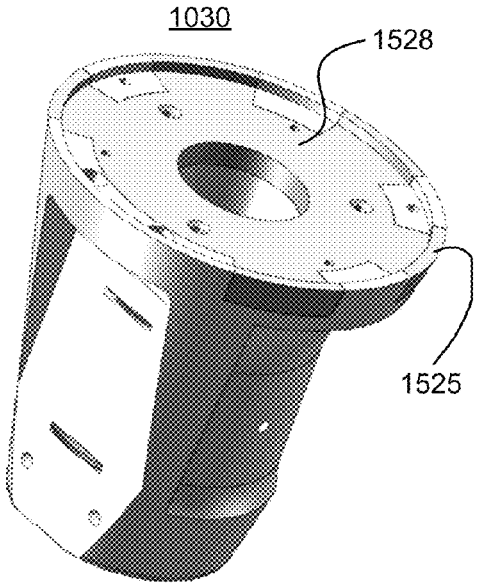
FIG. 37B shows a drawing of an electronics housing with a ground plane disposed within the housing.

FIG. 37A shows an external view of another embodiment of the incapacitator head 1020 where the tabs 1525 of the ground plane 1528 extend to and are flush with the external portions of the electronics housing 1030. In this embodiment, the electronics housing 1030 has a smaller diameter than the embodiment depicted in FIGS. 36A and 36B to allow for some weight reduction and easier handling. In this embodiment, the electronics housing 1030 and/or the optical housing 1040 may again comprise metal, plastic, a mix of metal and plastic, or other materials, since the external portion of the electronics housing 1030 (other than the ground plane tabs 1525) is not relied on to provide conductive coiling for the items within the housing 1030. FIG. 37B shows a drawing of the electronics housing 1020 with the ground plane 1528 disposed within the housing 1020.

Figure 38A:
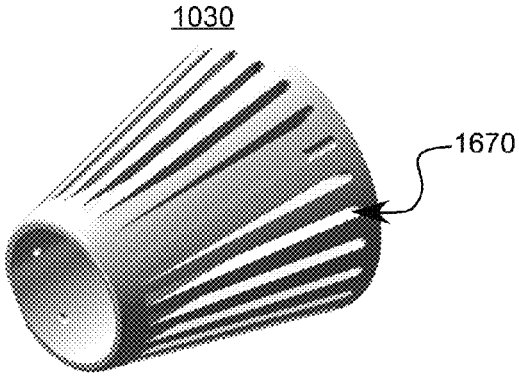
FIGS. 38A, 38B, and 38C show a slotted electronics housing.
Figure 38B:
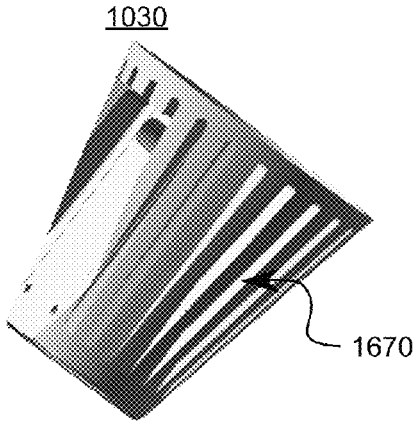
Figure 38C:
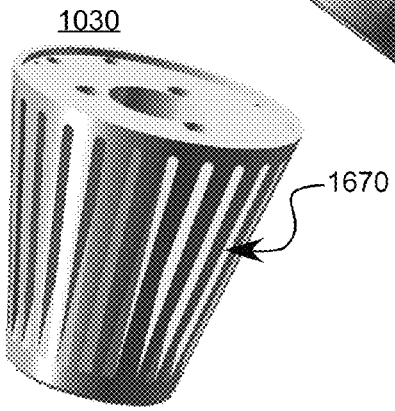

FIGS. 38A, 38B, and 38C show various views of a slotted electronics housing 1030. This housing 1030 may be used in place of the electronics housing 1030 depicted in FIGS. 36A, 36B, 37A, and 37B and elsewhere. With the housing 1030 depicted in FIGS. 38A, 38B, and 38C, slots 1670 are cut into the housing 1020 to allow air to freely circuit around the elements disposed within the housing 1020. These slots 1670 may lessen the need for heat sinks or heat conductive ground planes to be used within the housing 1030 or lessen the weight and/or size of such heat sinks or ground planes and thus decrease the overall weight or size of the incapacitator. Heat generated by the elements within the housing 1030 is freely dissipated into the air surrounding the elements. Note also that the weight of the housing 1030 may also be decreased due to the material removed to create the slots 1670.

Note also the FIG. 36A depicts the entry point 1610 where the handle 1010 (shown in FIG. 25) internally couples to the head 1020. In FIG. 36A, the handle 1010 may couple to a fixture within the head 1020, such as a grooved slot, threads, or other holding means, to preferably tightly mechanically couple the handle 1010 to the head. Electrical contacts between an electrical source in the handle 1010 (e.g. a battery pack) to electronics with the head 1020 is provided through the entry point 1610.

FIG. 37A depicts where the handle 1010 may externally couple to the head 1020. In FIG. 37A, there are external threads 1621 on the head 1020, so that the handle 1010 screws on to the head 1020. Electrical contacts between an electrical source in the handle 1010 (e.g. a battery pack) to electronics with the head 1020 is provided through the entry point 1620. Other embodiments may use still other mechanisms or means for coupling the handle 1010 to the head 1020. Other head embodiments or electrical housing embodiments may use the described mechanisms or means or other mechanisms or means to couple a handle to a head. For example, the slotted electronics housing depicted in FIGS. 38A, 38B, and 38C may use internal or external coupling to attach a handle to a head.

As briefly discussed above, preferred embodiments of the incapacitator 1000 contain a battery pack within the handle 1010 of the incapacitator 1000 as depicted in FIG. 25. An exemplary battery pack providing appropriate characteristics for operating with the CBT-380RGBW module and associated electronics has a pack capacity of 2300 mA; an operating voltage of 7.4 V, a charge voltage of 8.4V; and average discharge current of 6000 mA; a pulse discharge current of 41000 mA; a normal battery charge current of 500 mA; and a fast battery charge current of 2000 mA. The battery pack and handle 1010 may be configured to mate with the head 1020 to allow for easy and quick disconnect. Preferably, the battery pack is configured to allow recharge from a 120 V house current charger and/or a 12 V automobile charger.

An incapacitator according to an embodiment of the present invention may comprise a battery operated dual mode device in a conventional mid size flashlight format, which provides ultra bright flickering light of different colors, frequencies and color/frequency combinations in the 5-20 Hz range as well as intense narrow beam of white light on the level of the brightest conventional flashlights. The device may be a supportive offensive/defensive device to security forces in the everyday operations and also replace the conventional flashlight because of its dual mode operation.

Such an incapacitator may by effective at distances up to 21 feet in day operations and up to 35-40 feet in night operation. Using a single powerful RGBW LED chip (such as the CBT-380RGBW module described above), allows the incapacitator to provide four highly intense (red, green, blue and white) beams slightly separated in space (on the target). Such a chip and the optics within the incapacitator provide beam profiles that are rectangular in red and green and square in blue and white with a average concentration angle at 6° full angle. The irradiance at a distance of 7 feet may be as follows: red is 7.7 $mW/cm^2$; green is 5.5 $mW/cm^2$; blue is 12.6 $mW/cm^2$; and white is 9.4 $mW/cm^2$ (plus/minus 10%). Irradiance would be 9 times lower at a distance of 21 feet. The incapacitator may be configured to operate in a color mixing mode which provides a wide angle (approximately 20°) beam of mixed overlapping colors when the lens placed approximately 3 mm out of focus. The irradiance provided by each color is 2-2.5 times lower in the color mixing mode.

The incapacitator according to this embodiment may also operate as a conventional flashlight. In such a mode, the incapacitator provides a square white beam of 6° full angle. It can operate in two regimes: energy saving and full power. In the energy saving mode, it can provide 2700 lumen (+/−10%) at 7 feet. In the full power mode, it can provide 5550 lumen (+/−10%) at 7 feet.

The power supply for this embodiment may be a rechargeable battery pack contained within the handle of the device. If battery power is low, the handle can be detached and replaced with a spare handle. The low battery handle can then be recharged whenever operational conditions permit. An indicator on the unit can provide an indication of low battery power and the need for a recharge.

The incapacitating mode features may be programmable, allowing a nearly infinite variety of operational combinations of beam sequencing, frequencies and pulse durations. A programmable chip may be located within electronics inside this embodiment to provide the programmable features. The chip may be programmed at the time of manufacturing through a connector located on the device (for example, see element 1021 in FIG. 25) and can be reprogrammed as desired. Operation of the incapacitator in the incapacitating mode may be triggered by simply pushing a button on the device. The unit will then cycle through the programmed flash sequence and the cycle can be reinitiated by pushing the button again.

Effective use of the incapacitating mode of the unit may be provided by first pointing the unit a target's face. Once the incapacitating flashing is triggered, the unit should be rotated such that one beam flashes in one eye and the other beam flashes in the other eye. When the flashing sequence switches to another set of colors, the unit should be rotated or retargeted such that the new colors flash with one color in one eye and the other color in the other eye.

Other embodiments according to the present invention may provide for the selection of multiple incapacitating flash patterns or other colors for use in the flash patterns. Still other embodiments may provide for modes adapted for operation for targets at longer ranges, or for targets at shorter ranges, or selection of longer and shorter range modes. Still other embodiments may use light emitting elements other than the LED arrays discussed above.

Figure 39A:
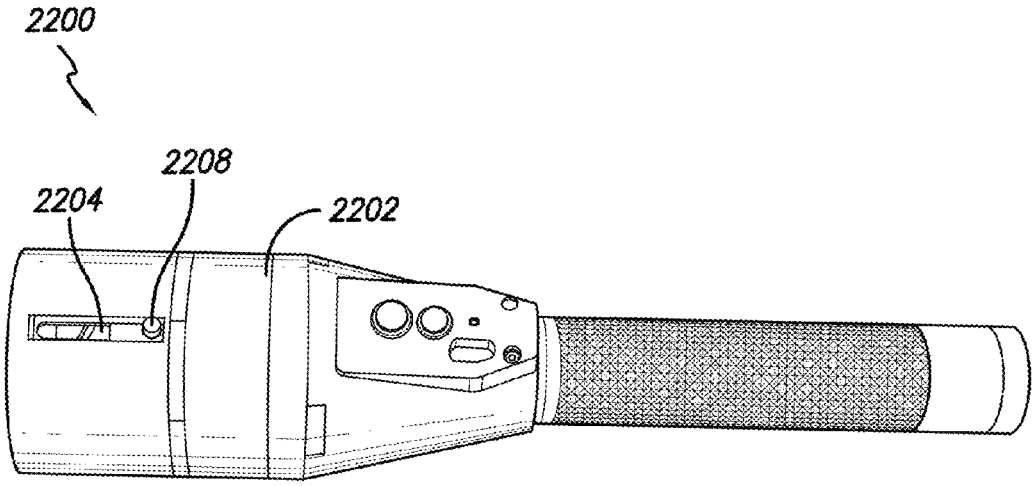
FIGS. 39A and 39B show a moving lens embodiment in a rearward and forward position respectively.
Figure 39B:
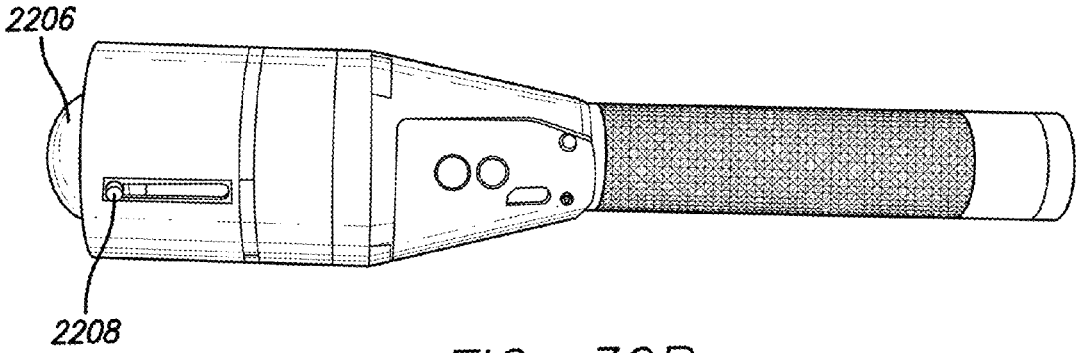

A further embodiment is described with reference to FIGS. 39A and 39B, 40A and 40B, 41A and 41B and 42A and 42B. This embodiment is a structure that allows the user to move the lens along the optical axis in relation to the LED source. As seen in FIGS. 39A and 39B, the unit 2200 has outer cover shell 2202 in which there is an elongate slot 2204 parallel with the optical axis. Inside the outer cover shell a lens 2206 is mounted on a lens housing (not shown) that is slidably mounted inside of the outer cover shell 2202. The lens housing has a knob 2208 that projects through the slot 2204 to be accessible from the outside. Sliding the knob 2208 backward and forward moves the lens housing and the lens 2206 inside the outer cover shell 2202. In FIG. 39A, the knob 2208 is in the rearward position and in FIG. 39B the knob 2208 is in the forward position.

This structure provides the opportunity of moving the lens 2206 along the optical axis in relation to the LED light source. This movement places the source out of the lens focal plane (defocuses the beam), which in turn changes the size and shape of the light spot on the target. Refocusing provides more options for using the device specifically in the white flashlight mode, but also is useful in some incapacitating applications. As will be seen, the structure allows movement of the lens from a first, most rearward position to a second, most forward position. The focused position is placed at a selected medium point in the range of motion, so that the most rearward position has the source in front of the focal plane and the most forward position has the source behind the focal plane.

Figure 40A:
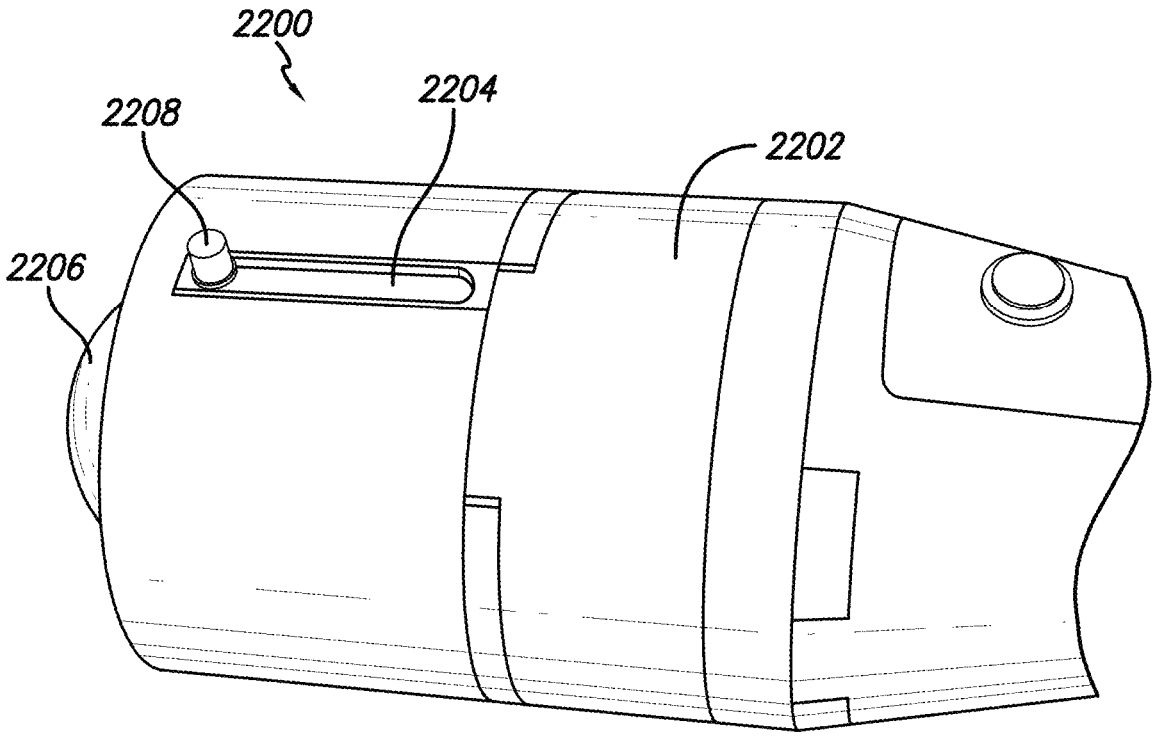
FIGS. 40A and 40B show a moving lens embodiment in a forward unfocused position and the spot made on a target respectively.
Figure 40B:
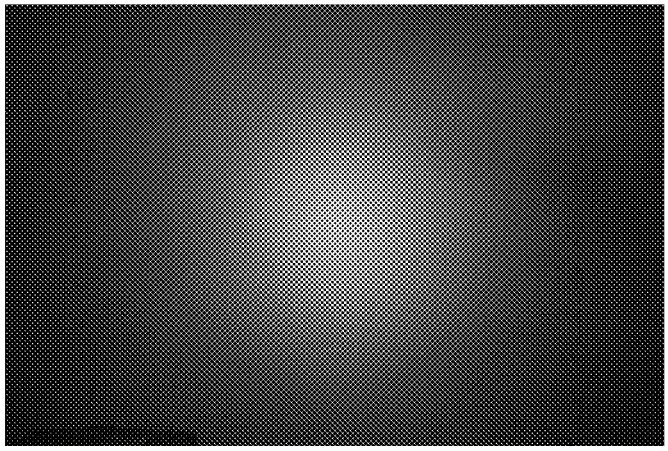

When the lens is in the forward position as in FIGS. 39B and 40A, the light spot is similar to the spot provided by all conventional flashlights with reflector. Security forces are accustomed to such a pattern. For example when police stop a car and check the driver's license illuminating it with the central part of the spot, they can still see the content of the area surrounding the driver via illuminating with less intense light surrounding the central spot. This is shown in FIGS. 40A and 40B.

Figure 41A:
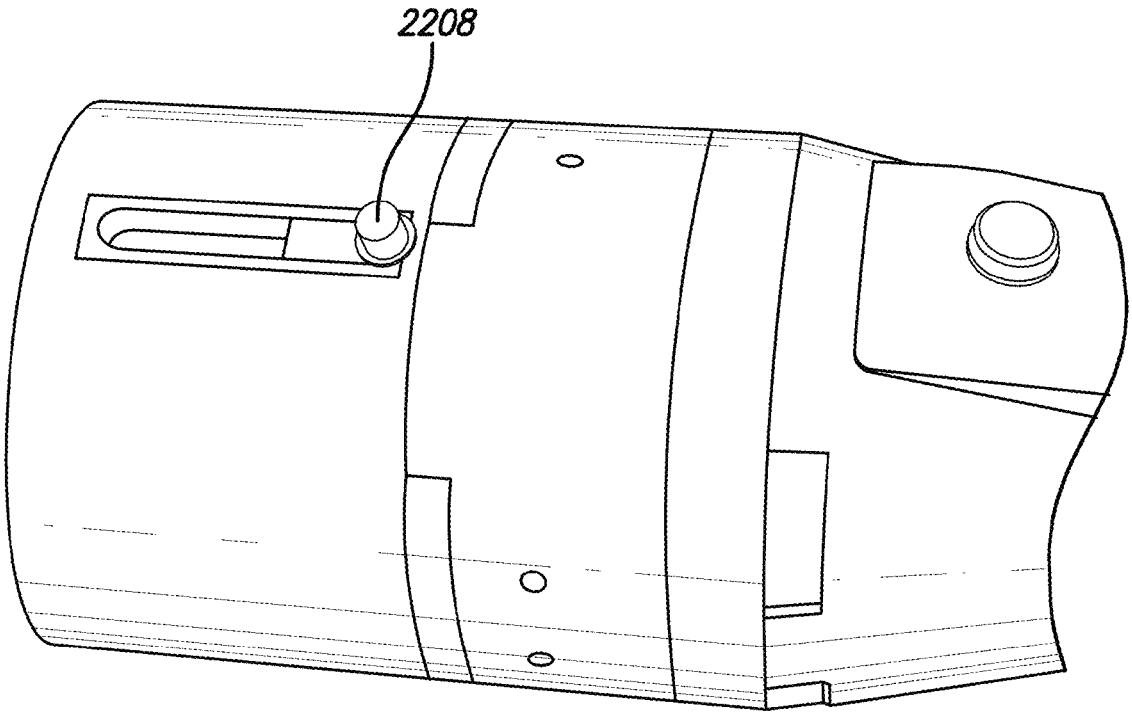
FIGS. 41A and 41B show a moving lens embodiment in a rearward unfocused position and the spot made on a target respectively.

FIG. 41A shows the device head with the knob 2208 moved backwards, the lens 2206 being in the rearward position. The spot in that position is a large circle as in FIG. 41B. This feature is useful for the quick search at short and medium distances, and is not provided by the conventional flashlight.

Figure 42A:
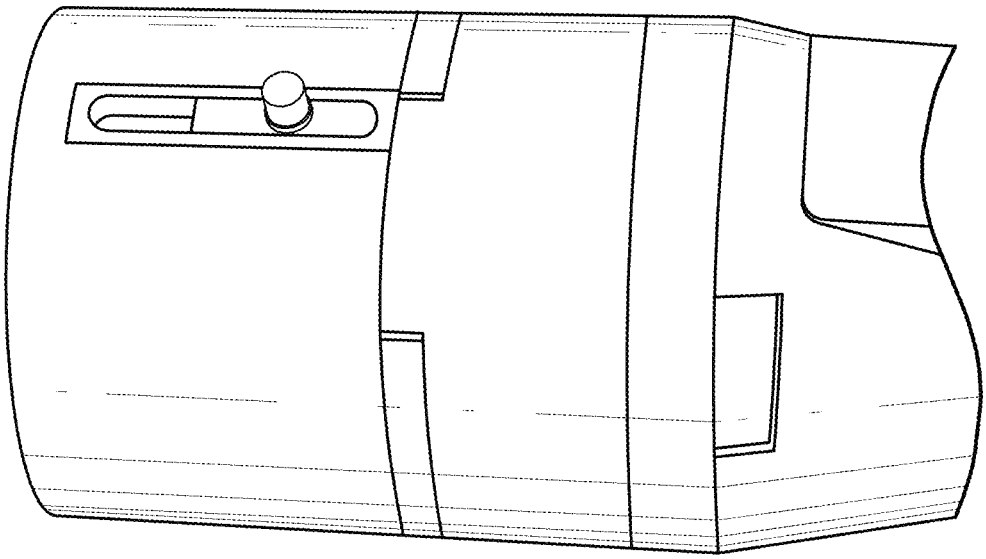
FIGS. 42A and 42B show a moving lens embodiment in a focused position and the spot made on a target respectively.
Figure 42B:
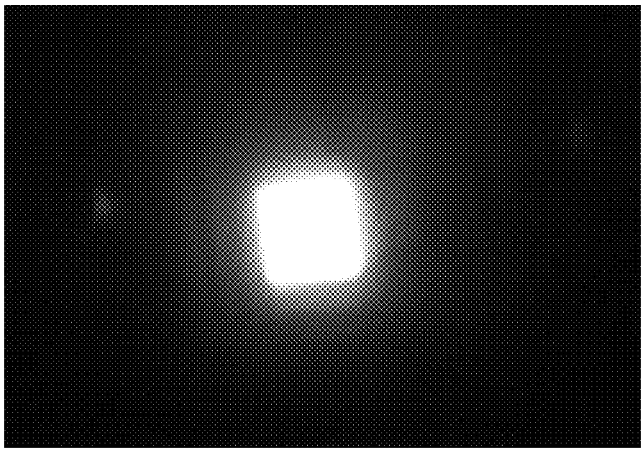

FIG. 42A shows a position, forward of the most rearward position, where the source is in focus. This provides a very narrow beam and a very bright spot as shown in FIG. 42B. This feature in flashlight mode can be very useful for signaling far field illumination and spotting and following the target at a far distance.

Figure 41B:
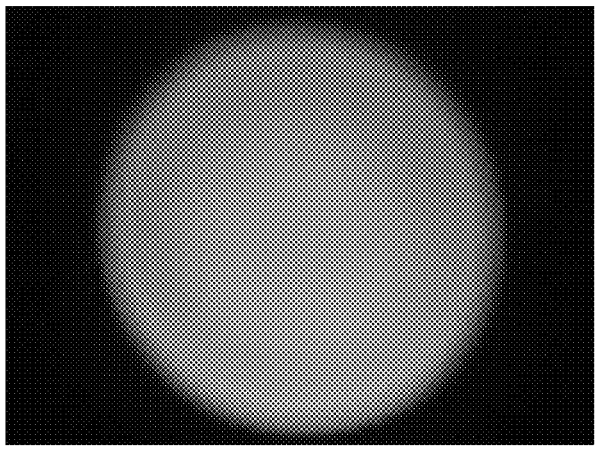

Similar spot patterns will appear when the device is used in the incapacitating multicolor flashing modes. In the focused position of the lens the patterns are as described above. In the defocused modes, all colors will be mixed. despite that in the defocused mode the intensity of each color is reduced, the effect can still be substantial because a number of color can work together. The effect of the defocused light in the incapacitating mode, when the pattern shown in FIG. 40A is used, is not substantial because a substantial amount of light is wasted in the wide (and therefore of low intensity) spot surrounding the central spot. Contrary however, the effect of the defocused light in the incapacitating mode, when the pattern shown in FIG. 41B is used may have substantial effect, and can be used at short to moderate distances in such situations as crowd control and locking inmates in cells in prisons.

The foregoing Detailed Description of exemplary and preferred embodiments is presented for purposes of illustration and disclosure in accordance with the requirements of the law. It is not intended to be exhaustive nor to limit the invention to the precise form or forms described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. This disclosure has been made with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising step(s) for . . . ".

What is claimed is:

1. An apparatus for causing incapacitation comprising:

a handle, wherein the handle comprises a power source;

a head coupled to the handle, wherein the head comprises:

a light emitting apparatus having at least two spatially separated light emitting areas, wherein each light emitting area emits light at a different wavelength; and an electronics assembly for controlling the emission of light from the light emitting apparatus; and a light concentrating element disposed to receive light from the light emitting apparatus, whereby the light emitting areas are enabled on and off by the electronics assembly in a selected sequence.

2. The apparatus according to claim 1, wherein distances between the spatially separated light emitting areas provide that a viewer perceives light at different wavelengths coming from different locations when each light emitting area is exclusively enabled.

3. The apparatus according to claim 1, wherein the light emitting apparatus comprises a light emitting diode module having a red light emitting substrate, a blue light emitting substrate, and a green light emitting substrate.

4. The apparatus according to claim 1, wherein the light emitting apparatus comprises a light emitting diode module having a red light emitting substrate, a blue light emitting substrate, a green light emitting substrate, and a white light emitting substrate.

5. The apparatus according to claim 1, wherein the handle comprises a rechargeable battery and the handle is configured to be replaceably coupled with the head.

6. The apparatus according to claim 1, wherein the light concentrating element comprises a structure that has an internal surface contoured to focus light from the light emitting apparatus into a beam and the structure is disposed within the head.

7. The apparatus according to claim 1, wherein the light concentrating element comprises an optical lens disposed within the head.

8. The apparatus according to claim 1, wherein the head further comprises a heat sink, wherein the heat sink is configured to conductively conducts heat from the light emitting apparatus to an external surface of the head.

9. The apparatus according to claim 1, wherein the head further comprises a heat conductive ground plane, wherein the heat conductive ground plane is configured to conduct heat from the electronics assembly to an environment outside the head.

10. The apparatus according to claim 4, wherein the electronics assembly is controllable to select between flashing of light from multiple substrates and emission of light only from the white light emitting substrate.

11. The apparatus according to claim 3, wherein the electronics assembly is controllable to select between individual flashing of light from multiple substrates and emission of light from all substrates simultaneously to produce white light.

12. The apparatus according to claim 1, wherein the apparatus further comprises a programming port electrically coupled to the electronics assembly.

13. The apparatus according to claim 7, wherein the head further comprises an apparatus for controlling a distance of the optical lens from the light emitting apparatus.

14. A method for visual incapacitation of a subject comprising:

providing at least two light emitting areas, wherein at least one of the light emitting areas emits colored light;

flashing the light emitting areas in a pattern;

concentrating the light emitted from the light emitting areas into one or more light beams; and directing the one or more light beams towards a subject, wherein each light emitting area comprises a high brightness light emitting diode substrate.

15. The method according to claim 14, wherein four light emitting areas having different colors are provided and flashing the light emitting areas in a pattern comprises:

emitting multiple flashes of light from two of the four light emitting areas at a first specified duty factor for a first specified duration, and emitting multiple flashes of light from the other two of the four light emitting areas at a second specified duty factor for a second specified duration.

16. The method according to claim 15, wherein directing the one or more light beams comprises directing light of one color into a first eye of a target and directing light of another color into a second eye of a target.

17. The method according to claim 15, wherein the different colors comprise red, blue, green and white.

18. The method according to claim 15, wherein four light emitting areas having different colors are provided and flashing the light emitting areas in a pattern comprises emitting multiple flashes of light from the light emitting areas at a pseudo random durations and at pseudo random frequencies.

19. An apparatus for causing incapacitation comprising:

means for holding the apparatus with a human hand, wherein the means for holding the apparatus comprises a power source;

a housing coupled to the means for holding the apparatus, wherein the housing comprises:

means for emitting light at multiple wavelengths, wherein the means for emitting light comprises at least two spatially separated light emitting areas; and means for controlling the emission of light from the means for emitting light; and means for concentrating light, wherein the means for concentrating light is disposed to receive light from the means for emitting light, wherein the means for controlling the emission of light controls the means for emitting light to emit light at different wavelengths with a desired sequence.

20. The apparatus according to claim 19, wherein distances between the spatially separated light emitting areas provide that a viewer perceives light at different wavelengths coming from different locations when each light emitting area is exclusively enabled.

21. The apparatus according to claim 19, wherein the means for emitting light comprises a light emitting diode module having a red light emitting substrate, a blue light emitting substrate, a green light emitting substrate, and a white light emitting substrate.

22. The apparatus according to claim 19, wherein the means for emitting light comprises a light emitting diode module having a red light emitting substrate, a blue light emitting substrate, and a green light emitting substrate.

23. The apparatus according to claim 19, wherein the means for concentrating light comprises a structure that has an internal surface contoured to focus light from the means for emitting light into a beam.

24. The apparatus according to claim 19, wherein the means for concentrating light comprises one or more lenses.

25. The apparatus according to claim 19, wherein the housing further comprises a means for dissipating heat from the means for emitting light.

26. The apparatus according to claim 19, wherein the housing further comprises a means for dissipating heat from the means for controlling the emission of light.

27. The apparatus according to claim 21, wherein the means for emitting light is controllable for emitting colored light and for emitting white light.

28. The apparatus according to claim 24, wherein the means for emitting light is controllable for emitting light from all light emitting substrates to produce white light.

29. The apparatus according to claim 19, wherein the apparatus further comprises a means for programming the means for controlling the emission of light.

30. Apparatus for causing incapacitation comprising:

a handle and a head member, said head member comprising a light-emitting diode module having at least three dies consisting of at least a red die and a blue die and a green die; and an electronics assembly including a specially programmed processor operative to cause multiple flashes of light from the dies in a pattern comprising emitting multiple flashes from a first two of the at least three dies at a first specified duty factor for a first specified duration and emitting multiple flashes from a second, different two of the at least three dies at a second specified duty factor for a second specified duration.

* * * * *